US008257189B2

(12) United States Patent
Koudele et al.

(10) Patent No.: US 8,257,189 B2
(45) Date of Patent: Sep. 4, 2012

(54) ADVANCED GOLF MONITORING SYSTEM, METHOD AND COMPONENTS

(75) Inventors: Larry J. Koudele, Superior, CO (US); Guy R. Wagner, Loveland, CO (US)

(73) Assignee: GeoGolf, LLC, Superior, CO (US)

( * ) Notice: Subject to any disclaimer, the term of this patent is extended or adjusted under 35 U.S.C. 154(b) by 509 days.

(21) Appl. No.: 12/415,515

(22) Filed: Mar. 31, 2009

(65) Prior Publication Data

US 2009/0253526 A1 Oct. 8, 2009

Related U.S. Application Data

(60) Provisional application No. 61/042,125, filed on Apr. 3, 2008.

(51) Int. Cl.
*A63B 69/36* (2006.01)
*A63B 67/02* (2006.01)

(52) U.S. Cl. ..... 473/155; 473/199; 473/200; 473/353; 473/409

(58) Field of Classification Search ..... 473/131, 473/155, 199, 200, 353, 409; 702/3, 152
See application file for complete search history.

(56) References Cited

U.S. PATENT DOCUMENTS

| | | | | |
|---|---|---|---|---|
| 3,996,590 | A * | 12/1976 | Hammack | 342/465 |
| 4,799,062 | A * | 1/1989 | Sanderford et al. | 342/450 |
| 4,926,161 | A | 5/1990 | Cupp | |
| 5,346,210 | A | 9/1994 | Utke et al. | |
| 5,423,549 | A | 6/1995 | Englmeier | |
| 5,564,698 | A | 10/1996 | Honey et al. | |
| 5,873,797 | A | 2/1999 | Garn | |
| 5,912,644 | A * | 6/1999 | Wang | 342/457 |
| 5,912,700 | A | 6/1999 | Honey et al. | |
| 5,953,077 | A | 9/1999 | Honey et al. | |
| 5,976,038 | A | 11/1999 | Orenstein et al. | |
| 6,113,504 | A | 9/2000 | Kuesters | |
| 6,270,433 | B1 | 8/2001 | Orenstein et al. | |
| 6,373,508 | B1 | 4/2002 | Moengen | |
| 6,607,123 | B1 | 8/2003 | Jollifee et al. | |
| 6,620,057 | B1 | 9/2003 | Pirritano et al. | |
| 6,634,959 | B2 | 10/2003 | Kuesters | |
| 2003/0228934 | A1 | 12/2003 | Corzilius et al. | |
| 2004/0014536 | A1 * | 1/2004 | Kuesters | 473/353 |
| 2005/0227792 | A1 | 10/2005 | McCreary et al. | |
| 2005/0233815 | A1 * | 10/2005 | McCreary et al. | 473/131 |
| 2005/0272516 | A1 | 12/2005 | Gobush | |
| 2008/0021651 | A1 * | 1/2008 | Seeley et al. | 702/3 |

FOREIGN PATENT DOCUMENTS

| | | |
|---|---|---|
| GB | 2267222 | 12/1993 |
| KR | 1020070093169 | 9/2007 |

* cited by examiner

*Primary Examiner* — Peter Dungba Vo
*Assistant Examiner* — Mukund G Patel
(74) *Attorney, Agent, or Firm* — Pritzkau Patent Group, LLC

(57) ABSTRACT

Monitoring of a golf ball and apparatus for doing so is described using differential time locating. Launch parameters of a golf ball can be characterized independent of any specific positional measurement on the basis of a ball signal that is transmitted from the ball. These parameters include initial spin, initial velocity, and initial trajectory. Ground proximity detection is described as well as a landing position and rollout position detection technique and associated apparatus. Calibration techniques are described for various kinds of range receivers that subsequently receive the ball signal.

14 Claims, 33 Drawing Sheets

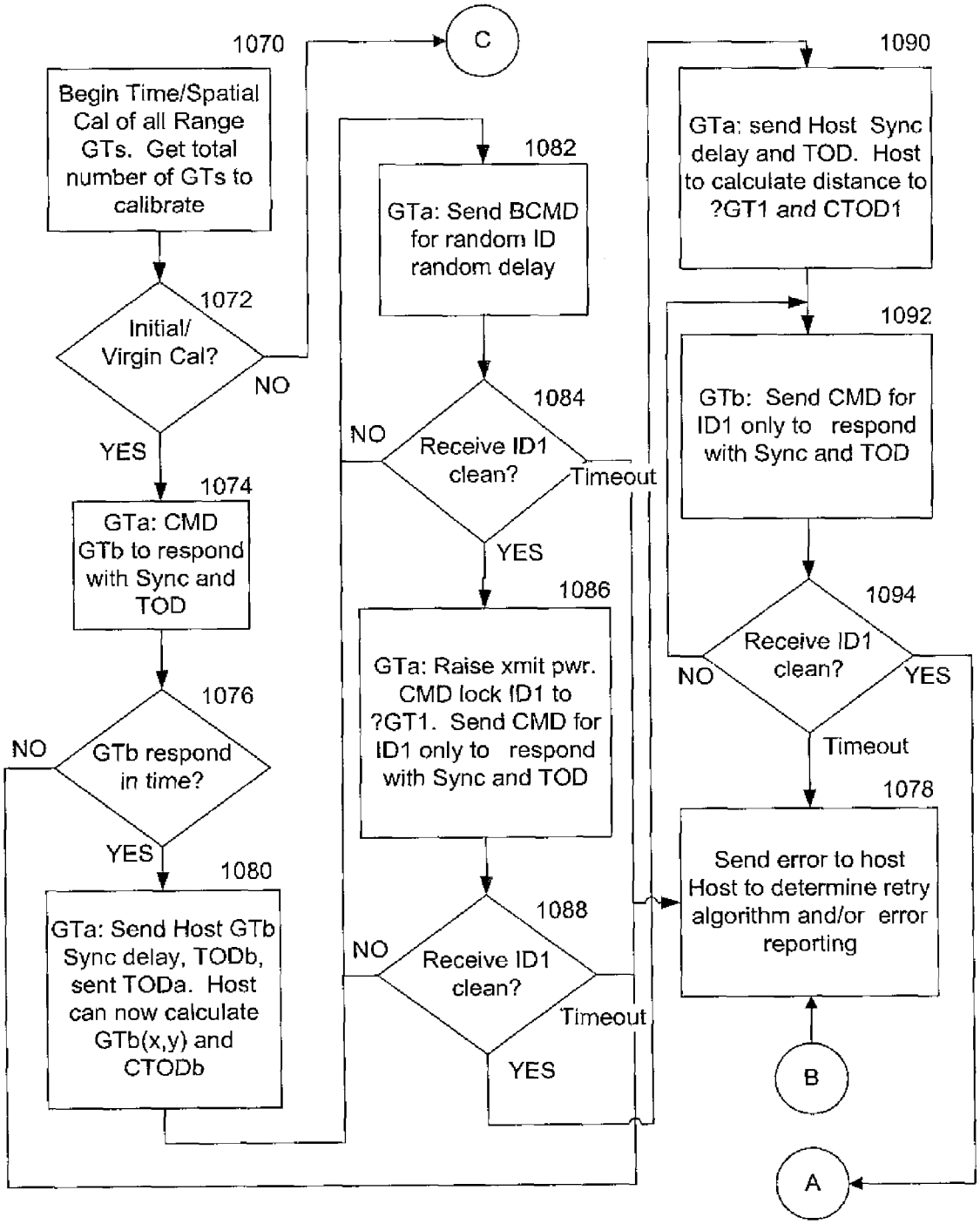
FIGURE 11e – sheet 1

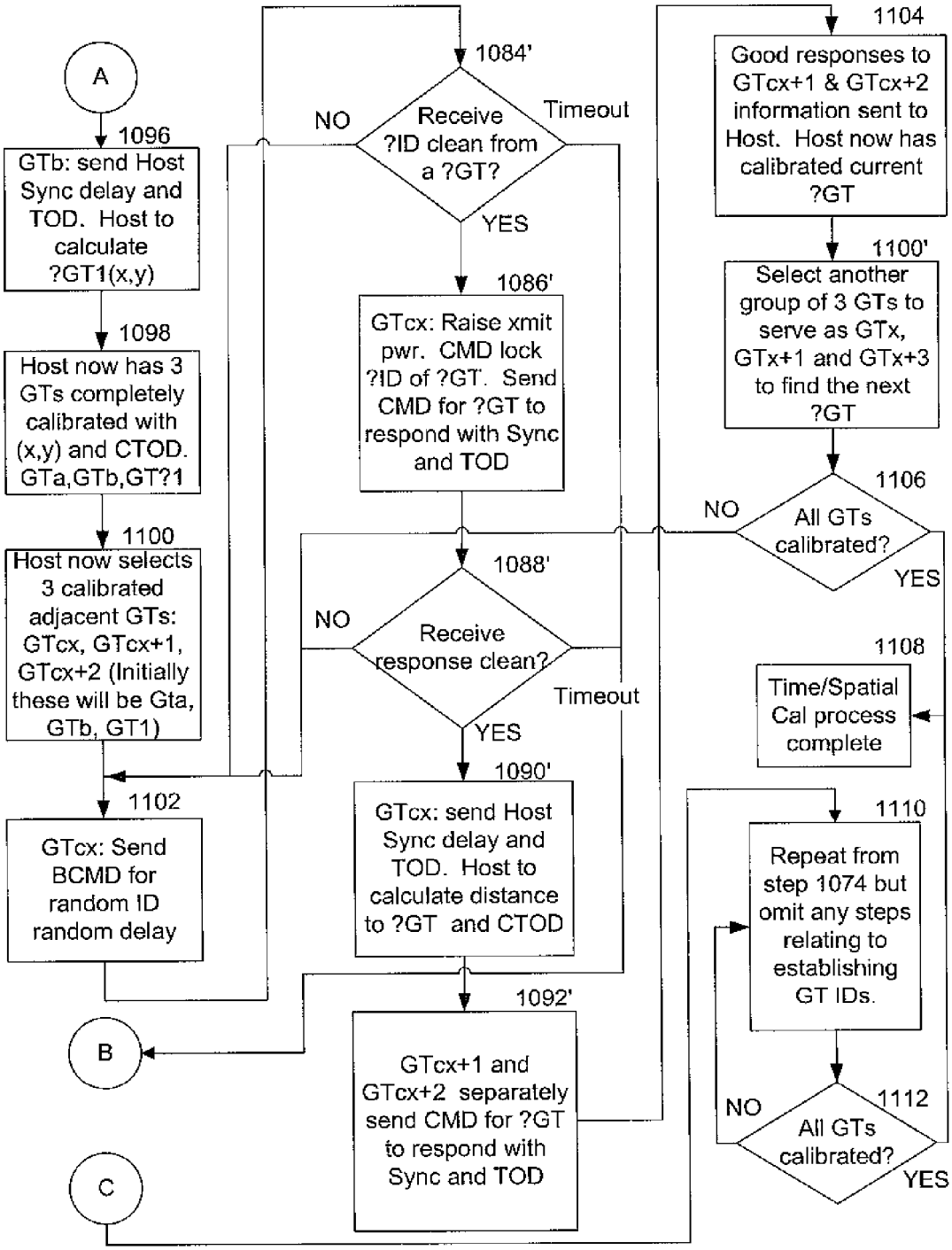
FIGURE 11e - sheet 2

ADVANCED GOLF MONITORING SYSTEM, METHOD AND COMPONENTS

RELATED APPLICATION

The present application claims priority from U.S. Provisional Patent Application No. 61/042,125, filed on Apr. 3, 2008, bearing the same title as the present application, and is incorporated herein by reference in its entirety.

BACKGROUND

The present application relates generally to characterizing certain parameters with respect to the travel of a golf ball and, more particularly, to characterizing the travel of a golf ball when hit under such circumstances as which may be encountered on a driving range.

The prior art has employed a number of approaches with respect to monitoring and/or tracking the flight of a golf ball. Many of these approaches use video recordings for such purposes. Often, an optically recognizable pattern is formed on the outer surface of the ball for use in such systems. Another approach, that has been taken by the prior art, resides in the use of radar to track the ball in flight. Of course, such an approach is limited with respect to any environment such as, for example, a driving range where multiple balls can be in flight at the same time.

More recently, a Radio Frequency ID (RFID) system has been suggested, as exemplified by U.S. Pat. No. 6,607,123 in which the golf ball includes a transponder that can be used to identify a particular ball in close proximity to a reading device that can be arranged next to a passage through which the ball is routed or beneath a tee-off mat. Unfortunately, this approach places unusual constraints on its installation environment through the use of ball return channels and zones, accompanied by relatively limited accuracy as to the actual location of the ball.

Still another prior art approach is seen in U.S. Pat. No. 6,113,504 which employs an array of receivers (see FIG. 5 of the patent) and a ball having a transmitter. The system appears to be able to locate a ball on a golf course using triangulation but is limited in other respects. For example, no information appears to be provided with respect to initial characterization of the flight of the golf ball, upon initially being struck by the golfer. This system is not so much oriented for use on a driving range, but appears to be primarily directed to finding a ball on a golf course.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In general, apparatus and corresponding methods are taught for use in a system for characterizing the movement of a golf ball assembly on a golf range having lateral extents. In one embodiment, the golf ball assembly transmits a ball signal at least from a landing location on the golf range based on a detected proximity of the golf ball assembly to a surface of the ground. A plurality of at least four ground transceivers are distributed across the lateral extents of the golf range. Positional coordinates of at least the four ground transceivers are determined such that the four ground transceivers form a group of ground transceivers that are at known locations. The ball signal is received at each one of the ground transceivers in timed relation to one another. A selected one of the ground transceivers is identified as a reference transceiver such that the arrival time of the ball signal at the selected ground transceiver serves as a reference arrival time. A set of arrival time differences is established which includes a difference in arrival time of the ball signal at each of the other three ground transceivers as compared to the reference arrival time at the reference ground transceiver. A landing position of the golf ball assembly is determined in two dimensions with respect to the lateral extents of the golf range based on the set of arrival time differences.

In another embodiment, a golf ball is monitored at least for a period of time following a launch of the golf ball after being hit. A radio frequency signal is transmitted from the golf ball during the period of time. The radio frequency signal from the golf ball is received during the period of time, exclusive of any specific position of the golf ball during the period of time, to establish one or more parameters that characterize the launch of the golf ball, based solely on the received radio frequency signal. In one feature, the one or more parameters are selected as one or more of initial backspin at time of launch, initial velocity at time of launch and initial trajectory at time of launch. In another feature, the golf ball is configured for monitoring proximity to a surface of the ground to generate a ground proximity signal and the golf ball is detected as having been hit based on the ground proximity signal.

In yet another embodiment, in a system for monitoring a golf ball, a radio frequency signal is transmitted from the golf ball prior to and at least for a given period of time following the hit. The radio frequency signal is received from the golf ball prior to the hit and during the given period of time. The received radio frequency signal is monitored to establish at least one characteristic of the received radio frequency signal that is indicative of the ball having been hit, independent of establishing an in-flight position of the ball. In one feature, the radio frequency signal is emanated having a generally constant frequency such that the hit produces a Doppler shift of the received radio frequency signal and monitoring detects the Doppler shift, as the characteristic, to indicate that the hit has taken place.

In still another embodiment, in a system for monitoring a golf ball assembly, an oscillator is configured as part of the ball assembly to oscillate at an oscillation frequency that is dependent upon a proximity of the oscillator to the Earth such that the oscillation frequency changes responsive to the ball traveling with a vertical component of movement. The change in the oscillation frequency is monitored. Responsive to a predetermined change in the oscillator frequency, an output indication is generated based on the vertical component of movement of the ball assembly. In one feature, the indication at least generally corresponds to the ball being in contact with the ground. In another feature, the output indication at least generally corresponds to the ball being in-flight.

In a continuing embodiment, in a system for monitoring a golf ball assembly subsequent to the ball being hit, the ball assembly is configured for transmitting an electromagnetic signal to provide for the monitoring after being hit, which electromagnetic signal is based on a frequency that is generated by an oscillator that is carried by the ball assembly. The ball assembly is further configured to detect an external oscillator frequency when the ball assembly is exposed to the external oscillator frequency. Responsive to the detecting, a sequence is initiated in the ball assembly that causes the ball assembly to synchronize the frequency of the oscillator that is carried by the ball to the external oscillator frequency such that the electromagnetic signal is adjusted prior to the ball being hit.

In a further embodiment, a golf ball assembly forms part of a system. The golf ball assembly includes a golf ball and an electronics assembly that is carried by the golf ball including a proximity detector for detecting a flight status of the golf ball assembly based on a capacitance that changes responsive to a current distance between the golf ball assembly and a surface of the ground and provides an indication of the flight status for subsequent use. In one feature, the indication is responsive to one or both of the golf ball assembly landing on the surface of the ground and a vertical component of movement of the golf ball assembly away from the surface of the ground.

In another embodiment, a system characterizes the movement of a golf ball assembly on a golf range having lateral extents. The system includes a plurality of at least four ground transceivers distributed across the lateral extents of the golf range with determined positional coordinates of at least the four ground transceivers such that the four ground transceivers form a group of ground transceivers that are at known locations. A golf ball assembly includes a transmitter for transmitting a ball signal from an unknown location on the golf range for reception by the group of ground transceivers such that each one of the ground transceivers receives the ball signal in timed relation to one another and a ground proximity detector for detecting that the golf ball assembly has contacted a surface of the ground and providing an indication of the contact to initiate transmission of the ball signal from a landing position. A processing arrangement (i) identifies a selected one of the ground transceivers as a reference transceiver such that the arrival time of the ball signal at the selected ground transceiver serves as a reference arrival time responsive to the contact with the ground, (ii) establishes a set of arrival time differences including a difference in arrival time of the ball signal at each of the other three ground transceivers as compared to the reference arrival time at the reference ground transceiver, and (iii) determines a landing position of the golf ball assembly in two dimensions within the lateral extents of the golf range based on the set of arrival time differences.

In yet another embodiment, in a system for characterizing movement of a golf ball assembly on a golf range, the hit and launch of the golf ball assembly is electronically detected. Responsive to detection of the hit, an electromagnetic ball signal is transmitted from the ball assembly for a duration of a launch interval which duration is less than a flight time of the ball assembly following the hit. The ball signal is received during the launch interval to characterize a set of launch parameters that correspond to the hit. Responsive to a timeout of the launch interval, the transmission of the ball signal can be temporarily terminated while the ball assembly is in-flight such that the ball signal is not transmitted for a remainder of the in-flight time of the ball assembly. A landing of the ball assembly on the ground is detected. Responsive to detection of the landing, a landing interval is initiated by temporarily resuming transmission of the ball signal for at least approximately detecting a landing position of the ball assembly by transmitting the ball signal as a ball ID transmission in a plurality of discrete and randomly spaced apart periods during the landing interval. At least one ball ID transmission is received as the ball signal, during the landing interval, to identify a landing position of the ball assembly. In one feature, at a conclusion of the landing interval, the transmission of the ball signal is terminated and a rollout period is initiated to provide for rollout of the ball assembly subsequent to landing. After a termination of the rollout period, transmission of the ball signal is temporarily resumed for at least approximately detecting a resting position of the ball assembly by transmitting the ball signal as the ball ID transmission in a plurality of discrete and randomly spaced apart periods during a final position detection period. At least one ball ID transmission is received as the ball signal, during the final position detection interval, to identify the resting position of the ball assembly.

In another embodiment, in a system for characterizing the movement of a plurality of golf ball assemblies that are simultaneously in play on a golf range. Each ball assembly is configured for transmitting a ball signal including a ball ID that is unique for each ball on the golf range. For a given one of the ball assemblies that has been previously hit and is in-flight, a landing of the ball assembly on the ground is electronically detected using an electronics package in the given ball assembly. Responsive to detection of the landing by the given ball, the electronics package initiates a landing interval by transmitting a plurality of ball ID transmissions from the given ball assembly in a plurality of discrete and randomly spaced apart periods during the landing interval. At least one ball ID transmission is received from the given ball, during the landing interval, to at least approximately identify a landing position of the given ball such that the landing position of the given ball is distinguishable from landing positions of other ones of the ball assemblies based on the plurality of random ball ID transmissions and a probability that at least one of the random ball ID transmissions from the given ball does not collide or interfere with another ball ID transmission from a different ball assembly.

In still another embodiment, in a system for characterizing the movement of a golf ball on a golf range having lateral extents, a plurality of more than three ground transceivers is distributed across the lateral extents of the golf range. Positional coordinates of at least three initial ones of the ground transceivers are measured such that the initial ground transceivers form a group of transmitters that are at known locations. A beacon signal is transmitted from another one of the ground transceivers that is at an unknown location. At least three ground transceivers, that are selected from the group of ground transceivers, are used to receive the beacon signal and to identify a location of the other ground transceiver based on a time of arrival reception of the beacon signal by the selected ground transceivers such that the other ground transceiver then becomes part of the group of ground transceivers at known locations.

In addition to the exemplary aspects and embodiments described above, further aspects and embodiments will become apparent by reference to the drawings and by study of the following descriptions.

BRIEF DESCRIPTION OF THE DRAWINGS

Exemplary embodiments are illustrated in referenced figures of the drawings. It is intended that the embodiments and figures disclosed herein are to be illustrative rather than limiting.

FIG. 11*e* is a flow diagram which illustrates one embodiment of a Time/Spatial calibration procedure for determining GT positions and which is described in the context of the system layout of FIG. 11*d*.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiment shown, but is to be accorded the widest scope consistent with the principles and features described herein including modifications and equivalents, as defined within the scope of the appended claims. It is noted that the drawings are not to scale and are diagrammatic in nature in a way that is thought to best illustrate features of interest. Descriptive terminology such as, for example, upper/lower, right/left, front/rear and the like may be adopted for purposes of enhancing the reader's understanding, with respect to the various views provided in the figures, and is in no way intended as being limiting.

Figure 1:
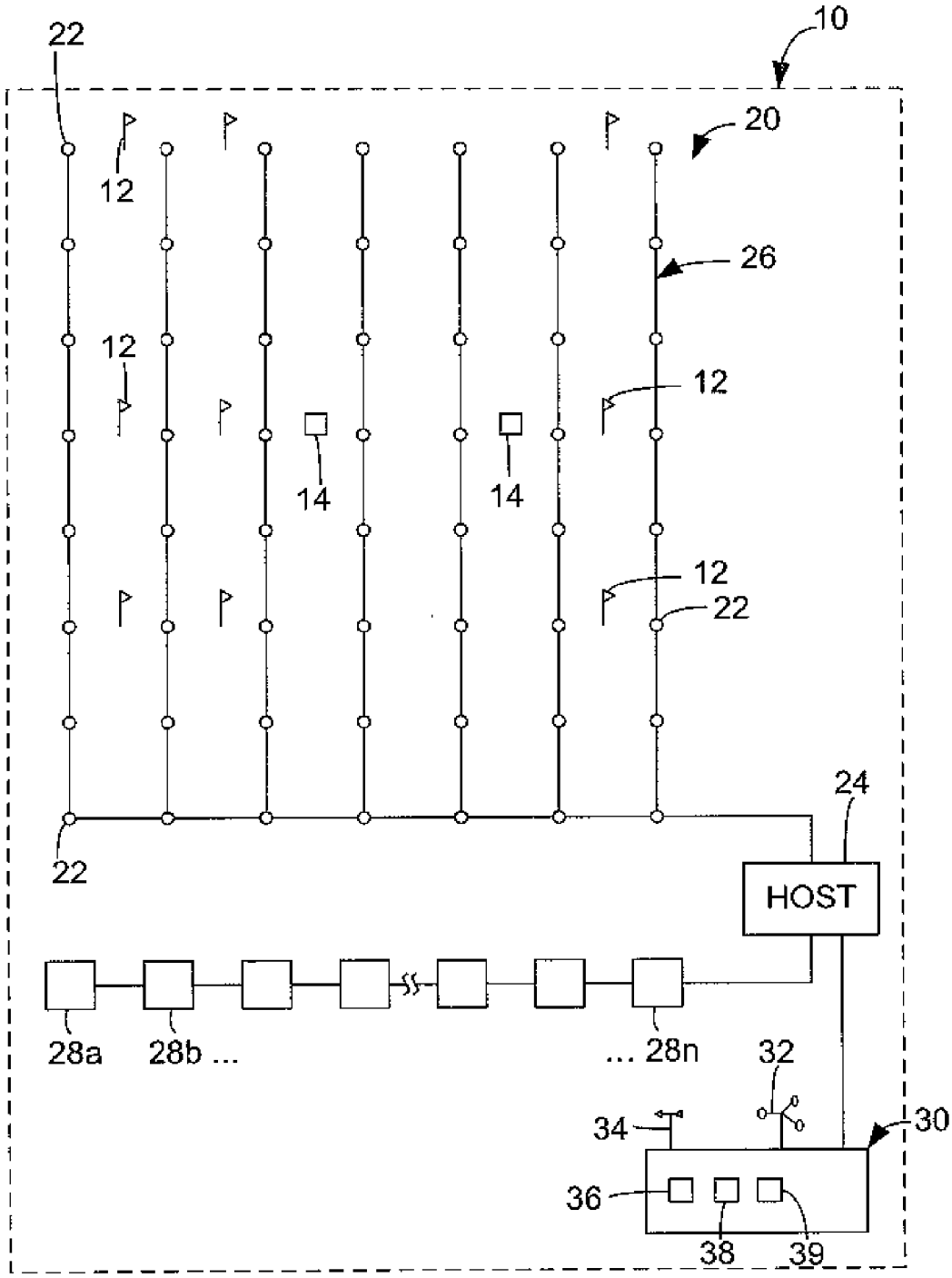
FIG. 1 is a diagrammatic plan view of a range including the system of the present disclosure.

Attention is now directed to the figures wherein like reference numbers may refer to like components throughout the various figures. FIG. 1 diagrammatically illustrates a golf driving range 10 (indicated within a dashed rectangle) that can have an arrangement of targets 12 and/or signs 14, as will be familiar to driving range patrons, for purposes of providing something to shoot for and some general indication of range. On range 10, a system 20 is installed. The system includes an array of ground transceivers (GTs) 22 that are arranged in an orthorectangular pattern, a hexagonal pattern or some other suitable pattern, although a pattern is not a requirement, the GTs may be arbitrarily arranged, and the number of GTs that are required may vary greatly, depending on receiving range, and other factors, as will be further described. The ground transceivers are in communication with a host 24 using any suitable communication arrangement or protocol that can be provided by a system of buried cables 26 or wireless communication techniques, yet to be described. It is noted that system 20 can include information relating to the specific configuration of the driving range such as, for example, the locations of targets 12 and signs 14. It should be appreciated that in some embodiments wired GTs can effectively operate as receivers since there is no need for these wired GTs to transmit wirelessly to other GTs and their operation may be limited to receiving the ball signal. As will be seen, system 20 can provide feedback to the user such as, for example, distributions of balls that are intended to be hit to a given target. Such information is useful to a golfer, for instance, to assist in choosing golf clubs, to identify shot characteristics, accuracy, and other shot variations, all of which are useful as parts of a learning system. In other cases, there can be a gaming embodiment (where users compete against themselves or other players). Competition is not limited to others on the same range. In this regard, it is considered that, once the information is available for a particular shot, as characterized in the highly advantageous manner of the teachings herein, it can be used in a virtually unlimited number of ways insofar as what is actually presented to the user, as well as other audiences, even world wide, having an interest in the information that can be made available.

When using a buried cable embodiment, suitable communication arrangements include, but are not limited to Ethernet, or any other suitable wired communication method. Using such a wired scheme, power may be provided to the GTs via cables 26. The GTs may be installed below the ground, may be installed in a low profile surface mounting scheme, or may be mounted in any convenient configuration which is efficient for the system. In any case, the mechanics and ground mounting of the GTs are in no way limited to any particular method. The GTs may include a suitable antenna. This antenna may extend above the surface of the ground, although this is not a requirement. There may also be multiple antennas in each GT, which may be of multiple directional configurations, where more than one antenna is used for one purpose (such as receiving ball communications), and other antennas are used for another purpose (such as GT to GT or GT to host communication). This will become apparent as the description is presented.

The GTs may be wireless or wired for purposes of communicating with host 24. Power for GTs may be wired, solar, or use some other method. System 20 further includes a plurality of tee stations 28*a-n*. Although the tee stations are shown as being aligned one-for-one with a column of GTs, this is not a requirement and there may be more or fewer tee stations than the number of columns of GTs, depending on range considerations with respect to the GTs, as will be further described. System 10 further includes a weather sensor arrangement 30 that can relay weather-related information to host 24 in any suitable manner such as for example through a cable or wirelessly. The weather sensor arrangement can include, for example, an anemometer 32 or other suitable expedient for detecting wind speed, a wind direction detector 34, a humidity sensor 36, a thermometer 38, an altimeter 39 and any other suitable instrument. In one embodiment, weather information data can be attached or associated with each ball hit, as an input to provide additional information as to the effect of the weather, for example, on each shot. Thus, the weather information needed can include, but is not limited to wind direction, wind velocity, altitude, humidity, and temperature in any desired combination. The location of weather sensor arrangement 30 is somewhat arbitrary, as long as it yields information that is sufficiently accurate for the particular driving range that it serves. In general, it may be located at a suitable position either on the driving range or adjacent to it.

Figure 2A:
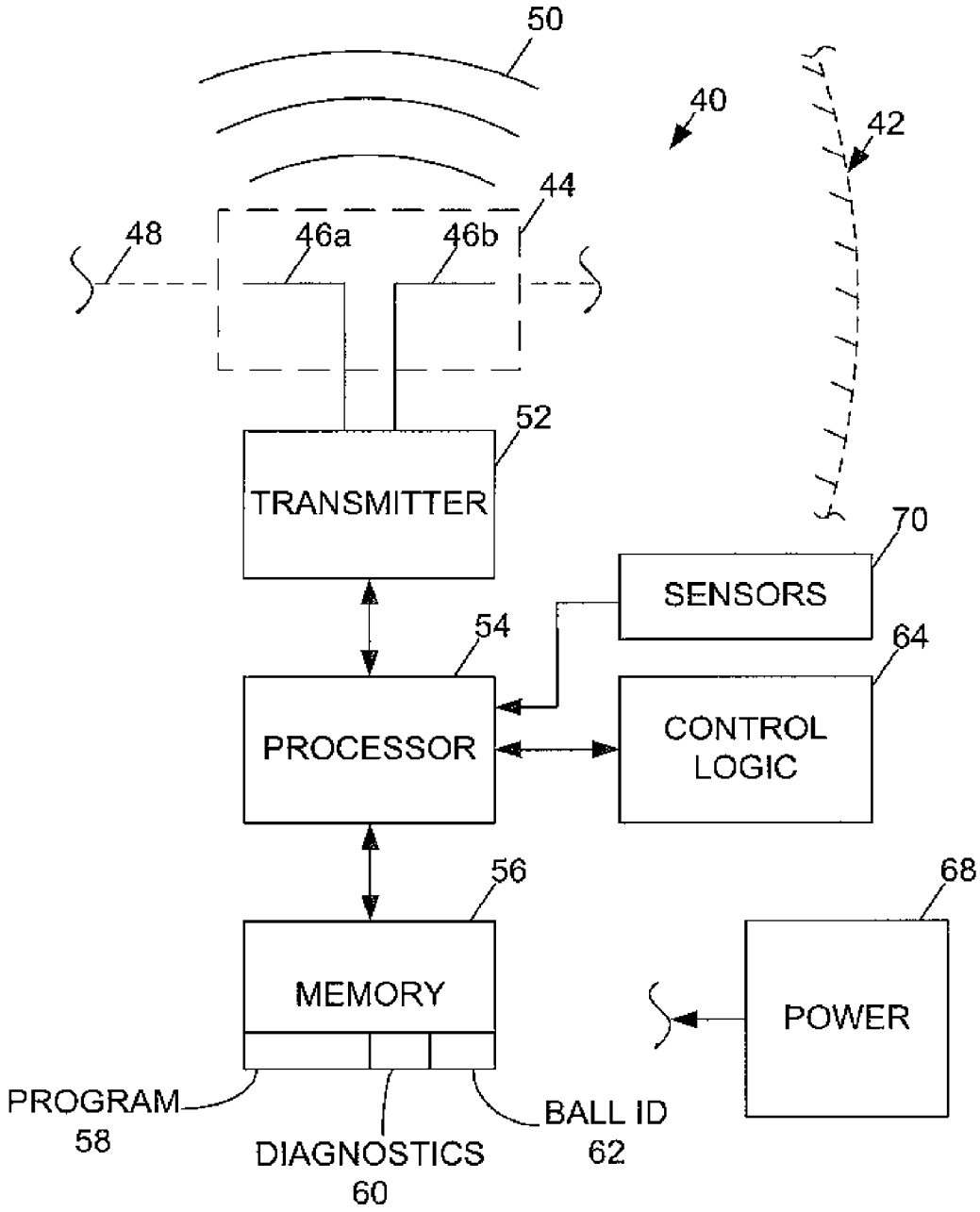
FIG. 2*a* is block diagram which illustrates one embodiment of an electronics section for use as part of a golf ball assembly.

FIG. 2*a* is a block diagram of one embodiment of an electronics section 40 of a golf ball assembly 42. The electronics section may be installed in the interior of the ball in any suitable manner and includes at least one antenna 44 having arms 46*a* and 46*b* that can be arranged along a diameter 48 of the ball, shown diagrammatically in relation to a partial outline of ball 42. It should be appreciated that the antenna is not required to be arranged along a diameter of the ball and may be offset therefrom. Other antennas may be included, for example, having antenna arms arranged transversely or orthogonal to the arms of dipole or other antennas and supported by the interior of the ball. It should be appreciated that any suitable antenna can be used, depending upon design objectives. For example, an omnidirectional antenna may be used which radiates a substantially uniform signal in three dimensions. The dipole antenna, of course, radiates the well-known dipole antenna pattern, which is axisymmetric. The ball signal is indicated by the reference number 50. Antenna 44 is connected to a transmitter 52. It is noted that, in some embodiments, a transceiver may be used in place of the transmitter, depending upon design objectives. It is noted that the transceiver or transmitter can include components for purposes of insuring frequency stability such as, for example, a crystal. In another embodiment, yet to be described, a crystal is not needed in the ball since suitable frequency stability is provided in another way. It should also be noted that when referring to the ball transmission frequency as a carrier, the term carrier is not limited to a fixed frequency, but can include the use of well known spread spectrum technology, which may consist of direct sequence, frequency hopping, or a hybrid of the two.

Transmitter 52 is, in turn, connected to a processor 54 which may comprise any suitable form of processing arrangement such as, for example, a microprocessor. Processor 54 uses a memory 56 which contains a program 58, a diagnostics section 60 and a ball identification or ID 62. It is noted that the ball ID can be permanent, for example, provided at the manufacturing facility or reprogrammable in the context of operation of the driving range. A control logic section 64 is further interfaced with processor 54 and may be used, for example, for purposes of providing power control, at least for purposes of conserving power, during various stages of operation of the golf ball assembly. A power section/source 68 is provided, as will be further described. As one option, a sensor section 70 can be provided which may include any suitable type of sensor such as, for example, an accelerometer, a mechanical shock sensor, a strain gauge and/or a ground proximity sensor, as will be further discussed below.

It should be appreciated that self-powering (i.e., the ball operating from its internal power source) is only needed from the initial "hit" by a golf club to a point in time shortly after the final rollout. Accordingly, reducing power consumption can have a positive influence on cost and design considerations. At all other times, the ball can either be powered externally, or essentially turned off (in an ultra low power mode). In this regard, the ball can employ techniques and electronic designs that conserve and lower power usage: Very fine geometry integrated electronics can lower power considerably; low duty cycle operation (use only when needed); and methods of transmission which lower average power, but allow for increased range may be employed. The ball requires a power storage device inside it (such as, for example, a battery or capacitor), and these power conservation techniques may serve to reduce the size and cost of such a power providing device. In the case of the ball being in a self-powered environment, where the ball is either on the range post-rollout, or in a storage area, the ball can go into an "off" state, where it uses virtually no power, aside from leakage currents. If during this time, the power source (battery, capacitor, or other device) goes completely dead, the ball still retains an ability to "wake up" and function when placed in a powering environment.

Figure 2B:
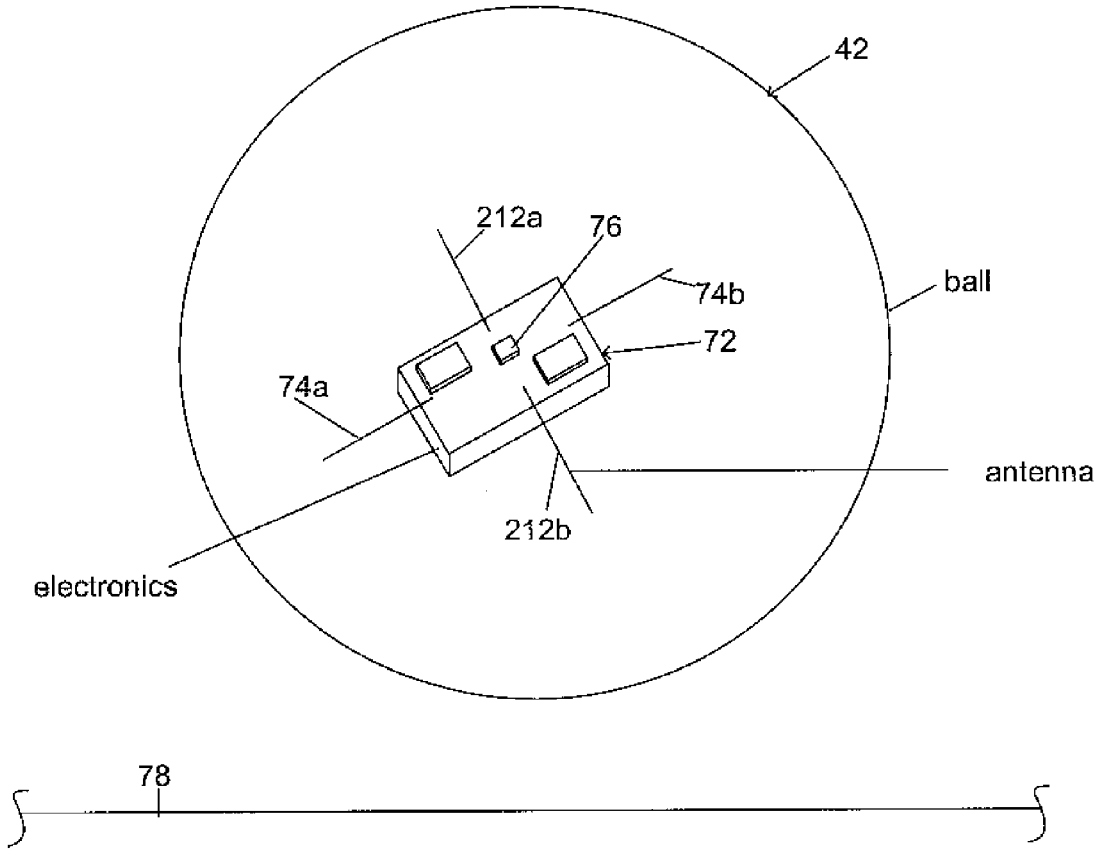
FIG. 2*b* is a diagrammatic view in perspective of the embodiment of the golf ball assembly of FIG. 2*a*, which is shown here to illustrate details with respect to its structure.

FIG. 2*b* is a diagrammatic view, in perspective, of ball assembly 42 wherein the aforedescribed functional electronic sections may be provided as parts of an electronics assembly 72, for example, mounted on a printed circuit board or its equivalent, integrated within a die or in some suitable combination as a chipset on a wiring substrate. In the present example, an additional antenna is provided which includes antenna arms 74*a* and 74*b* that are connected at least to a transmitter section which forms part of assembly 72. The additional antenna may be used for purposes of spin detection, ground proximity detection, both of which are yet to be described. It is noted that the antenna arms can themselves be formed as parts of a printed wiring pattern. In one embodiment, a ground proximity detector section 76 is provided for use in detecting the proximity of ball 42 to a surface 78 of the ground. The use of a ground proximity detector is considered to be a significant advance over the prior art. As stated earlier, it represents an embodiment that precludes the need for either an accelerometer, impact switch or their equivalent. Advantages attendant to using a ground proximity detector reside in lowering the cost of the system, simplifying the design, and making the design more robust. A ground proximity detector can be designed, implemented and used in a variety of ways while continuing to remain within the scope of the teachings herein.

Figure 2C:
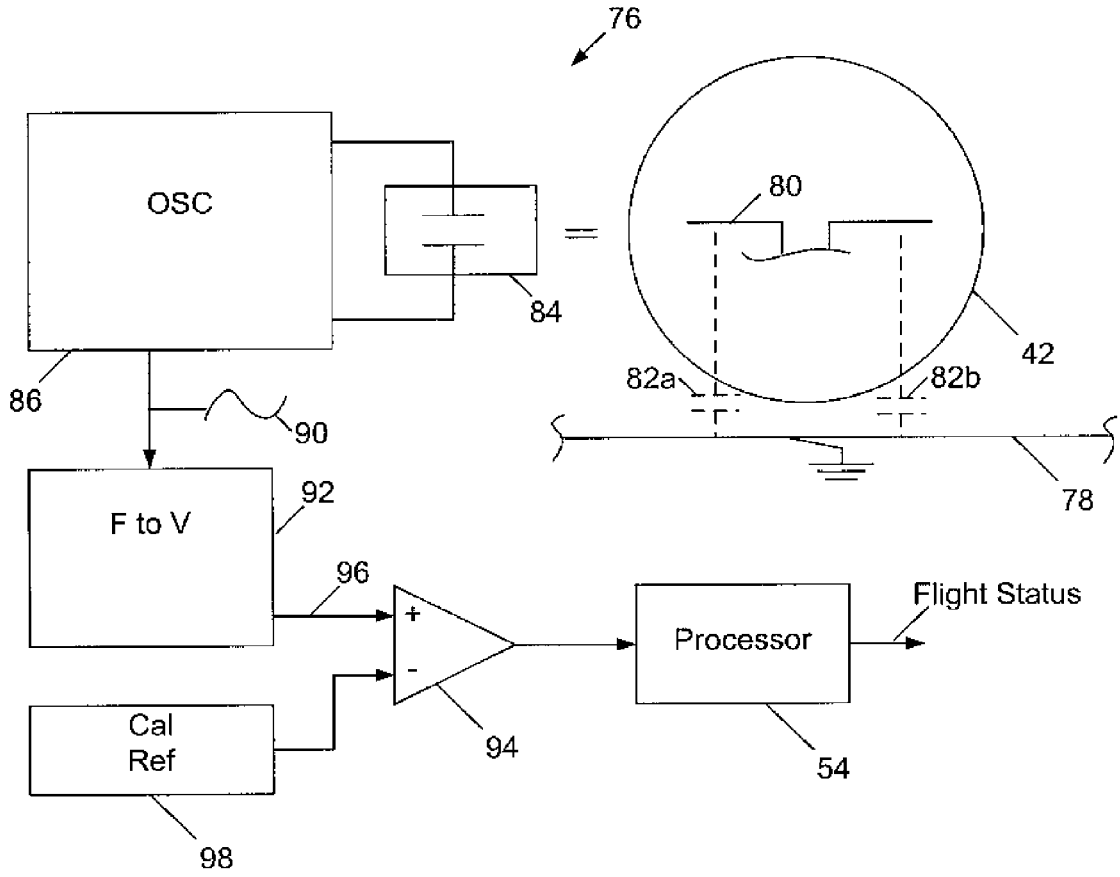
FIG. 2*c* is block diagram and diagrammatic representation of one embodiment of a ground proximity detector that may be used in a golf ball assembly according to the present disclosure.

Attention is now directed to FIG. 2*c*, in conjunction with FIG. 2*b*. The former illustrates one exemplary embodiment of ground proximity detector 76, as well as its manner of operation as installed in a ball 42 having an antenna 80 which itself includes a pair of antenna arms. As seen in FIG. 2*c*, equivalent capacitances 82*a* and 82*b* are set up between each antenna arm and ground 78. The ball may have multiple antenna stubs of various configurations. Between antenna stubs, internal circuitry sums up the capacitance. Ground (i.e., the Earth) has a capacitance effect on these antenna elements. The amount of capacitance that is present will depend on many conditions. Irrespective of the source of the capacitance, however, if an appropriate calibration is performed, then any relatively small amount of capacitance variation can be detected, including changes resulting from changing proximity to the ground. Based on the foregoing, in one exemplary embodiment, an overall equivalent capacitance 84, which varies with changes in the illustrated equivalent capacitances, is connected to an oscillator 86 such that the oscillator runs based on the value of overall equivalent capacitance 84 so as to produce an oscillation frequency 90. It should be appreciated that there is no requirement to use an antenna in the context of proximity detection. For example, a dedicated structure can be used for proximity sensing and may be as straightforward as an electrically conductive plate that might resemble one plate of a capacitor. By way of example, the oscillator can be a well known multivibrator oscillator, having a frequency that depends on the combination of a resistor and capacitor, or a well known LC tank oscillator having a frequency that depends on the well known formula ($\frac{1}{2}\pi\sqrt{LC}$).

The oscillator frequency is provided to a frequency to voltage converter 92, which provides a converted DC voltage to the plus input of a comparator 94 on a line 96. A minus input of the comparator receives a calibration reference voltage from a calibration reference source 98. In one embodiment, comparator 94 outputs a high voltage (V+) whenever the converted DC voltage on the plus input is greater than the calibration reference voltage on the minus input. Calibration may be performed by setting the calibration reference voltage of source 98 based on the output voltage of frequency to voltage converter 92 when the ball is positioned on the tee or hitting mat, as will be further described. An offset in the calibration reference voltage may be used to prevent inadvertent or oversensitive toggling of the state of comparator 94. The output of comparator 94 may be monitored by processor 54 for a change in the output state of the comparator. In one embodiment, the comparator output is a binary output of either a low voltage (binary 0) or a high voltage (binary 1). Processor 54 takes actions responsive to the comparator output to generate a flight status output. It should be appreciated that proximity to the ground caused, for example, by a landing may be indicated by a change in the output of comparator 94 and reflected by the flight status output. Similarly, a change in the state of the comparator responsive to the ball, for example, being hit and launched can result in a change in the flight status output responsive to the vertical component of movement of the ball as detected responsive to ground proximity.

The ground proximity detector can be used to determine the following conditions:

1) When the ball is first hit from the T-station (either off a tee or off the mat surface)
2) When the ball either first contacts the ground following the hit, or comes near contacting the ground (both conditions may be considered as the same, because variation in the spatial location of the ball are not normally significant (a matter of a few feet at most).

Figure 2D:
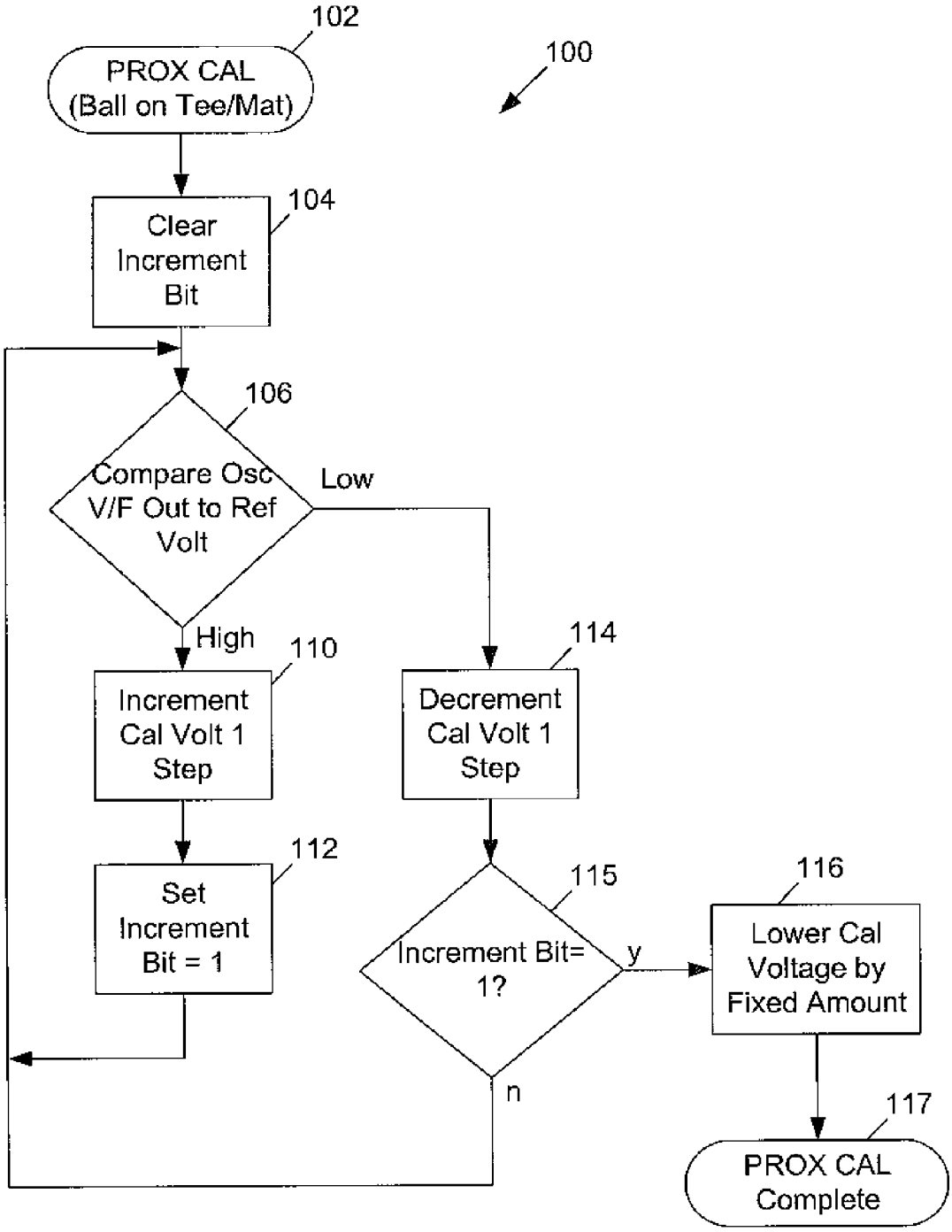
FIG. 2*d* is a flow diagram showing one embodiment of a method for the operation of the ground proximity detector of FIG. 2*c*.

Turning now to FIG. 2*d* in conjunction with FIG. 2*c*, additional details will now be provided with respect to one embodiment of a method for establishing the calibration reference voltage of calibration reference source 98, generally indicated by the reference number 100 which begins with step 102. Generally, for purposes of performing the calibration, the ball will be on the tee or on the hitting mat. For the example in FIG. 2*d*, the ball is instructed to perform a proximity calibration responsive to a specific charge frequency sent by the mat, and the ball then performs the proximity calibration. In another embodiment, the mat can be involved in the actual calibration. Other suitable embodiments may be implemented within the scope of this overall disclosure so long as they rely on the use and calibration of a proximity detector which resides in the ball.

In the example of FIG. 2*d*, the calibration is being performed in the ball. Any ball position may be used, so long as the ball is near or on the surface of the ground. At step 104, an increment bit stored, for example, in memory 56 of FIG. 2*a* is cleared. At step 106, the output of F/V converter 92 is compared to the reference calibration voltage. If the output of the F/V converter is greater than the reference calibration voltage, at 110, the reference calibration voltage is incremented by one step. Thereafter, at 112, the increment bit is set to 1. The procedure then returns to compare step 106 such that the reference calibration voltage can incrementally converge on the output voltage of the F/V converter. On the other hand, if the output of the F/V converter is less than the reference calibration voltage, at 114, the reference calibration voltage is decremented by one step. Step 115 then tests the increment bit to ascertain whether it is set to binary 1. If not, the procedure returns to step 106. If, on the other hand, the increment bit is set to binary 1, at 116, the calibration reference voltage can be lowered by a predetermined amount in order to insure stable operation. The process then concludes at 116.

With respect to the use of an oscillator such as, for example, oscillator 86, in a ground proximity detector, it should be appreciated that a level of stability is required in the free running oscillation frequency of the device in order to distinguish a change in the oscillation frequency that is attributable to a change in ground proximity from mere oscillator instability. Stability is also needed when the oscillator is used for clocking purposes, for example, by the processor in the ball. In one embodiment, a crystal can be used to provide stability. In another embodiment, a crystal is not needed in the ball. Advantages associated with removing the crystal from the ball include:

1) Cost of the crystal is avoided,
2) Physical space, that the crystal would otherwise occupy, can be used for other purposes, and
3) Shock relief provisions that would otherwise be needed to protect the crystal from mechanical shock, experienced by the ball, are not needed. It should be appreciated that this shock may approach 20,000 Gs.

A crystal free oscillator design for use in the ball may be referred to hereinafter as an NCO (non-crystal oscillator). In this case, the accuracy of the frequency of oscillator generation may be within approximately +/−0.2% of a targeted frequency, following appropriate calibration steps. In order to at least somewhat lessen this need, it is recognized that the GTs (ground transceivers) can allow some deviation in frequency which can be detected by the GTs, locked onto, and tracked. In this regard, using modern Phase Locked Loop (PLL) technology, once a carrier wave is received which is either exactly correct, or close to the correct frequency, a receiver PLL can lock onto the carrier and track it. This is well known in modern communications, and in fact is used in hard disk drives as common practice, because the rotational velocity of the disk can only be held within about +/−0.1% accuracy. Generally, in order to implement such PLL functionality, a short "preamble" frequency is needed for the host PLL, in the GT, to lock on, then data can be received as usual by the GT.

In the context of frequency stability of the ball oscillator, it should be appreciated that the total time from when the ball is hit to when rollout occurs and communication ends is generally less than approximately 15 seconds. Accordingly, this relatively short time period represents all the time for which the oscillator is required to maintain a sufficiently accurate frequency. When a PLL is used in the GTs, the oscillator frequency simply needs to be within the tolerance of the worst case PLL locking range of each GT, and can even be drifting after lock-on has occurred. The PLL will track this drift at least within the GT tracking range.

Figure 2E:
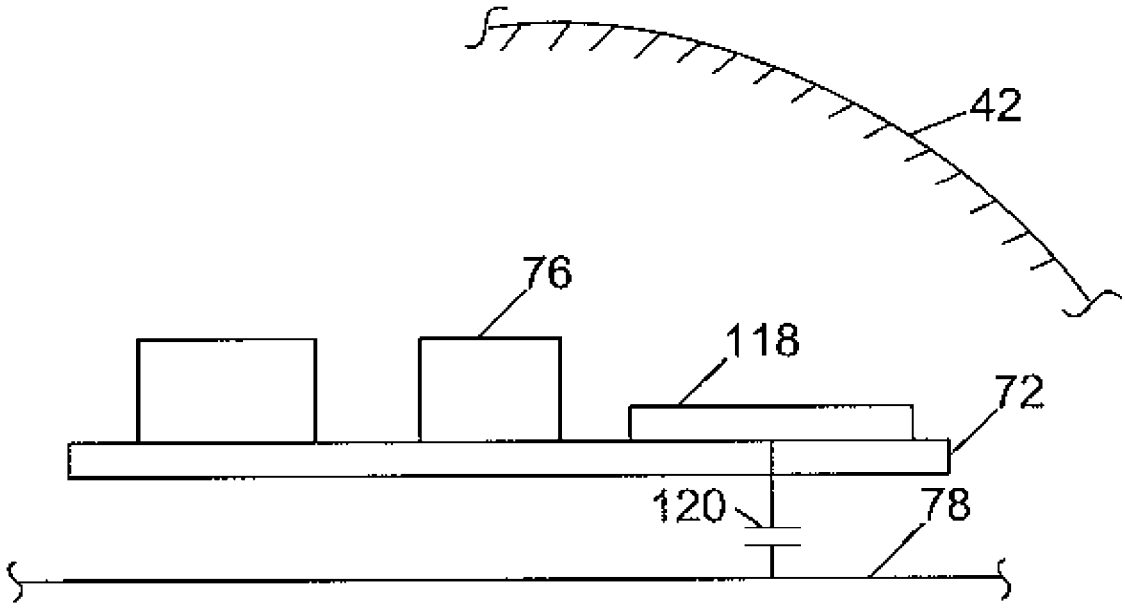
FIG. 2*e* is a diagrammatic view, in elevation, which shows another embodiment of a ground proximity detector according to the present disclosure which may be used as part of a golf ball assembly.

FIG. 2*e* is a diagrammatic illustration of another embodiment of proximity detector 76 that can be implemented as part of aforedescribed electronics assembly 72, in ball 42, using a plate-like member 118 such that effective capacitance 120 is formed between member 118 and ground 78. It is noted that the plate-like member can be in any suitable form including a flat or curved sheet material such as a portion of an electrically conductive trace. While the electronics assembly and capacitor plate member are illustrated as appearing to be adjacent to the periphery of ball 42 for purposes of illustrative convenience, these components will generally be spaced away from the periphery at least to provide for mechanical shock isolation.

Figure 2F:
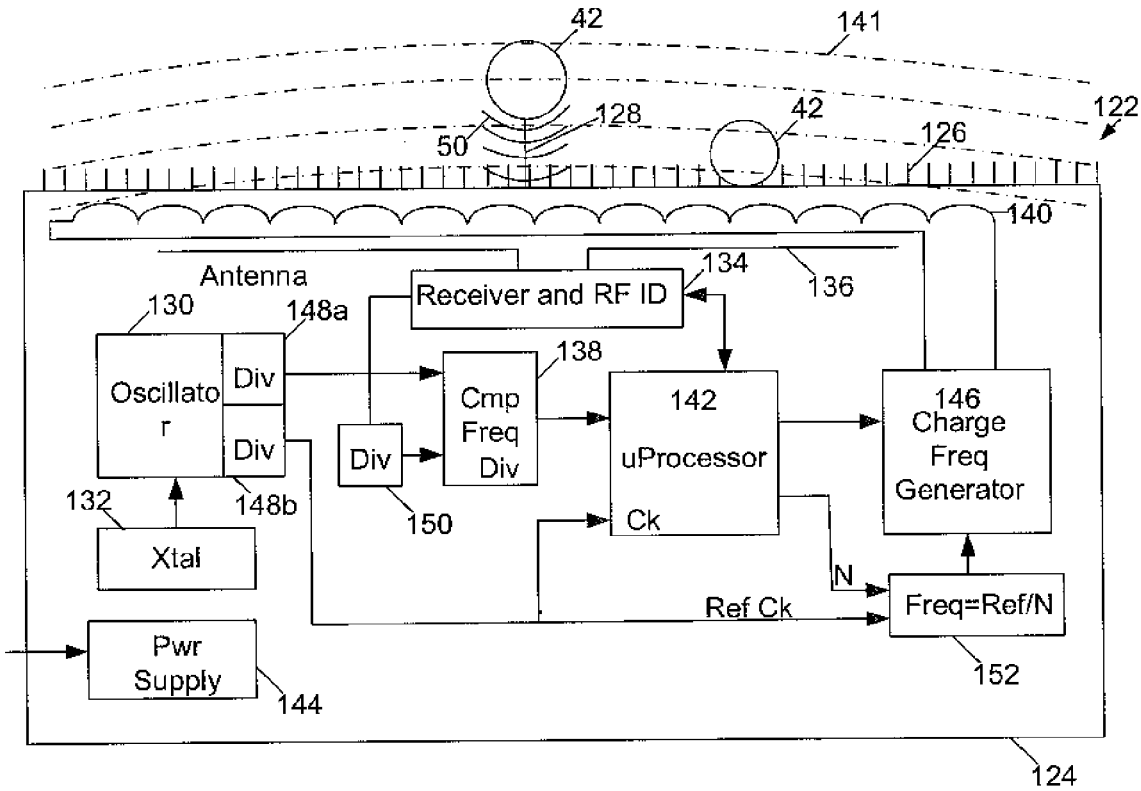
FIG. 2*f* is a diagrammatic view, in elevation, and block diagram form of a tee-off mat that is produced according to the present disclosure.

Attention is now directed to FIG. 2*f*, which illustrates one embodiment of a tee-off mat assembly that is generally indicated by the reference number 122. For purposes of clarity, the present description is limited to features of interest that relate to the mat assembly, although it is understood that other functionality may be present. In this exemplary embodiment of an NCO design, a mat 124 can include a grass-like surface 126, a tee 128, an oscillator 130 which can be connected to a crystal 132, a receiver amplifier 134 that can be of a low power variety, an antenna system 136 within or under the mat and a comparator 138 including a low frequency charging coil 140 that can emit a charge field 141, a microprocessor 142 with internal flash and ram memories, a power supply 144, a low frequency generator 146, oscillator dividers 148*a* and 148*b*, and a receiver divider 150. Charge Frequency (CF) generator 146 is connected to an input divider 152 which is controlled by the microprocessor, and provides for changing the charge frequency indicated as Ref Ck divided by N. The ball (in this embodiment) can sense the charge frequency of charge field 141, and can respond in specific ways, based on this frequency. As will be further described at an appropriate point below, when ball 42 is sitting on the tee or the mat, a specific low charge frequency can indicate to the ball that it is on the mat. As a result of the ball detecting that it is on the tee/mat, the ball transmits ID and status information. The mat can then respond with other charge frequencies which can initiate a variety of responses in the ball. For example, the ball may modify it's RF transmit frequency (if it uses an NCO implementation), perform a ground proximity calibration (if it uses a ground proximity detector), or cause the ball to arm itself for being launched (assuming that conditions are correct for launch status).

Figure 2G:
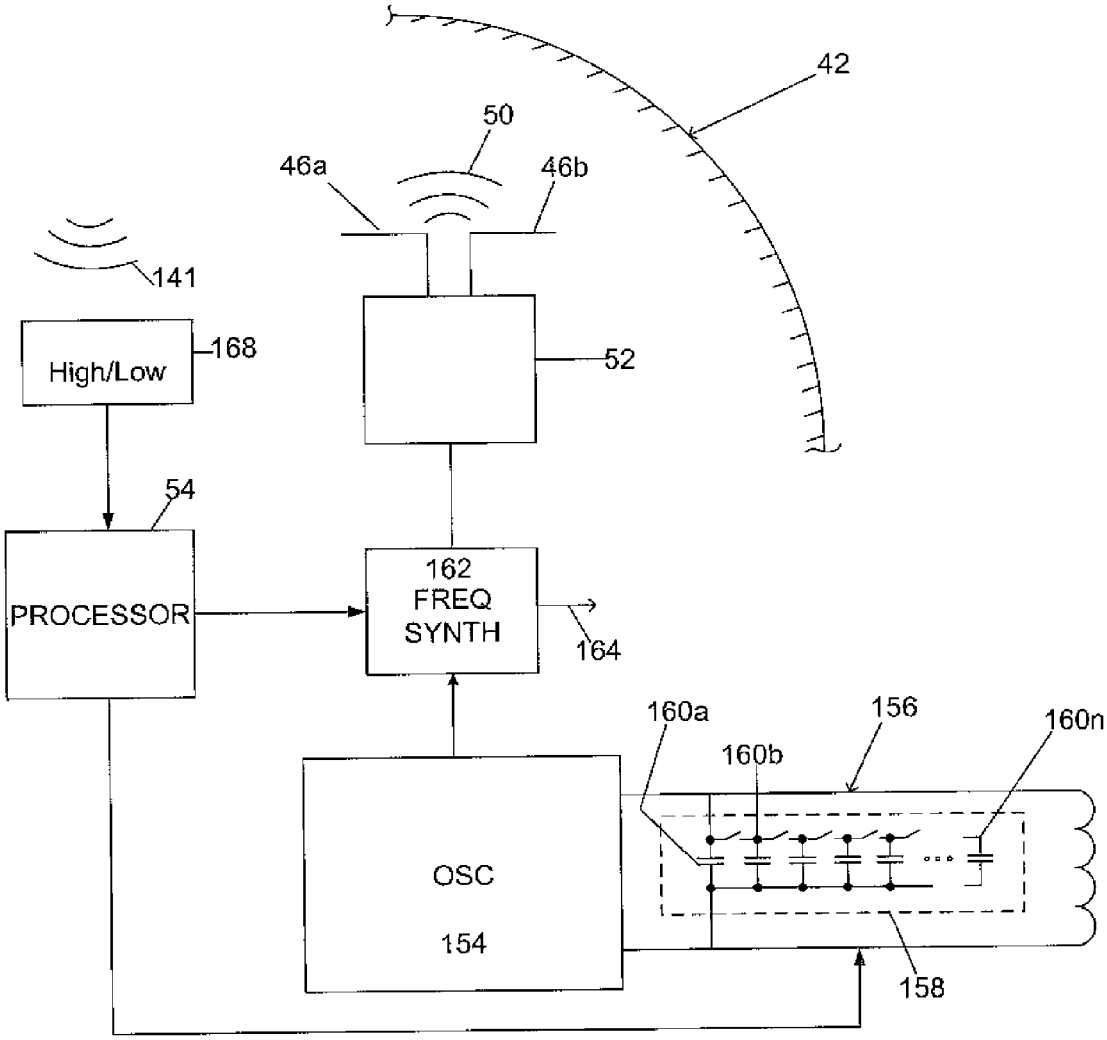
FIG. 2*g* is a block diagram which illustrates one embodiment of an arrangement for frequency calibration of a ball in accordance with the present disclosure.

Turning now to FIG. 2*g* in conjunction with FIG. 2*f*, one arrangement for use in frequency calibrating ball 42 is described. In the present example, the ball does not include a crystal. A high frequency tank circuit oscillator 154 includes an inductor 156 that, in one embodiment, can be built into an integrated circuit using metallized traces. In one embodiment, a variable reference capacitor 158, can be built into the IC, for example, using metallized traces and is controlled by processor 54. Reference capacitor 158 includes a plurality of sub-capacitors $\mathbf{160}_{b\text{-}n}$ that can be switched in or out in parallel with a first sub-capacitor $\mathbf{160}_{a}$, based, for example, on a binary word from processor 54. The variable reference capacitor is connected to a frequency synthesizer section 162 that generates a carrier frequency for transmitter 52. Synthesizer 162 can provide logic and clock signals 164 for use by other sections (not shown) of the ball. Initially, ball 42 transmits carrier frequency 50 (FIG. 2*f*) which is detected by mat assembly 122 using antenna 136. This frequency is fed into comparator 138 in the mat, which compares the ball transmitted frequency to the accurate frequency from crystal 132. Charging signal 141 can be very low (kHz to 10 s of kHz to hundreds of kHz) relative to the frequency that is transmitted by the ball. In one embodiment, the charging signal can be selected from two distinct frequencies, either a relatively higher frequency (Hi charge), or a relatively lower frequency (Lo charge). Either frequency can charge the ball, but they are sufficiently different that the ball can sense which is in use. The ball can respond, for example, to the high charge frequency by synthesizer 162 calibrating up (i.e., increasing) in its transmission frequency 50. On the other hand, if the low charge frequency is detected, synthesizer 162 responds, for example, by calibrating down (i.e., decreasing) in transmission frequency 50. In this way, by sensing such low frequencies, detection of the charge frequency can be performed by a charge circuitry section 168 of the ball. In this regard, the ball can go through a frequency calibration routine in cooperation with mat 124, as will be described immediately hereinafter. It is noted that, as long as the ball is proximate to the mat, the system can repeat this calibration at periodic intervals that can be based, for example, on the frequency stability of the ball circuitry. It should be appreciated that the principles of inductive charging are well known in the art.

Figure 2H:
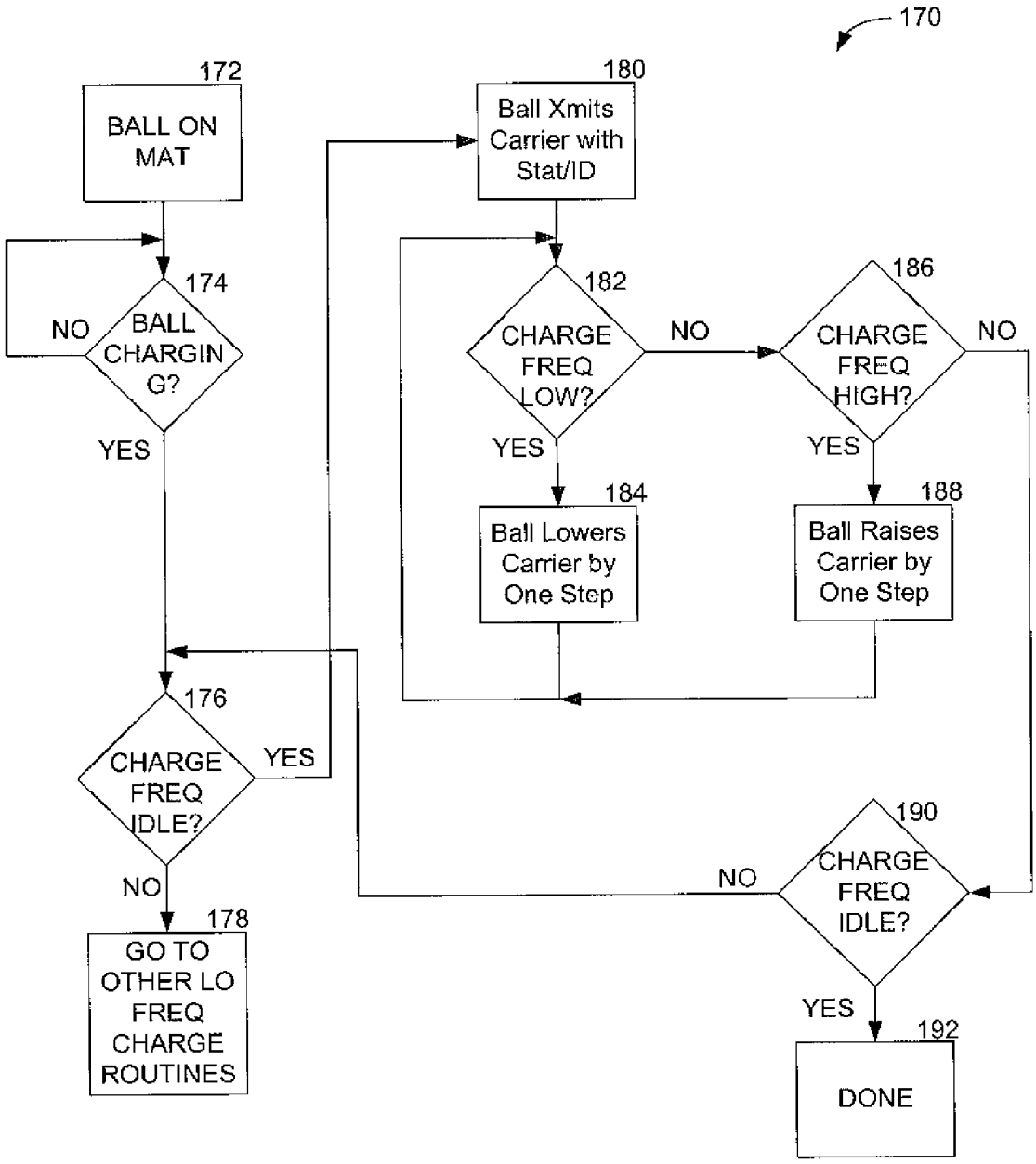
FIG. 2*h* is a flow diagram which illustrates one embodiment of a method for operation of the ball assembly during frequency calibration of its carrier frequency, for example, using the configurations of FIGS. 2*f* and 2*g*, respectively, of the tee-off mat and frequency calibration circuitry.

Attention is now directed to FIG. 2*h*, in conjunction with FIGS. 2*f* and 2*g*. The former illustrates one embodiment of a method for calibrating carrier frequency 50 of ball 42, generally indicated by the reference number 170, when the ball does not include sufficient long term or start-up frequency stability such as would be provided by a crystal controlled oscillator. It is noted that FIG. 2*h* illustrates NCO calibration from the point of view of the ball. Initially, the ball is placed on the mat at 172. Note that the ball senses that it is being charged at 174. The ball is configured so that its electronics operate responsive to charging. At 176, the ball is operating and determines if it is charging on the mat. If the charge freq is a CF Idle frequency (described in further detail below), then the ball is on the mat. If some other charging frequency is detected, the ball is being charged at some other location, which will cause the ball to respond or behave in a different way at 178. In the case of charging on the mat, in the embodiment being described, the ball initiates a frequency calibration by transmitting a carrier at 180 with status and ID information. At this point, the ball will calibrate its RF transmission frequency as commanded by the mat, until a frequency within the tolerance desired is reached. In particular, if a low charge frequency is detected at 182, the ball can lower its carrier frequency by one step at 184. On the other hand, if a high charge frequency is detected at 186, the ball can raise its carrier frequency by one step at 188. If the high charge frequency is not detected, at 190, the idle frequency is tested for. If the idle frequency is found the process is complete at 192. If, at 190, the idle frequency is not found, operation moves to 176. In this embodiment, the intelligence for RF frequency calibration is contained in the mat, and the ball responds to the mat. In any case, an NCO calibration can be performed, which calibrates the frequency of the ball within a specified tolerance, including the case of the ball using spread spectrum transmission technology.

Figure 2I:
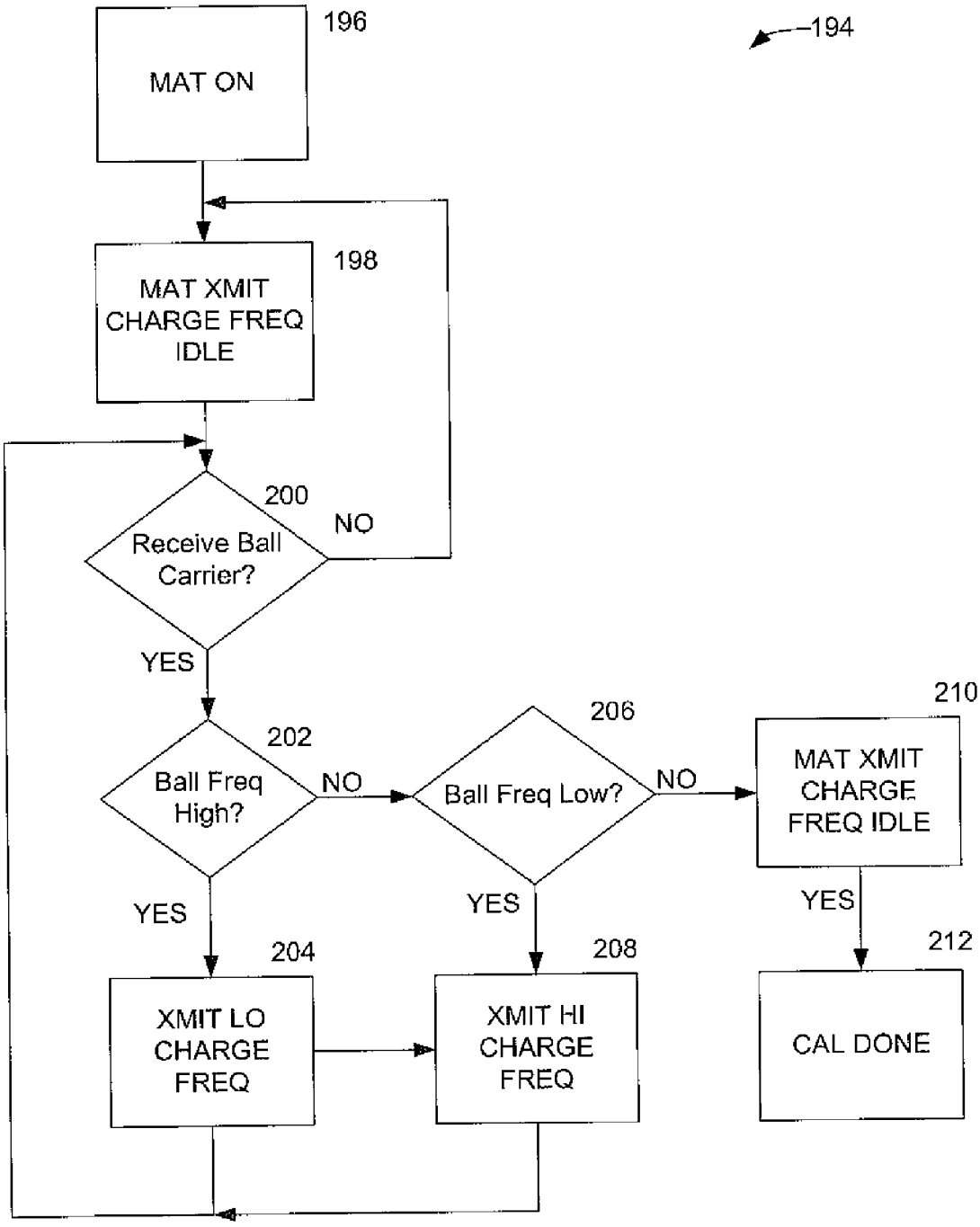
FIG. 2*i* is a flow diagram which illustrates one embodiment of a method for operation of the tee-off mat which cooperates with the frequency calibration of FIG. 2*h*.

FIG. 2*i* is a flow diagram, generally indicated by the reference number 194 that illustrates NCO calibration from the point of view of the mat. Accordingly, it should be appreciated that this procedure cooperates with the procedure of FIG. 2*h*. One embodiment of the configuration of the mat is illustrated in FIG. 2*f*. The mat is on at 196 and transmits the idle charge frequency at 198 using antenna 140 and as generated by charge frequency generator 146 responsive to microprocessor 142. At 200, using receiver 134, microprocessor 142, checks for reception of ball carrier 50. If no ball carrier is received, steps 198 and 200 are repeated in a loop. If, on the other hand, a ball carrier is received, step 202 tests for whether the ball frequency is higher than a targeted value. For this purpose, comparator 138 compares the output of divider 150 with a reference signal from divider 148*a* and provides a signal to microprocessor 142. If the ball frequency is high, step 204 is entered which causes microprocessor 142 to produce the value N such that frequency divider 152 causes charge frequency generator 146 to produce the low charge frequency. If, on the other hand, at step 202, the ball frequency is not high, step 206 tests for a low frequency condition of the carrier. If the carrier is lower than a targeted value, step 208 then causes microprocessor 142 to produce the value N such that frequency divider 152 causes charge frequency generator 146 to produce the high charge frequency. At step 206, however, if the ball frequency is not determined to be low, microprocessor 142 produces the value N such that frequency divider 152 causes charge frequency generator 146 to produce the idle charge frequency at 210. In other words, the ball carrier frequency is within a targeted, acceptable range and the calibration is complete at 212.

Figure 3:
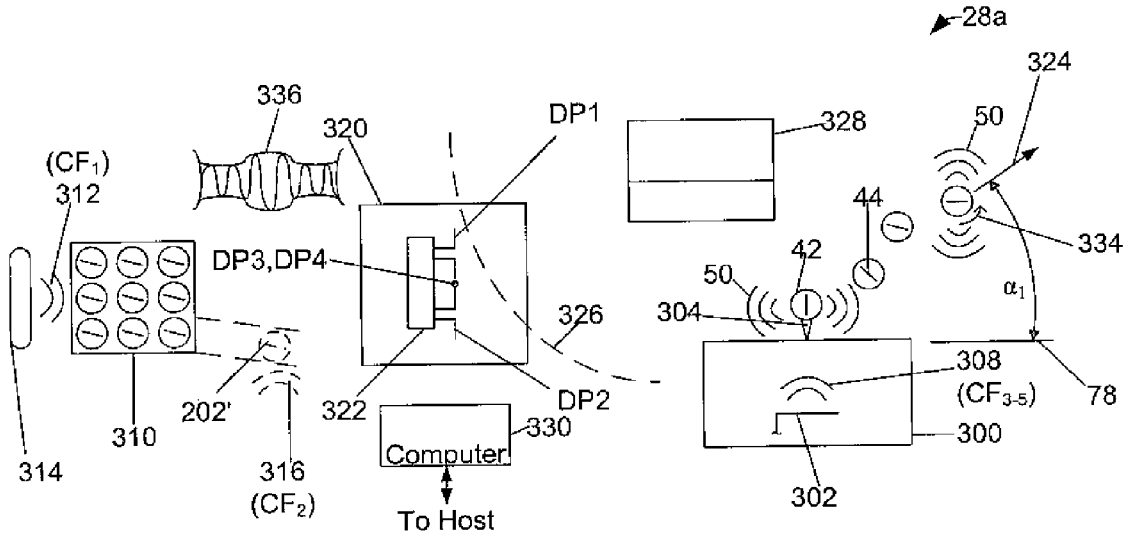
FIG. 3 is a diagrammatic view, in elevation, of one embodiment of a tee station that is produced according to the present disclosure.

Attention is now directed to FIG. 3 which illustrates tee station 28*a*, where all of the tee stations are essentially the same, in a diagrammatic elevational view. Each tee station includes a tee-off mat 300 that optionally supports an antenna 302 for use in receiving signals from the ball assembly such as, for example, the ball ID, internal power status, which may include battery charge and an indication that the ball is ready to be struck (which may be referred to as being armed). For an NCO embodiment, the mat configuration of FIG. 2*f* can be used in conjunction with appropriate calibration procedures and mechanisms, as described above. Ball assembly 42 may sit on a tee 304, above or sufficiently near antenna 302 for purposes yet to be described. In one feature, a charger can be arranged to couple magnetic energy 308 into ball assembly 42, from antenna 302, to a suitable energy storage arrangement in the ball which may include, but is not limited to a battery or a capacitor. In this embodiment, the ball can sit on the tee indefinitely, since its power storage arrangement can be continuously charged. The ball can then begin transmitting when hit, as detected in any suitable manner or transmit continuously on the tee. In one embodiment, loss of signal with antenna 302 can be used as an indication that the ball assembly has been hit and launched, as will be further described below. In this regard, the use of a shock sensor, strain gauge or accelerometer is not necessary for detecting that the ball has been launched. Of course, the use of a proximity detection configuration likewise avoids the need for such sensors.

In one embodiment, the strike of the ball can be sensed from a sudden loss of the low frequency charging signal from the mat. Depending on the configuration of the antennas, this loss of signal may be a $1/R^2$ function (R being the distance from the ball to antenna 302), so it will occur very quickly following the hit. Upon sensing that this sudden loss of low frequency charge signal has occurred, the ball can begin an interval I1 transmission, yet to be described, which will allow the trajectory, launch velocity, and spin to be detected, as will be described at an appropriate point below.

Continuing to refer to FIG. 3, in one embodiment, a ball dispenser and charging station 310 may be provided which wirelessly charges a basket of balls using a magnetic charging field 312. Further details will be provided below with respect to a ball dispenser/charging station and in reference to a subsequent figure. The charging station of the present figure can be provided proximate to the tee station or the balls can be pre-charged by the driving range operator, prior to providing the basket of balls to the golfer. For charging purposes, the charging station can include an inductive coil 314 that is positioned in suitable proximity with respect to the balls that are to be charged, so as to emit magnetic flux 312. In any embodiment where the ball is charged on the tee or tee-off mat, the frequency of charging signal 308 (whether the Idle, high or low) can be different, for example, from charging signal 312, that is used by standalone charging station 310, such that the specific charging signal, to which the ball is being subjected, can be distinguished by processor 54 in the ball, in addition to charging the ball's internal power source. Detection of the origin of the charging signal can be used to initiate particular behaviors of the ball. As another example, the ball can transmit status information responsive to detecting tee charging signal 308. Further, on the tee, the status information can be transmitted at a low power by carrier 50 since receipt of the tee charging signal indicates that that ball is on the tee-off mat and very near the antenna that is intended to receive the status information. As another example, the ball can enter an arming sequence so that it is ready to be hit. For example, the ball may begin transmitting ball signal 50. Consistent with the foregoing, in one embodiment, charging signal 312 of charging station 310 is selected so that its frequency elicits no response from the balls, whereas the frequency of tee charging signal 308 (Hi charge, Lo charge or otherwise) does elicit a response. In another embodiment, an arrangement can be provided for dispensing an individual ball 42' (shown in phantom) into a feed tube (also illustrated in phantom). In this way, ball 42' can be subjected to another magnetic charge frequency signal 316. This latter signal can be distinct in frequency or other suitable characteristic from signals 308 and 312 so as to be identifiable by processor 54 (FIG. 2*a*) to initiate transmission of selected information by the ball such as, for example, status information and other self test information. Accordingly, any number of different charging frequencies can be used, along the path of travel of the ball so as to illicit different responses from the ball.

In one embodiment, the tee-off station further includes a tracking receiver 320, immediately to the rear of the tee-off mat and conveniently out of the way of a golfer using the station or at another suitable location proximate to the tee-off mat. Tracking receiver 320 includes a pair of antennas which, in the present example, are dipole antennas that are indicated as DP1 and DP2. The antenna arms of DP1 and DP2 are, at least approximately, coaxially arranged and connected to an array receiver 322. In this regard, ball assembly 42 is illustrated at four positions along a launch trajectory 324 which forms an angle $\alpha_1$ with horizontal and is referred to as the launch elevation angle of the ball after having been struck by a golfer. It is noted that ball signal 50 (shown only for two positions) is transmitted from the ball assembly, at least upon its departure. The golfer's club has not been shown for purposes of illustrative clarity. A particular RF transmission from the ball signal 326 is illustrated as a dashed line, the curvature of which is exaggerated for illustrative purposes, which would result from transmission of signal 50 at a particular distance from the tee-off mat. It is apparent, in view of particular RF transmission 326, that the RF waves will impinge antenna DP1 in an earlier phase than they will impinge antenna DP2. This phase difference, when the signals from these two antennas are compared, is mathematically related to launch elevation angle $\alpha_1$. Thus, $\alpha_1$ can be determined based on the detected phase difference In any embodiment, tee-off station 28*a* can include a display 328 that is used to display various information to the station user and for receiving inputs from the user, as will be further described. All of the aforedescribed components of the tee-off station may be connected to any suitable processing and control arrangement such as, for example, a computer 330 which, in one embodiment, may be a personal computer that is connected to host 24. The interconnections of the various components have not been shown for purposes of illustrative clarity.

Figure 4A:
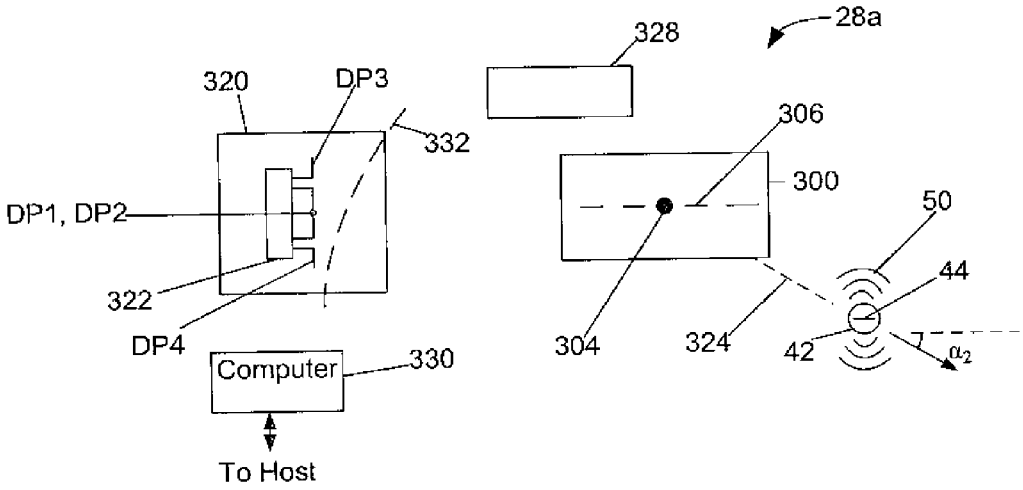
FIG. 4*a* is a diagrammatic plan view of the tee station of FIG. 4, shown here to illustrate further details of its structure and operation.

Turning now to FIG. 4*a*, tee-off station 28*a* is shown in a diagrammatic plan view with ball 42 departing on launch trajectory 324. In this regard, tracking receiver 320 includes dipole antennas DP3 and DP4, having antenna arms that are at least approximately coaxially arranged with respect to one another and orthogonal with respect to antennas DP1 and DP2. DP3 and DP4 are likewise connected to array receiver 322. A selected RF transmission line 332 is illustrated as a dashed line, transmitted from departing ball 42. It can be seen that RF transmission line 332 will impinge upon DP4 prior to DP3. There will, therefore, be a phase difference, when the signals from these two antennas are compared, that is mathematically related to launch angle azimuth $\alpha_2$. Accordingly, this phase difference is used to measure $\alpha_2$. It should be appreciated that the array receiver is not limited to the use of dipole antennas, but rather may use any suitable antenna arrangement that is capable of detecting the described phase differences.

Referring to FIGS. 3 and 4*a*, by using tracking receiver 320, the launch angle of ball 42 can be closely characterized with no need to determine the position of the ball when the phase detection antennas are close together. That is, the launch angles can characterize the initial trajectory of the ball without actually determining the position of the ball. As the phase detection antennas are moved farther apart, then the position of the ball on its flight outward will affect the phase detected, due to the well known affect of parallax (the apparent change of angular position of two stationary points relative to each other as seen by an observer, caused by the motion of an observer). In this case, the ball is the observer. This error can be introduced in the launch angle and azimuth calculated. In this case, position information can be used to compensate for the error. This can be approximated by promptly detecting launch velocity after launch, then integrating to obtaining position. Time from launch, when coupled with velocity, can be used to obtain an initially detected position and subsequent position as a function of time. Because velocity will not have changed appreciably during this initial time period, the launch trajectory is being measured. Further, it should be appreciated that backspin 334 (indicated by an arrow in FIG. 3) is applied to the ball in addition, at least potentially, to a side spin component so as to generate an overall spin. For most orientations of the ball in relation to its spin axis, backspin of antenna 44 or, for that matter, any spin of the antenna will cause tracking receiver 320 to pick up an amplitude modulated signal 336. The frequency of this amplitude modulation is recognized to be directly proportional to the rate of rotation of ball 42. It will be a rare occurrence, but if the axis of rotation of the spin is coincident with the axis of antenna 44 of the ball assembly, no amplitude modulation data is present, unless it is produced by other antennas. In this regard, other antennas may be provided such as, for example, one or more additional antennas having antenna arm axes arranged orthogonal or transverse to the axes of any other antenna arrangements that are present such as is illustrated, for example, in FIG. 2*a*.

Ball spin information is often useful to retrieve and is of interest to the golfer. Spin information, coupled with launch information (the trajectory at which the ball launches), gives personal feedback on what a golfer might do to improve his or her performance. For instance, using a driver, golf ball manufacturers have determined for each launch elevation, what the optimum spin speed is in order to achieve the maximum distance. The optimum launch elevation is different for different golfers. For a golfer with a slow swing speed, the best launch angle is higher than the launch angle for a golfer with a higher swing speed, and the ideal ball spin speed for this slower swinging golfer is also higher. However, if the ball spin speed is too high, a loss of distance will result. For shorter clubs, such as a 9 iron or pitching wedge, high RPM is usually very desirable, because it results in the ball stopping quickly on the green.

Referring again to FIG. 4*a*, launch velocity is also a parameter that is of interest. Velocity, in this embodiment, can be obtained through the use of Doppler shift. That is, if ball assembly 42 transmits a carrier of a given frequency, array receiver 322 can lock on to that frequency before the ball is struck. Responsive to launch, the received carrier frequency will decrease in a detectable manner that is indicative of the launch velocity, as a result of Doppler shift. It is noted that the ball carrier frequency can be locked on to as part of a ball initiation sequence, yet to be described. The stability of the carrier frequency can be maintained, for example, by using a crystal in the oscillator section of the transmitter or transceiver that is used or by using a suitable embodiment with sufficient frequency stability such as, for example, the NCO embodiment described herein.

Figure 4B:
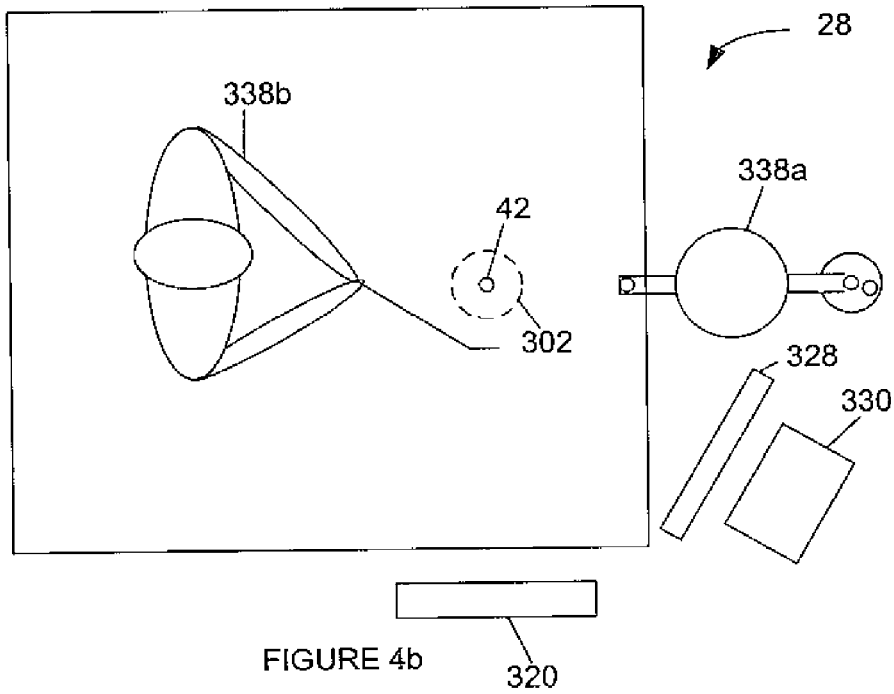
FIG. 4*b* is another diagrammatic plan view of one embodiment of a tee stations including a sample layout of various components.

FIG. 4*b* is another diagrammatic plan view of one of tee stations 28 and a sample layout of one embodiment of its various components including a ball dispenser 338*a* which can serve as the aforementioned standalone charger of FIG. 3. Also illustrated are computer 330, display 328 and tracking receiver 320 in this sample layout. A golfer 338*b* is about to hit a ball 42 that is on a tee which is approximately centered above antenna 302 (see FIG. 3), which is illustrated in a circular form that surrounds the tee.

Figure 4C:
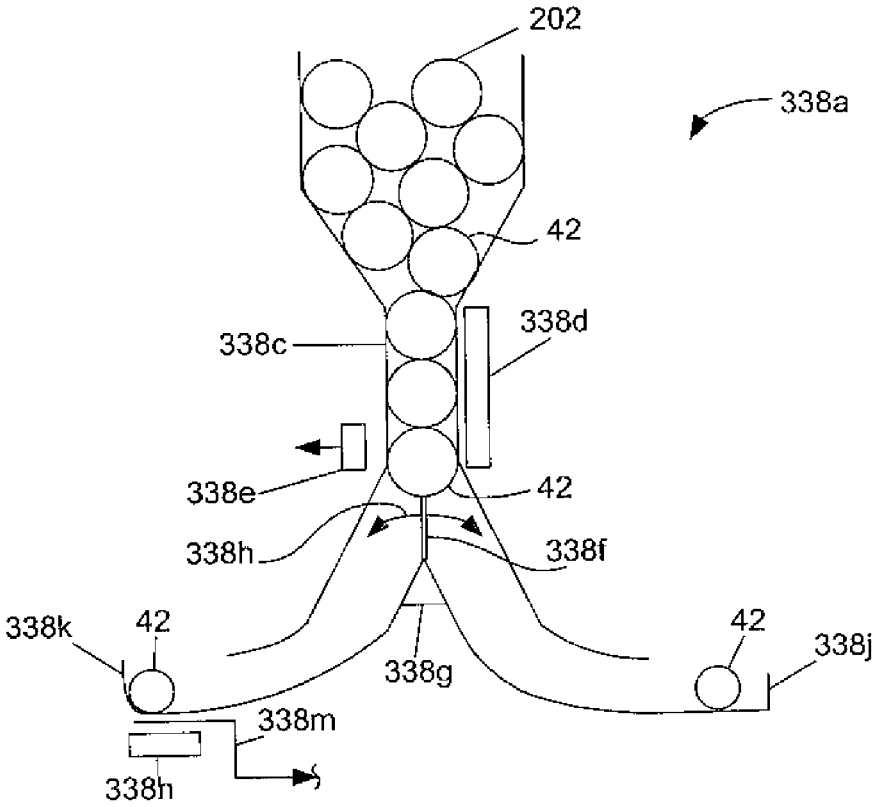
FIG. 4*c* is a diagrammatic plan view of one embodiment of a ball dispenser for use at a tee station.

Referring to FIG. 4*c*, attention is directed to further details with respect to ball dispenser 338*a* which is shown in a diagrammatic elevational view. In the present example, balls 42 drop into a charging duct 338*c*, where they are charged by a primary inductive charging coil 338*d*. As described above, the charge field can cause the ball to transmit ball signal 50, which is received by antenna 338*e* and referred to computer 330. A ball gate 338*f* controls the movement of balls via an actuator 338*g* which can pivot the ball gate at a lowermost end thereof in either direction, as indicated by a double headed arrow 338*h*, under control of computer 330. In this regard, antenna 338*e* can be sufficiently directional so as to only receive from the immediately adjacent ball. When the ball gate pivots to the left, a ball is rejected into a reject bin 338*j*. This can take place, for example, when a ball fails testing in the charge duct. On the other hand, if the ball passes scrutiny in the charge duct, ball gate 338*f* is pivoted to the right, in the view of the figure, such that the ball travels to a dispenser end 338*k* and is available to the golfer to place on the tee. At the dispenser end, the ball can again be identified using an antenna 338*m* and continue charging from a second charge coil 338*n*.

Figure 4D:
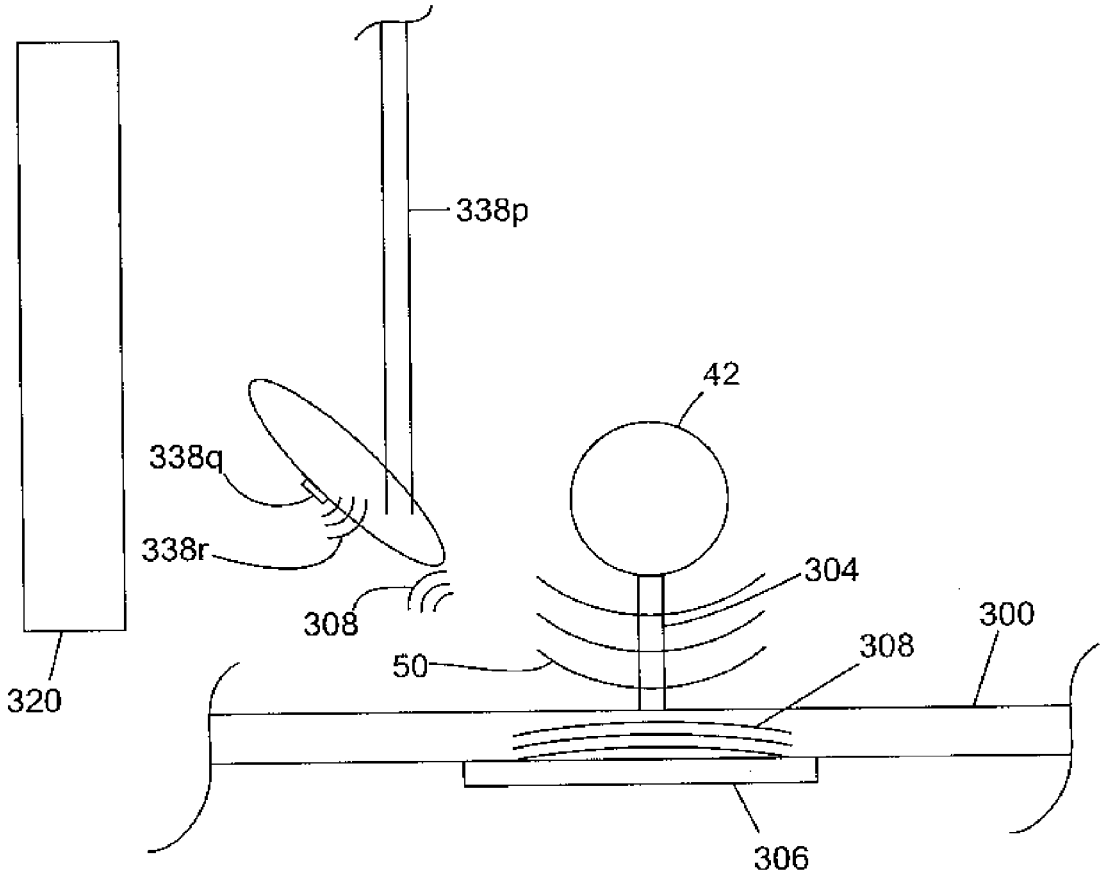
FIG. 4*d* is a diagrammatic view, in elevation, of a ball on a tee-off mat in operation showing interactions between the ball and tee-off mat according to one embodiment which can include an RFID chip on the golfer's club.

FIG. 4*d* diagrammatically illustrates a ball 42 on tee 304 which is, in turn, on tee-off mat 300 adjacent to tracking receiver 320, in a particular embodiment. Ball 42 receives charging signal 308 and emits ball signal 50 which can be received by antenna 306 or another suitable antenna. Further, a club 338*p* is shown addressing the ball. In one embodiment, the club is provided with an RFID chip 338*q* which may be attached, for example, to a rear surface of the club or embedded (not shown) in the club. RFID chip 338*q* can also receive charging signal 308 at a pre-selected frequency that causes the chip to respond by sending an RFID signal 338*r* which identifies the particular club that is in use. Antenna 306 receives the RFID signal and the system information such that it can be recorded in association with the current shot and can be indexed against any other suitable information that is available through the system. It should be appreciated that the use of RFID is well known.

Figure 5A:
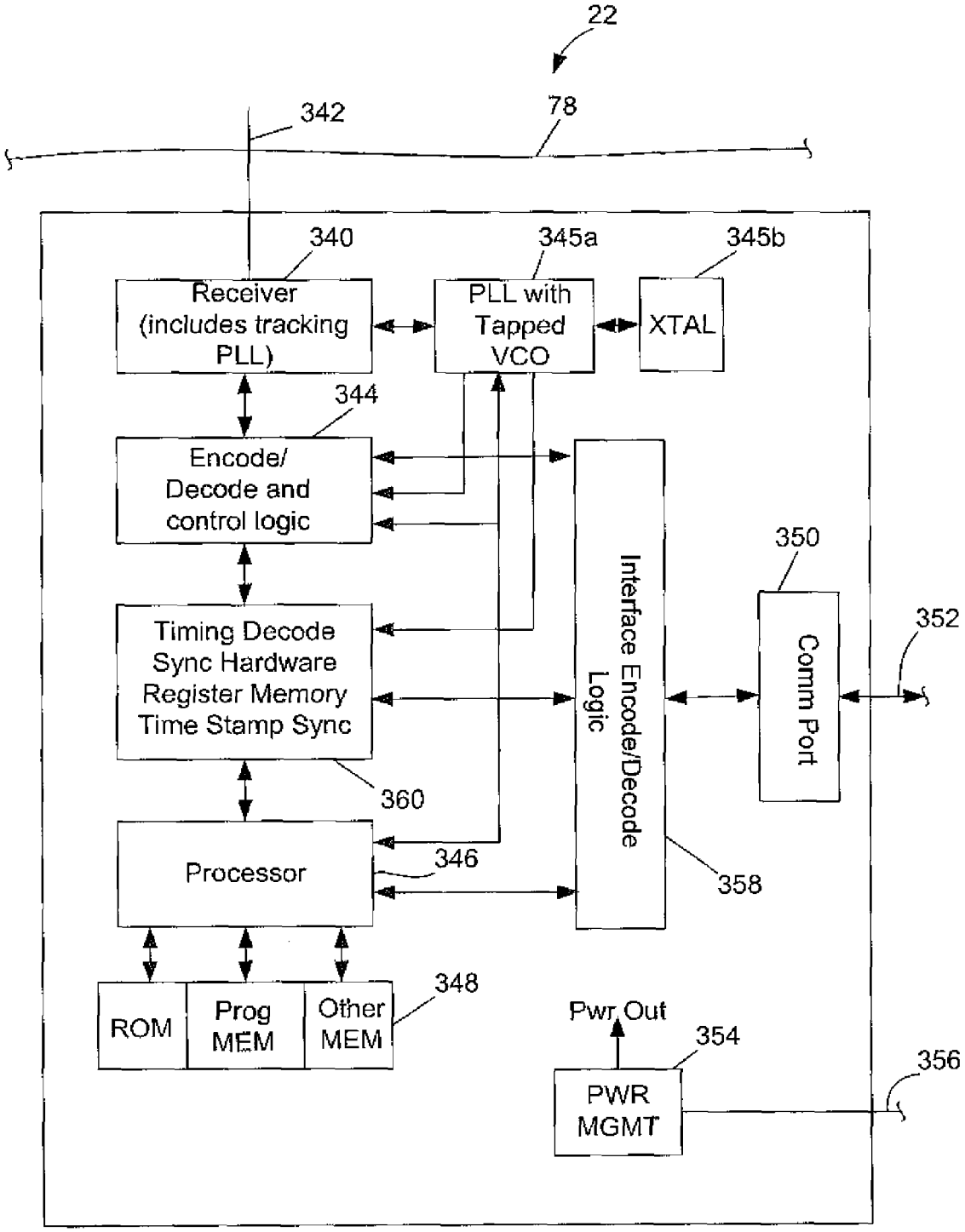
FIGS. 5*a*-5*c* are diagrammatic block diagrams showing various embodiments of wired and wireless GTs (Ground Transceivers) produced according to the present disclosure.
Figure 5B:
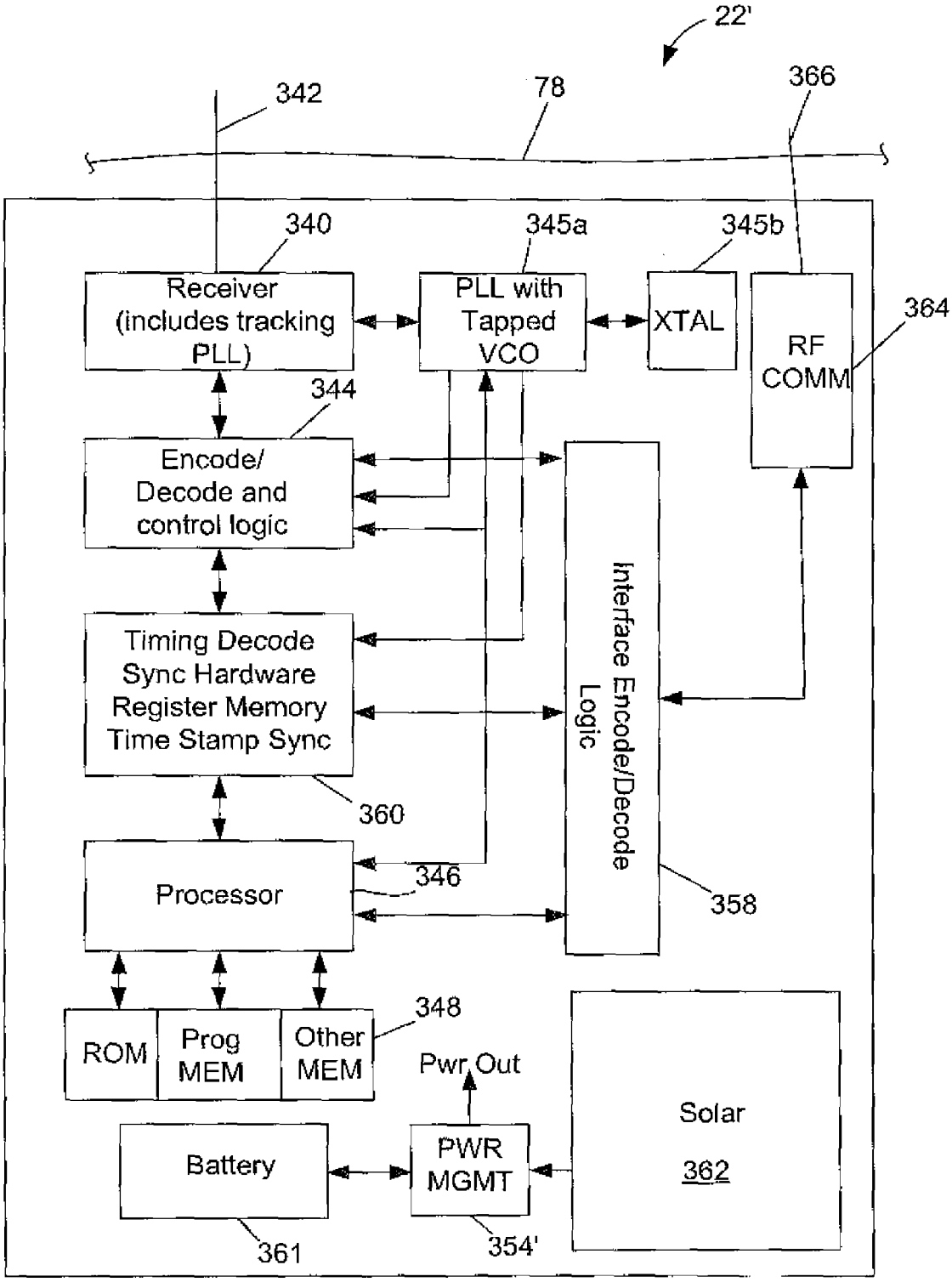
Figure 5C:
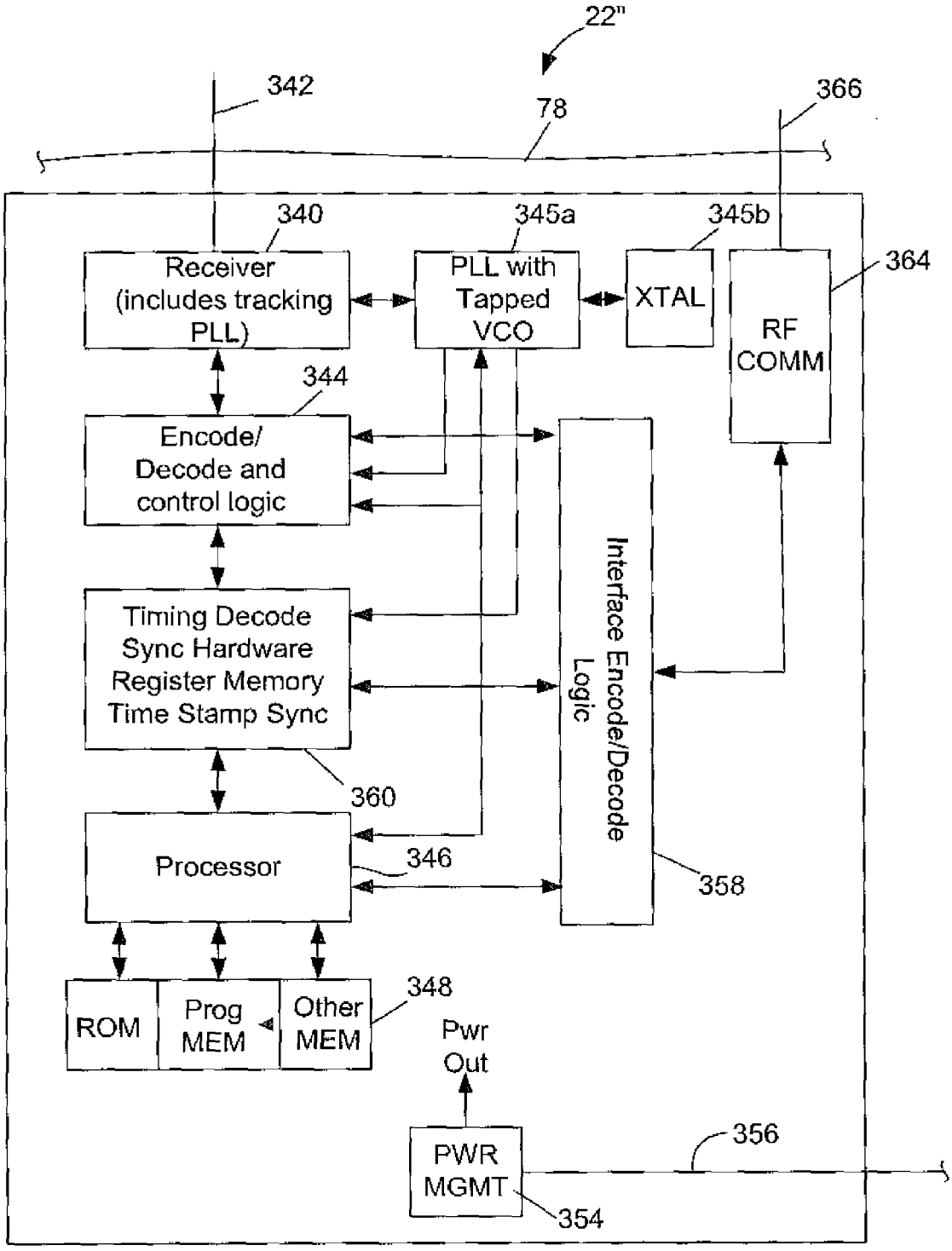

FIGS. 5*a*, 5*b* and 5*c* are block diagrams illustrating wired and wireless GTs. In FIG. 5*a*, the wired GT is generally indicated by the reference number 22. Each GT contains a transceiver 340, which can include a tracking PLL that allows ball transmission frequency to vary within a certain tolerance while the GT continues to reliably receive ball transmissions. The receiver is connected with an antenna 342, for receiving communications from the golf ball and with a decoding and control section 344 for decoding the received information. Further, a PLL section 345*a* includes a tapped VCO, in one embodiment, which is used as a reference for the real time clock. The PLL section is connected to a crystal 345*b* that oscillates at a reference frequency. As described above, the GTs may be installed above or below the ground surface whereas antenna 342 may extend above the surface of the ground, although this is not a requirement. The antenna and GTs should be resistant to typical range events including, but not limited to being hit by a ball, being subjected to the activity of the ball pickup machine, adverse weather conditions, as well as other identified events that may affect GT reliability in a negative way. The control that is implemented by control section 344 includes, for example, cooperating with the system host in performing a time calibration, yet to be described. Additionally, each GT contains a programmable processor 346 for managing the information and communications on the GT network. This control includes, for example, cooperating with the system host in performing a time calibration, yet to be described. Each processor has a ROM/RAM section 348 and may include other attached memory for storing the GT firmware and calibration and other data local to the GT such as ID and IP/network address. In the case of a wired GT, communication is performed through a wired communication port 350 with Ethernet or other appropriate protocol on a communications line 352 (also see cables 26 in FIG. 1) which will generally be buried. A power management block 354 provides power to the various sections of the GT, as needed. As mentioned elsewhere in this disclosure, power for wired GTs may readily be provided, for example, through underground or above ground cabling 356 that can be co-located and share conductors with communications line 352. A command decode logic section 358 serves as an interface between the communications port and decode and control section 358, a clock section 360 and processor 346. With regard to the reference frequency that is provided by the PLL in both wired and wireless embodiments, signals can be sent to the a Time Stamp Sync sub-section of clock section 360 periodically, so that the real time clock drift is continually compensated out by selecting a phase of a tapped VCO at each update. Further details will be provided below.

Attention is now directed to FIG. 5*b*, which is a block diagram that illustrates one embodiment of a wireless GT, that is generally indicated by the reference number 22'. As noted above, like reference numbers have been applied to like components and the descriptions of these components have not been repeated for purposes of brevity. In the case of the wireless GT, power management block 354' manages the power supply from a battery 361 and the charging of the battery from a solar panel 362. To conserve battery life, the wireless GT may go into a lower power mode, when practical, so that battery charging can be maximum when solar charging is occurring, and battery power loss will be minimized when no solar charging is occurring. Additionally, the wireless GT can limit its power requirements to just the level required to communicate with adjacent/nearby GTs in an embodiment using a mesh network, which is yet to be described. In one embodiment, the wireless GT includes an R/F communications block 364, having an antenna 366 that controls the R/F communication protocol to communicate, for example, on a mesh network that can include all of the wireless GTs. Antenna 366 may be configured in a manner that is similar to aforedescribed antenna 342. In the case of a wireless system, each antenna will be tuned to the specific frequency on which it operates.

FIG. 5*c* is a block diagram that illustrates another embodiment that is generally indicated by the reference number 22" that still may receive power from a wired connection, but which is otherwise consistent with the embodiment of FIG. 5*b* by using cable 356 to receive electrical power.

Figure 6:
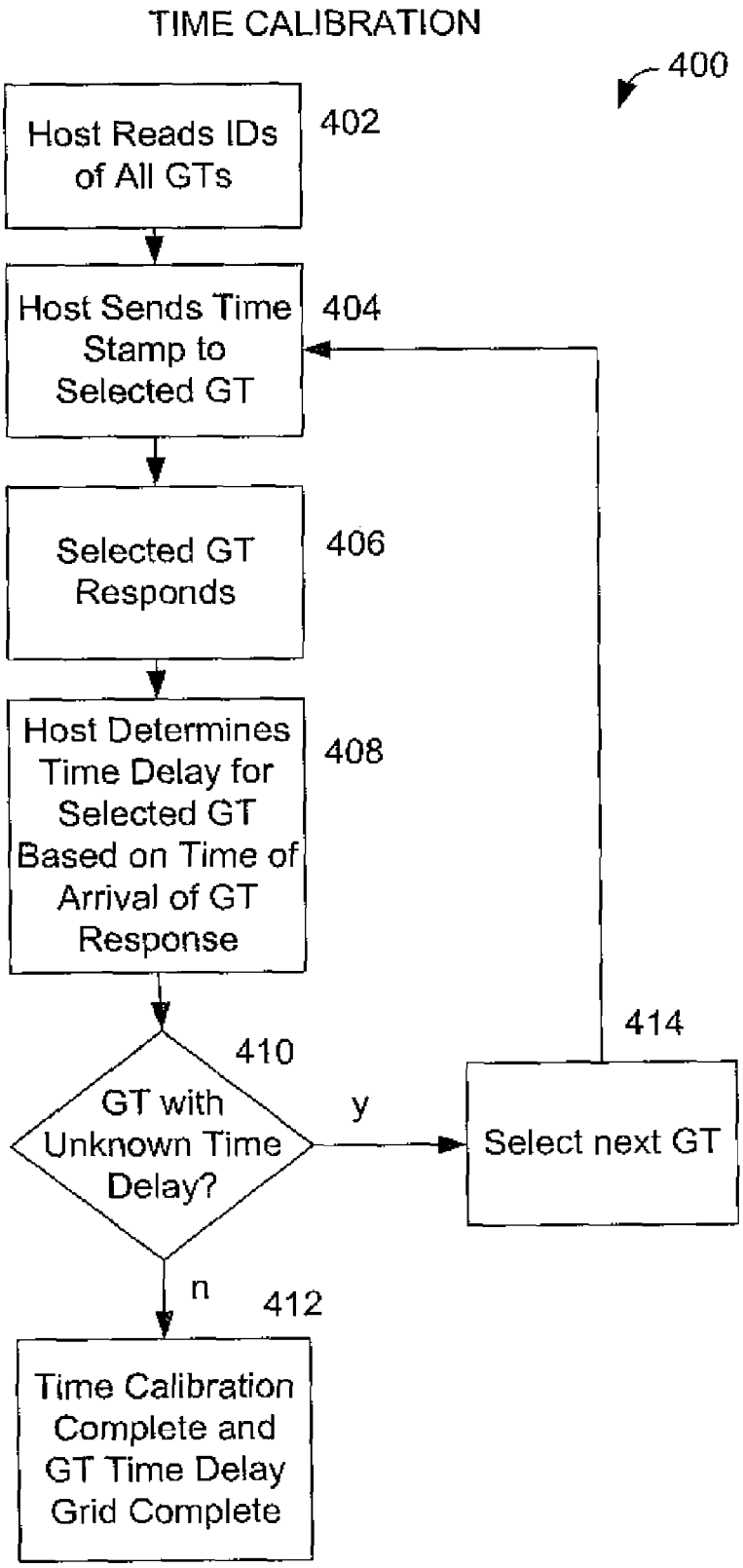
FIG. 6 is a flow diagram which illustrates one embodiment of a method for time calibration that is applicable with respect to the use of wired GTs.

Attention is now directed to FIG. 6, in conjunction with FIG. 1. FIG. 6 is a flow diagram that illustrates one embodiment of a time calibration procedure that is generally indicated by the reference number 400. This time calibration method is applicable with respect to the use of wired GTs or at least a portion of a system using wired GTs. A discussion of wireless spatial and time calibration will be taken up at appropriate points below. Initially, at 402, host 24 reads the identification numbers for every ground transceiver 22 in the arrangement of FIG. 1. It does this by sending out commands to cause each GT to respond with it's ID. Following the reception of the ID information, the host is aware of all GTs on the range. Subsequently, at 404, host 24 sends a timestamp to a selected one of the ground transceivers. At 406, the selected ground transceiver responds to the timestamp that was directed to it. At 408, host 24 determines a time delay for the selected wired ground transceiver, based on the time of arrival of the response to the timestamp. In this way, the time delay is determined by the host that is associated with that particular wired ground transceiver. This delay corresponds to the amount of time that is required for communication between the host and the selected ground transceiver. Accordingly, one-half of the determined time delay should be experienced by a communication that is originated by the particular ground transceiver to the host. At 410, it is determined whether there is another ground transceiver for which an associated time delay is unknown. If the time delays have been established for every ground transceiver 22, the time calibration procedure terminates at 412. Otherwise, at 414 another ground transceiver is selected and the aforedescribed process is repeated for that selected ground transceiver, in order to establish a time delay associated with that ground transceiver.

Figure 7:
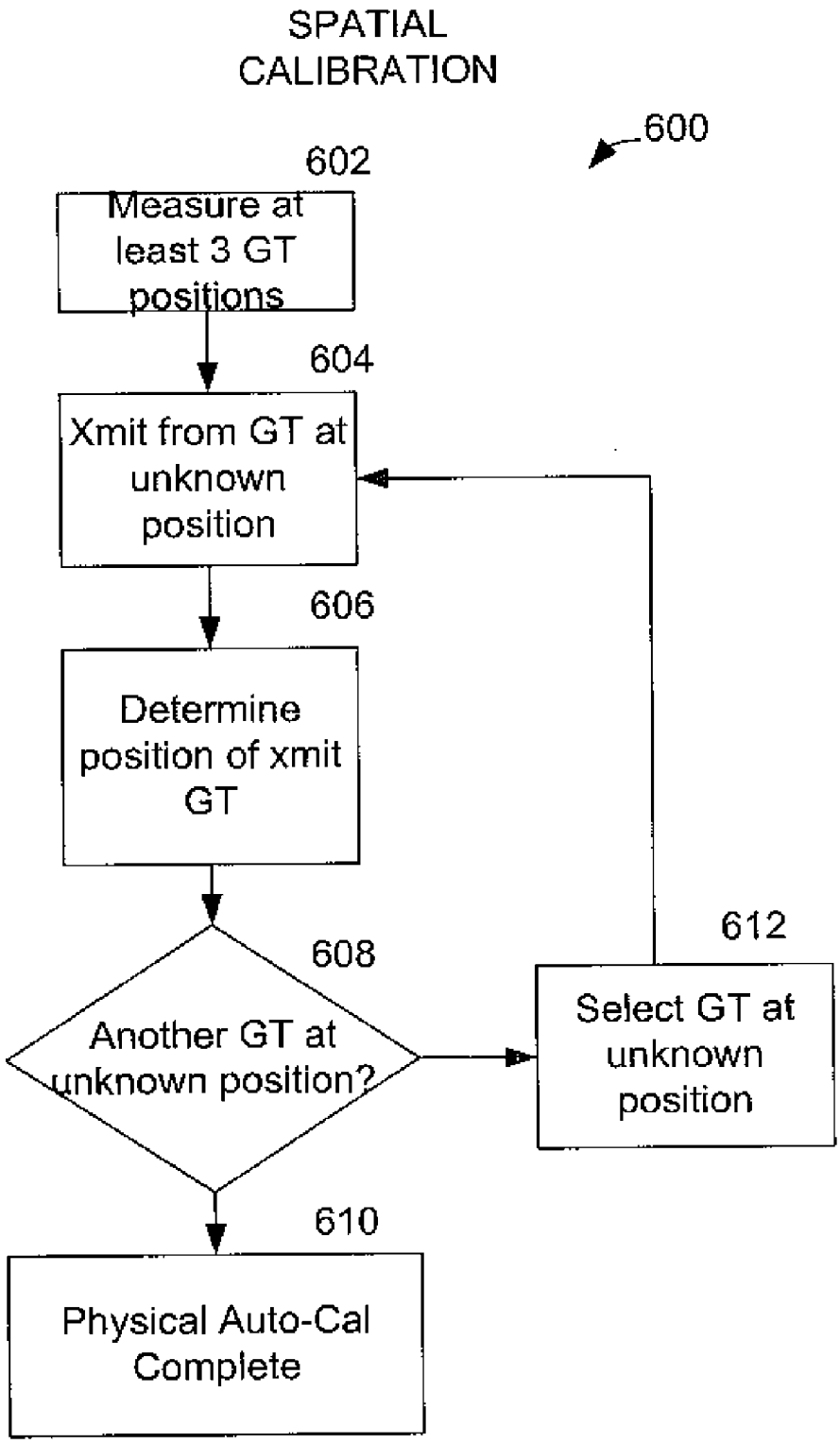
FIG. 7 is a flow diagram which illustrates one embodiment of a method for performing a spatial calibration procedure that can be performed subsequent to the method of FIG. 6 for wired GTs.

FIG. 7 is a flow diagram that illustrates one embodiment of a spatial calibration procedure, generally indicated by the reference number 600 that is performed subsequent to the time calibration procedure, described immediately above. This is again for a wired system or at least a portion of a system that uses wired GTs. As will be described below, in the instance of wireless GTs, the time calibration and spatial calibration can actually be performed simultaneously.

The purpose of the spatial calibration is to determine the physical location of each ground transceiver in FIG. 1 for any ground transceivers at unknown positions within the overall arrangement of ground transceivers. Accordingly, at 602, the physical position of at least three ground transceivers is obtained. This can be accomplished in any suitable manner such as, for example, by physical measurement of the position of three ground transceivers or, as another example, through the use of a GPS receiver. As described above, the configuration of each ground transceiver provides for transmitting a sync signal that includes the ID number of the transmitting ground transceiver. At 604, a ground transceiver at an unknown position is caused by host 24 to transmit a sync and ID signal. When a ground transceiver receives a sync and ID signal, it then adds a time stamp to the sync signal, and passes the ID and corresponding time stamped sync on to host 24. At 606, when host 24 is in possession of time stamp and ID signals from at least three ground transceivers at known positions, the host can determine the physical position of the unknown ground transceiver using the well known method of triangulation. This method allows 2D (two-dimensional) locating. Using 4 GTs, the 3D (three-dimensional) location of the unknown can be determined. Thus, the ground transceiver associated with the just determined position can now be used in a receiving mode for receiving sync and ID signals from other ground transceivers that are at unknown positions. In this way, the position of every one of the unknown ground transceivers can be determined, so long as every ground transceiver at an unknown position is within a receiving range of at least three ground transceivers that are at known positions. At 608, a determination is made as to whether there is at least one other ground transceiver that is at an unknown location. If the position of all ground transceivers is known, the spatial calibration process concludes at 610. On the other hand, if there is at least one other ground transceiver at an unknown location that ground transceiver is selected at 612 and caused to transmit its sync and ID signal for use in determining its position by looping through the aforedescribed procedure. It should be appreciated that transmission of this information from the ground transceivers is essentially unconstrained with respect to power considerations when the ground transceivers are provided with power through an underground or above ground cabling system. For this reason, it is recognized that the transmission range of the sync and ID signal from the ground transceivers can be significantly greater than that which is seen from a golf ball assembly.

Figure 8:
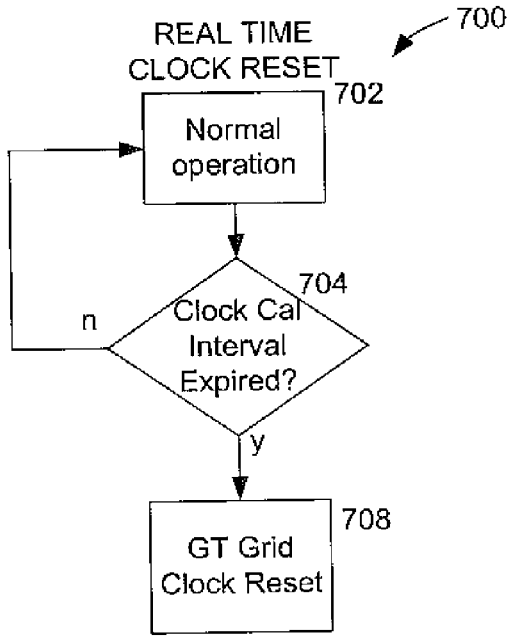
FIG. 8 is a flow diagram that illustrates one embodiment of a real-time clock reset procedure that may be performed during normal operation of the system.

FIG. 8 is a flow diagram that illustrates one embodiment of a real-time clock reset procedure, generally indicated by the reference number 700 that may be performed during normal operation of the system. In this regard, it should be appreciated that the clock that is incorporated in each of ground transceivers 22 may drift with respect to other ground transceiver clocks. Further, this discussion is also applicable with respect to wireless GTs. One approach is to use the most stable typical form of clock such as, for example, a crystal oscillator, however, most crystal oscillator circuits are accurate to within a range from approximately 20 ppm (parts per million) to 100 ppm. To achieve an accuracy of approximately one foot, all real time clock measurements may be compensated to within approximately 1 ns of each other. It should be appreciated that because electromagnetic radiation (RF energy) velocities are well known in the art, and used in many cases for position calculations (GPS as the most well known in general), any error in the real time clocks of each GT relative to another GT will result in a corresponding positional error. As a result, such drifting can produce positional determination errors when using a time of arrival differential position determination technique. Depending on the accuracy of each GT real time clock (RTC), different methods can be employed to keep all the GT clocks in accurate time calibration. Accordingly, from normal operation, at 702, step 704 determines whether a clock calibration interval has expired. If not, normal operation resumes. If the interval has expired, a ground transceiver grid clock reset is performed at 708. This reset is simultaneously sent out by host 24 to all of the ground transceivers and includes a timestamp from the host. Upon receipt of the reset, each ground transceiver sets its internal clock to the time that is indicated by that timestamp. It should be appreciated, however, that the ground transceivers will receive the reset timestamp at different times, based on their particular communication time delay from host 24. At any given instantaneous time, therefore, all of the ground transceivers will indicate different times, unless a particular one of the ground transceivers happens to be at exactly the same distance from host 24 as another one of the ground transceivers, as measured through the inground cabling arrangement (in the wired system), or measured as direct RF transmission time to a GT from the host (in a wireless system). Host 24 compensates for these different clock values on the basis of information that was previously obtained by time calibration procedure 400, shown in FIG. 6 and described above. It is noted that another embodiment of the time calibration procedure will be described below with regard to FIG. 11*d*.

Figure 9:
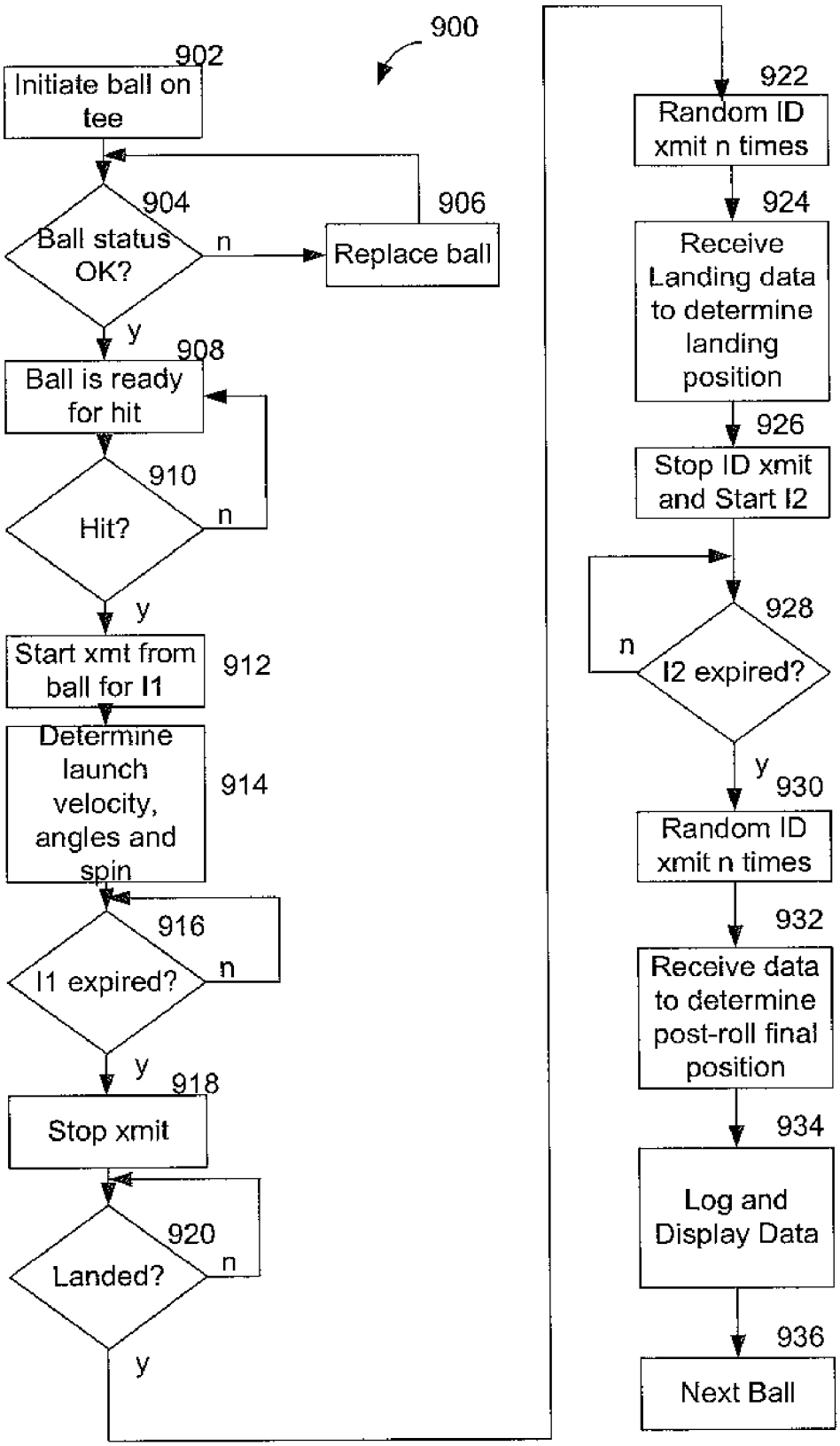
FIG. 9 is a flow diagram that illustrates one embodiment for the operation of the overall system of the present disclosure.

Turning now to FIG. 9, a flow diagram, generally indicated by the reference number 900, illustrates one embodiment of a sequence for operation of the system. At 902, a ball assembly 42 is placed on a tee at one of tee stations 28*a-n* (see FIG. 3). As described above, the tee station can initiate the ball with a temporary ID or the ball can be provided with a permanent or semipermanent ID. There are a number of suitable manners in which to receive the ID and status information. One embodiment resides in the ball receiving a command to reply with the required information. Another embodiment resides in the ball (for example, via processor 54 of FIG. 2*a*), recognizing that it is on the charging station (the tee or the hitting mat), and continually transmitting status information for as long as it is so positioned. As discussed above, the ball can recognize that it is on the tee or tee-off mat based on a unique and identifiable feature of a signal that it only receives at this location such as, for example, the particular frequency of a charging signal. Further, intermediate charging signal 316 can be used, as described above. In any case, at 904, the ball status is determined which can include the capability to read the ID, or other information of interest, from the ball when positioned on the tee. If the particular ball assembly that is in use fails this test, step 906 notifies the user to replace the ball. It should be appreciated that this notification can be accomplished in any number of different ways. For example, if the ball passes the test, a flashing green indication may be provided on display 328 (FIGS. 3 and 4*a*) whereas, if the ball fails the test, a flashing red indication may be provided on the display. Any suitable operations can be performed in order to prepare the ball on the tee to be hit. For example, if an Earth/ground proximity sensor is used, processor 54 (FIG. 2*a*) can calibrate to Earth proximity by reading and storing the specific frequency at which the Earth proximity sensor oscillator is running, as is the case with respect to aforedescribed FIGS. 2*c* and 2*d*. It is noted that the ability to read the frequency of the Earth proximity sensor may form part of the ball status testing operations. Aural indications may also be provided either alone or separate from visual indications.

Having established that the ball assembly is good, at 908, the ball is ready to be hit, which may be referred to as being armed or in an armed mode. At 910, processor 54 monitors the status of the ball assembly with respect to whether or not it has been hit. In one embodiment, a sufficient and measurable change in Earth proximity will occur responsive to the hit. In another embodiment, a carrier can be transmitted from the ball which is received by tracking receiver 320 and/or antenna 302 (FIG. 4*a*). Tracking receiver 320 will see a Doppler shift once the ball has been hit, while antenna 302 will experience a loss of signal or reduction in signal strength. After detection of the hit, at 912, transmission of ball tracking signal 50 proceeds or may increase in power, if it was previously being transmitted at a low level. Initiation of this transmission starts time interval I1. During I1, at 914, tracking receiver 320 picks up the ball tracking signal and determines launch angles $\alpha_1$ and $\alpha_2$, velocity and backspin, as described above, without determining the position of the ball. Interval I1 is made sufficiently long to allow these determinations to be accurately completed. In the instance of using an Earth proximity detector, further details will be provided at an appropriate point below. At 916, transmission is allowed to continue to the completion of I1. Once interval I1 has expired, at 918, transmission is temporarily terminated for the remaining duration of the flight of the ball assembly. In this regard, the actual trajectory of the ball assembly is not tracked, although the initial launch angles are known. It is noted that it may be difficult to track the flight of the ball based on position determinations when the ball may easily travel out of range of all receivers, based on a sufficiently high flight path. Thus, there is no need to waste transmission power in the ball during much of the flight of the ball.

During flight of the ball, after I1, monitoring is performed for purposes of detecting a landing event. This monitoring is performed at 920. Any suitable expedient may be employed such as, for example, using an accelerometer, impact sensor or Earth proximity detector, as part of sensor package 70 (FIG. 2*a*), as will be further discussed. It should be appreciated that a low power mode may be utilized, during this time, so that the functionality of electronics section 200 (FIG. 2*a*) is essentially limited to monitoring for landing and, during this time, no transmissions are initiated in order to conserve electrical power. Upon detection of landing, processor 54 in the golf ball assembly initiates the transmission of the ID of the particular golf ball assembly via ball signal 50. One ID transmission can occur almost immediately upon detection of landing. It is recognized, however, that another ball assembly, driven from a different tee station, may land at the same time, such that there is an RF collision between the ID transmissions of two or more balls. The ball ID transmission will be described below, but for clarity, GTs receiving multiple transmissions at the same time (which may be referred to herein as an RF collision) can identify that an RF collision has occurred. This feature is provided since the ball ID transmission includes ECC (error correction code). ECC is used in virtually all modern wireless transmission protocols, and is well known in the art. It allows the receiver to validate that the received data is correct, at a minimum. If the data is not valid, or cannot be corrected so that it is valid, it will not be used. For this reason, processor 54 is configured to randomly transmit the ball assembly ID at least once following the initial transmission, subsequent to landing. For example, any desired number of random transmissions may occur. It should be appreciated that all of these random transmissions can be completed within a manner of milliseconds after the ball assembly has landed such that movement of the ball from the initial landing position will be inconsequential. At 924, each time one of ground transceivers 22 receives an error free transmitted ID for a particular ball (meaning no RF collision occurred), it transfers the time of receipt TOD (time of day) to host 24 along with the ball ID and ground transceiver ID (GT ID). In the case of one GT receiving multiple transmissions from a single ball, which will occur if there are no RF collisions, the GT may limit information transmitted to the host corresponding to the first transmission received. Subsequent, random transmissions for the same event may provide no additional useful information. The GT can readily identify the subsequent transmissions as a result of their close proximity in time as one expedient in performing such filtering. In one embodiment, host 24 can route the ball ID, GT ID and ground transceiver timestamp to the tee station with which the ball having that particular ID is associated. For at least one of these landing ID transmissions, the tee station will receive four or more transmitted ball IDs with associated time stamps from the respective GTs that received the ball ID. The tee station can then determine the landing position of the ball on the range. In another embodiment, host 24 can itself determine the landing position, based on at least four transmitted IDs, associated GT IDs and TOD timestamps, and relay the landing position to the tee stations, at least along with the ball ID. In some embodiments, ball landing information is targeted directly to the tee station from which the ball was hit, while, in other embodiments, the ball landing information is transmitted to all of the tee stations to be picked off based on monitoring by the specific tee station from which the ball was hit. It is possible that, for a given landing, the ground transceivers generate more than four received IDs. In this event, the received IDs can be handled in any suitable manner. For example, four of the received IDs may be selected for use, while the other received IDs are discarded. Selection of the four received IDs that are to be used may be performed in any suitable manner such as, for instance, by choosing the four received IDs that exhibit the smallest time delays from the ground transceivers, thereby using the four ground transceivers that are nearest the landing position. As another example, all of the received IDs may be used for purposes of enhancing landing position accuracy, for instance using the well known least squares technique.

At 926, random transmission of the ball ID ceases and ball assembly 42 rolls to a final resting position. At the same time, an I2 timing interval is initiated that is sufficiently long for the ball assembly to come to rest. Suitable values for I2 may be in the range from 4 to 8 seconds and may be customized for a particular driving range. At 928, the I2 interval is monitored. Once this interval expires, at 930, ball assembly 42 again initiates random transmission of its unique ID n times. Since the ball is at rest, there is no particular urgency with respect to which of these random ball ID transmissions is received by the ground transceivers. Further, so long as the ball ID matches a given ball, ground transmitter ID transfers to the host can all be used, even though they originate from different random transmissions, because the ball assembly is assumed to be stationary. It is noted that a landing transmission can be associated with a landing code that is different from a rollout code, associated with information that is related to the final ball position that originates after I2 so that there is no confusion with respect to these differing events. For example, the landing code related information may not be received if the ball lands in a depression and then bounces out so that the rollout code can be received. Conversely, the landing code related information may be received, but the rollout code may not be received, for example, if the ball rolls into a hole or pond. At 932, the final position of the ball can be determined based on data that is associated with the rollout code related information. In one embodiment, where a ground proximity detector is present, a stable output from the ground proximity detector can affirmatively indicate that the ball has stopped rolling. Having all information in hand, with respect to the particular hit, including the initial launch information, the landing position and the final position of the ball assembly, at 934, this information is logged and used on display 328, if appropriate. At 936, the system is prepared for the next ball.

Figure 9A:
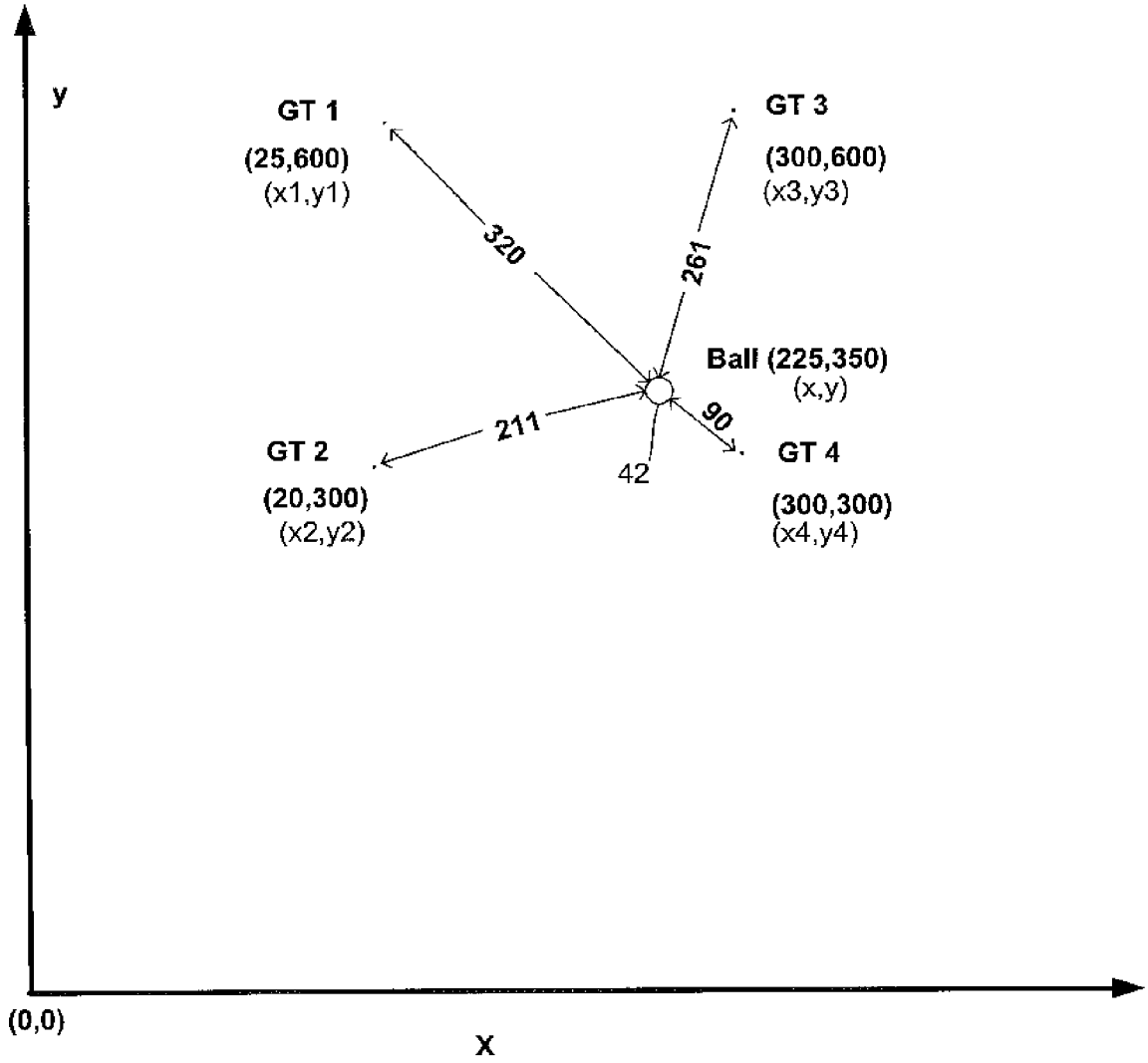
FIG. 9*a* is a diagrammatic plan view of a range that includes 4 GTs (GT 1-4) in a Cartesian coordinate system with x and y axes, as indicated, for use in describing a differential distance locating technique.

Attention is now directed to FIG. 9*a*. The latter is a diagrammatic plan view of a range that includes 4 GTs (GT 1-4) in a Cartesian coordinate system with x and y axes, as indicated. The coordinates of each GT are shown as well as an example position of ball 42 and the coordinates of the ball. One useful technique for establishing the actual location of ball 42 involves at least four ground transceivers (GTs) that are at known locations within range of the ball. This technique may be referred to hereinafter as "differential distance locating." As will be seen, this technique does not require knowledge of the distance or the direction of the ball from each of the GTs. The technique relies instead on the use of relative differences in distance from each GT to the ball. That is, for example, the difference from GT 1 to the ball can serve as a reference distance. Differential distances are then the difference between this reference distance and the actual distance between each GT to the ball. Table A sets forth the distance from each GT to the ball, as shown in FIG. 9*a* and, furthermore, gives the differential distance using the time of day (TOD) from GT 1 to the ball as a base or reference value. It should be appreciated that a similar table can be developed using the distance between any given GT and the ball as the reference value.

Referring to Table A in conjunction with FIG. 9*a*, further details will be provided with respect to one embodiment of differential distance locating.

TABLE A

Differential Distance Nomenclature

| | GT 1 | GT 2 | GT 3 | GT 4 |
|---|---|---|---|---|
| Distance to ball (the distance (in feet)- unknown until final calculations are completed by host or tee station) | 320 ($D_{1B}$) | 211 ($D_{2B}$) | 261 ($D_{3B}$) | 90 ($D_{4B}$) |
| Differential distance relative to GT 1 (calculated) | 0 | 109 ($K_{12}$) | 59 ($K_{13}$) | 230 ($K_{14}$) |
| Time stamp TOD (known) | 06-3-21-8-10-100-550-500 | 06-3-21-8-10-100-550-391 | 06-3-21-8-10-100-550-441 | 06-3-21-8-10-100-550-270 |

Key: 1. Distance values in feet.
2. $D_{nB}$ indicates distance from a given GT (n) to the ball.
3. $K_{1x}$ indicates the differential distance for a given $GT_x$ relative to $D_{1B}$ for $GT_1$))
4. TOD => year-day-hour-minute-second-millisecond-microsecond-nanosecond
5. For simplicity of calculation purposes, 1 foot will equal 1 nanosecond
6. Calculation of differential distance
a. $K_{12} = TOD_1 - TOD_2 = 109$
$TOD_1$ (06-3-21-8-10-100-550-500) – $TOD_2$ (06-3-21-8-10-100-550-391) = 109
b. $K_{13} = TOD_1 - TOD_3 = 59$
$TOD_1$ (06-3-21-8-10-100-550-500) – $TOD_3$ (06-3-21-8-10-100-550-441) = 59
c. $K_{14} = TOD_1 - TOD_4 = 230$
$TOD_1$ (06-3-21-8-10-100-550-500) – $TOD_4$ (06-3-21-8-10-100-550-270) = 230
$TOD_1$ is the time-of-day (TOD) captured by $GT_1$ from a ball ID transmission.
The TOD definition in (4) above is not the only format that can be used, but is one example of a possible format that is not intended as being limiting.

To obtain the ball position without ambiguity, at least four (4) GTs receive a ball ID transmission. Upon receiving the transmission, each GT captures the instantaneous TOD that corresponds to the ball ID. This information is sent to the range host or tee station for processing to determine ball position. In the present example, $GT_1$ has been selected as a reference for the reason that $GT_1$ was the first to receive the ball transmission. All of the distances relative to $GT_1$ are therefore positive. The distance relative to any one of the GTs can be used as a reference, however, such that some of the relative distances can be positive and/or negative.

In order to determine the ball location in 2D, at least four GTs can be used where one GT provides the reference distance and the other three GTs are used to define differential distances relative to the reference distance. In order to determine the ball location in 3D, at least five GTs are used where one GT provides an additional differential distance. It is noted that the ball position can be found based on only 3 GTs using the described technique, but some ambiguity is present since two possible positions will be presented as the solution. The ambiguity may resolved, however, in a straight forward way if one of the solutions happens to be outside of the lateral extents of the range. Using 4 GTs, as described above, there is no ambiguity.

With continuing reference to FIG. 9*a*, the differential distance technique will be discussed, at least initially, in terms of the minimum number of 4 GTs, as shown. Again, differential distance refers to the difference in distance from a given GT to the ball, versus the distance from some other GT to the ball. Absolute or actual distances from each GT to the ball are not needed. The calculation of the differential distance metrics can be performed by the host computer that receives the time stamp (time of day TOD) information. The actual differential distance calculation using the TOD information will be described below.

Referring again to Table A in conjunction with FIG. 9*a*, let $D_{1B}$ be defined as the distance from $GT_1$ to the ball, and let $K_{12}$ be defined as the differential distance between $GT_1$ and $GT_2$. If differential distance in this case is defined as $D_{1B}=D_{2B}+K_{12}$, when looking at actual distances: $D_{1B}=320$ and $D_{2B}=211$. Accordingly, $K_{12}=109$ after solving the equation. Therefore: $K_{12}=109$, $K_{13}=59$, and $K_{14}=230$ But, note that actual distances are not known, just time stamp information. So, using TOD information, as shown above, $K_{12}=TOD_1-TOD_2$ and so forth as described in Key item #6 under Table A.

Let $x_1$ be the x coordinate of $GT_1$ and $y_1$ be the y coordinate of $GT_1$. Let x and y be the ball coordinates, and $D_{1B}$ is the distance from $GT_1$ to the ball, for example. The requirement is to solve for x and y:

$$D^2_{1B}=(x_1-x)^2+(y_1-y)^2 \quad (1)$$

$$D^2_{2B}=(x_2-x)^2+(y_2-y)^2 \quad (2)$$

$$D_{1B}=D_{2B}+K_{12} \quad (3)$$

$$D_{2B}=D_{1B}-K_{12} \quad (4)$$

$$D^2_{2B}=D^2_{1B}-2D_{1B}K_{12}+K^2_{12} \quad (5)$$

Substituting the right side of equation (5) into the left side of equation (2), and solving for $D^2_{1B}$ yields:

$$D^2_{1B}=(x_2-x)^2+(y_2-y)^2+2D_{1B}K_{12}-K^2_{12} \quad (6)$$

Setting the right side of equation (6) equal to the right side of equation (1) yields:

$$(x_1-x)^2+(y_1-y)^2=(x_2-x)^2+(y_2-y)^2+2D_{1B}K_{12}-K^2_{12} \quad (7)$$

$$(x_1-x)^2+(y_1-y)^2-(x_2-x)^2-(y_2-y)^2=2D_{1B}K_{12}-K^2_{12} \quad (8)$$

Equation 8 defines the differential distance from $GT_1$ to $GT_2$ in terms of three unknowns, x, y, and $D_{1B}$. In order to solve for the position of the ball, two additional equations are needed. Accordingly, two additional equations are developed based on the differential distance for $GT_3$ with $GT_1$ as the reference, and the differential distance for $GT_4$ with $GT_1$ as a reference. Accordingly, the two additional equations are given as:

$$(x_1-x)^2+(y_1-y)^2-(x_3-x)^2-(y_3-y)^2=2D_{1B}K_{13}-K^2_{13} \quad (9)$$

$$(x_1-x)^2+(y_1-y)^2-(x_4-x)^2-(y_4-y)^2=2D_{1B}K_{14}-K^2_{14} \quad (10)$$

Solving equations (8)-(10) for the three unknowns x, y, and $D_{1B}$ yields the location of the ball, which is simply (x,y). $D_{1B}$ is also solved for, because it is an unknown in each equation. It should be appreciated that a best fit solution approach may be taken, for example, in view of measurement error if necessary.

Figure 10:
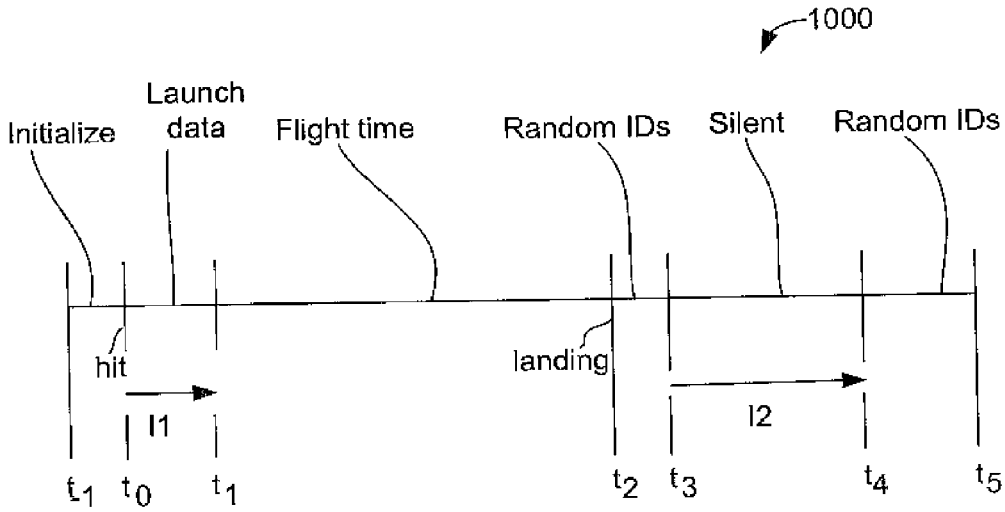
FIG. 10 is a timeline which illustrates one embodiment of a sequence of events associated with one drive on a driving range using the system of the present disclosure.

FIG. 10 is a timeline generally indicated by the reference number 1000, which illustrates one sequence of events associated with one drive on the driving range. From $t_{-1}$ to $t_0$ the ball is on the tee and initialized. At $t_0$, the impact takes place to launch the ball. From $t_0$ to $t_1$, aforedescribed interval I1, the ball transmits for purposes of establishing launch data which includes, but is not limited to launch angles, velocity and spin. It is noted that in the embodiment of FIG. 1, the ball can transmit the ball tracking signal continuously, for example, by repeatedly transmitting synchronization information followed by ID information. In another embodiment, yet to be described, the ball tracking signal can be transmitted intermittently during I1. From $t_1$ to $t_2$, the ball is in flight and monitors for a landing without transmitting. At $t_2$, landing takes place. From $t_2$ to $t_3$, the ball transmits information including the ball ID and which can include the landing code. This can include one transmission that is immediately responsive to landing, followed by at least one random ID transmission. From $t_3$ to $t_4$, the ball is silent and does not transmit. This corresponds to interval I2 which is generally sufficiently long to insure that the ball rolls to a stop. From $t_4$ to $t_5$, the ball randomly transmits information including the ball ID and which can include the rollout code for use in establishing its final post-roll position.

Figure 11A:
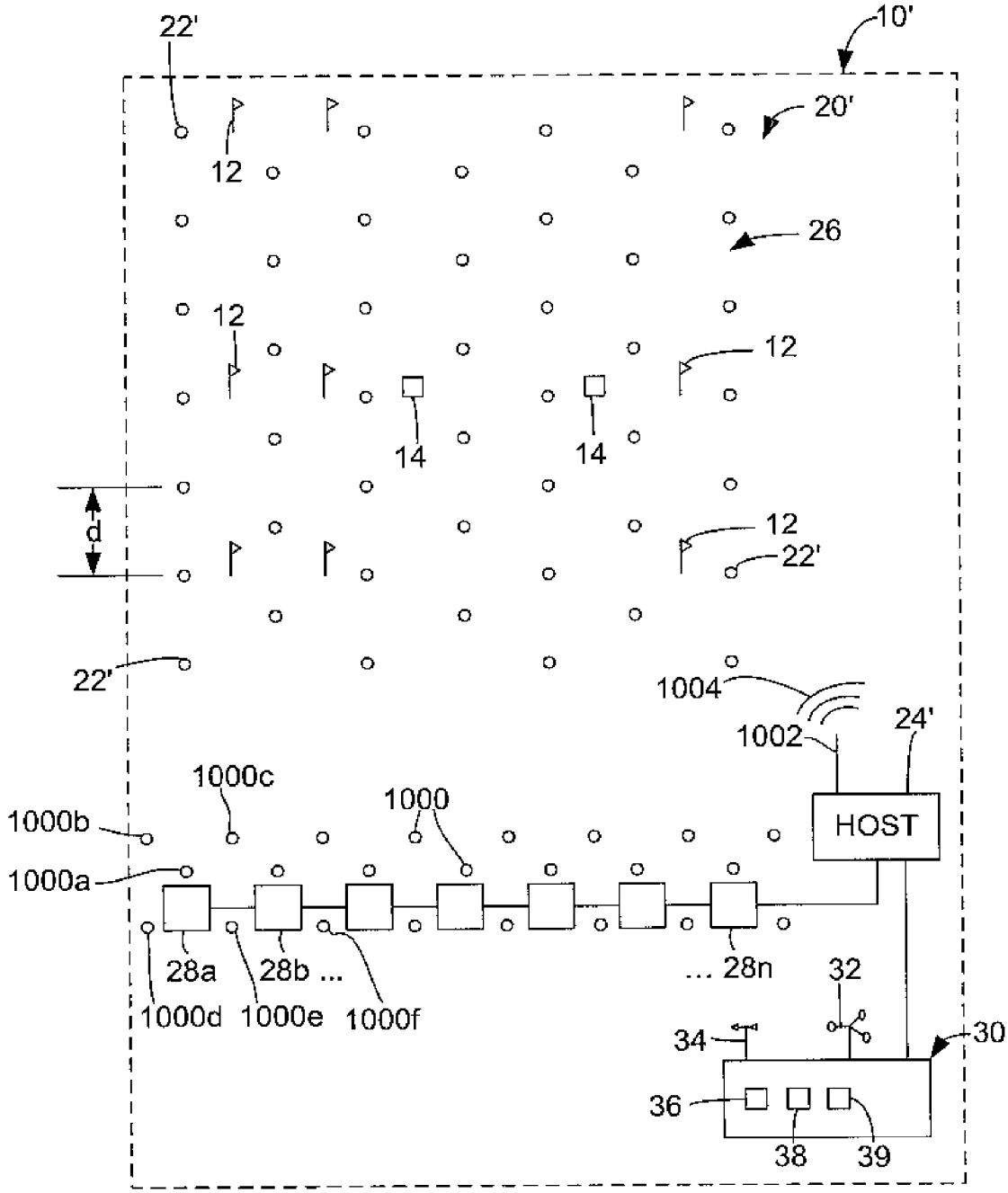
FIG. 11*a* is a diagrammatic plan view of another embodiment of a system on a driving range which system can use wireless GTs.

Attention is now directed to FIG. 11*a* which diagrammatically illustrates another embodiment of a system, which is generally indicated by the reference number 20', on golf driving range 10. The system includes an array of wireless range ground transceivers 22' (GTRs) and wireless launch ground transceivers (GTLs) 1000. It is noted that system 20' can readily be implemented with wired range and launch GTs wherein wired range transceivers correspond to GTs 22 of FIG. 1. Wired GTLs correspond to a simplified form of the wireless GTL by eliminating the wireless functionality in favor of a connection to an inground network, in the manner that is described above for GTs 22. While the use of wireless GTs may provide benefits in the form of making installation less labor intensive and less intrusive, it should be appreciated that other benefits may be associated with wired GTs such as, for example, the ability to provide electrical power through the cabling network. In this regard, the wired GTs of the system of FIG. 1 may be replaced with wireless GTs. Further, some combination of wired and wireless GTs can be provided.

Another advantage of a wireless system resides in the potential to extend and expand an existing system with no disruption of wireless or wired GTs that are already installed. As one example, an existing wired system of GTs may be expanded using wireless GTs, for example, when a driving range is expanded. Additionally, any time an inoperable or damaged GT (wired or wireless) is identified, if enough added range exists, then this will not cause the system to fail locally in some region of the driving range. To elaborate on what this means, in the event that one or more GTs fail on the range, but these failed GTs are not adjacent to each other (random failure events are considered), in one aspect, the transmission range of the ball to a GT may be sufficient to reach a different GT, irrespective of whether the GTs are wired or wireless. Essentially, from the perspective of the ball, this redundancy is provided by a ball to GT transmission range, and cooperating layout of GTs, that causes the ball, for a given location on the driving range, to be within transmission range of more than four GTs, when it is desired to establish the two dimensional location of the ball when using the aforedescribed differential distance technique. In another aspect, the transmission range of a wireless GT to an adjacent wireless GT (for a wireless mesh network) may be sufficient to reach a different GT so as to insure redundancy in the system. In either instance, the probability of "dead spots", where balls cannot be identified and located, even in the event that one or more GTs fail, is reduced. In the event that multiple GTs fail in a localized area (not expected, but at least theoretically possible, for example, as a result of a lightning strike, flooding and the like), the system can automatically notify the operator of such a condition, so that repairs can be made in a timely manner with little or no down time. Such a FA (failure analysis) can be performed automatically by the same system calibration (time calibration and other routines) that already exist. Further, replacement of an inoperable wireless GT is simplified at least from the standpoint that no wiring connections are needed.

A wireless GT may be solar powered, use long life battery technology, a combination thereof, or some other suitable arrangement whereby to avoid a need for external power provisions. In this regard, the wireless GTs can use power conservation techniques, along with design constraints to minimize power consumption when in use. This is of particular interest if the range is being used in a location where operation is up to 24 hours/day, and a solar power implementation is employed. The power that is gained during a minimal sunlight time (charging a battery) and a maximal non-charging time (excessive clouds, night, etc.) should be sufficient to maintain an adequate power supply to provide for system operation.

Communication in the wireless environment can be handled using radio frequency (RF) communication. The method of communication to and from host 24' can either be direct or through the use of a wireless mesh network using an antenna 1002, as will be described further. Regardless of the specific details of the method and associated implementation that is used, communication can be either via single frequency or spread spectrum and have power levels based on design requirements. The frequency bandwidth can be licensed or unlicensed.

Depending on the accuracy and drift of each GT clock, the frequency of the GT clock interval can vary with respect to wired or wireless GTs. In the case of a wireless mesh network, or other wireless embodiment, the aforedescribed method for real time clock calibration is applicable to wired GTs, since the cable network is needed to send the clock calibration to the wired GTs. The embodiment described immediately hereinafter, while framed in terms of wireless GTs, is applicable to both wired and wireless GTs and, therefore, is readily employed in the instance of a hybrid system having both wired and wireless GTs.

Turning again to FIG. 11*a*, attention is directed to one embodiment of a method for maintaining wireless GT calibration, to within some given minimum time period such as, for example, on the order of about Ins, as noted earlier). Accordingly, host 24' transmits a periodic time stamp RF calibration transmission 1004 from antenna 1002, which all wireless GTs are intended to receive. In one embodiment, the real time clock of each GT is synthesized using a crystal oscillator as a reference. In the case of all crystals in the GTs being chosen for an accuracy of +/−20 ppm, the actual frequency accuracy of one GT can drift 40 ppm relative to another GT where a worst case is seen if one GT is +20 ppm in frequency and another GT is −20 ppm in frequency. The interval at which time calibration should be performed is related to the amount of worse case oscillator drift that can occur from GT to GT as well as how much oscillator error is tolerated between GTs. This determination is considered to be readily performed by one having ordinary skill in the art to insure sufficient GT to GT and system wide clock accuracy.

Figure 11B:
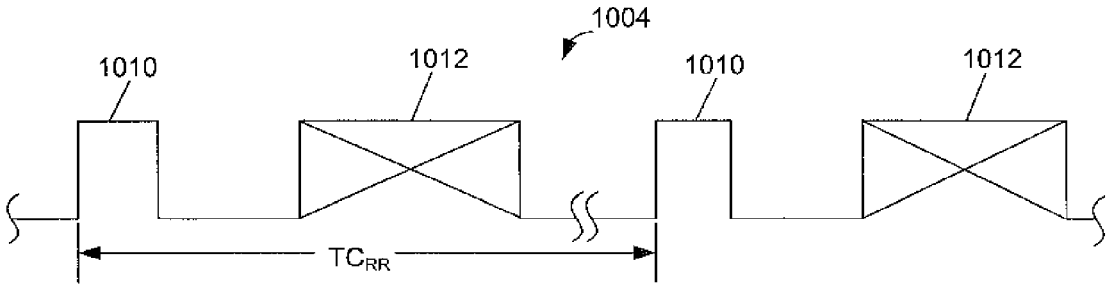
FIG. 11*b* is a plot which illustrates one embodiment of a time stamp calibration signal.

Referring to FIG. 11*b*, in one embodiment, RF time stamp calibration signal 1004 is illustrated. Signal 1004 includes a sync pulse 1010, followed by time stamp information 1012 that specifically identifies the reading (i.e., clock value as a time stamp) of host 24' clock. Time stamp information can include, but is not limited to the time of day in the form of year, day, hour, minute, second, millisecond, microsecond, nanosecond, and fraction of ns if needed. The time stamp information of signal 1004 can be truncated, for example, so that the year, day, and hour are sent intermittently, while the minute, second, and ns are sent corresponding to every interval. Based on a crystal accuracy of +/−20 ppm, this time stamp sync information can be sent at a repetition rate $TC_{RR}$ of approximately 5 thousand times/second in order to maintain Ins phase synchronization between the GT clocks. It should be appreciated, however, that this repetition rate may vary widely, depending on design factors. Responsive to a GT receiving the time calibration signal, that GT re-synchronizes its real time clock (RTC), and continues operation. Each GT can establish within Ins of when time stamp information is expected, so the GT can open a time stamp receiving window, looking for this information. A time stamp receiving window is a periodically generated window in time that is produced when a given GT expects to receive the calibration signal. The time to open and close the time stamp receiving window can readily be determined, if the calibration signal is sent at regular and known intervals. The time stamp receiving window opens at some fixed period in time before the time stamp is expected, and closes at some fixed time after reception of the time stamp is expected. Outside of the time stamp window, the GT can dedicate relatively more processing power and resources to other tasks. The receiver that receives the time stamp sync is different than the receiver that is used to receive ball position information, so if the GT is getting a time stamp, it can simultaneously receive a ball transmission.

One method for performing a time sync correction, in real time, resides in using a ring oscillator, where each delay in the ring is brought out, as can be embodied by the GTs of FIGS. 5*a*, 5*b* and 5*c*, as will be described in more detail immediately hereinafter.

One embodiment of a phase locked loop uses a voltage controlled ring oscillator for clock generation, although this is not required. The ring VCO is useful in terms of its frequency range, relatively low chip area in an integrated circuit and relatively low power consumption.

Figure 11C:
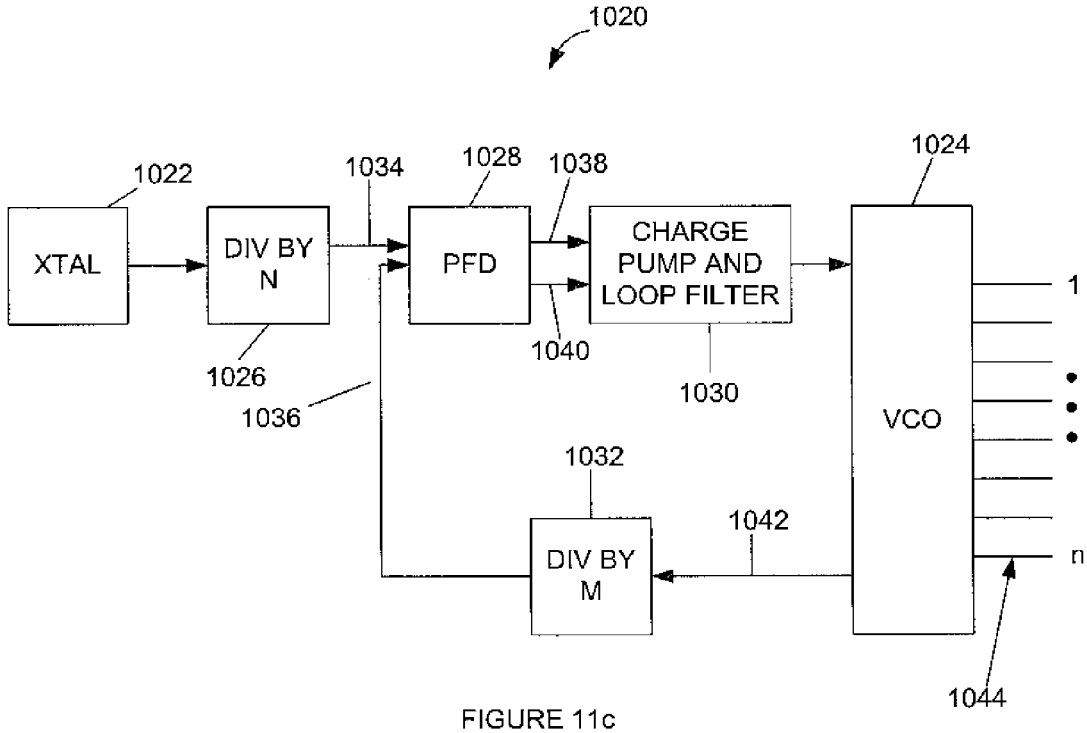
FIG. 11*c* is a block diagram which illustrates one embodiment of a phase locked loop circuit that can be used in GT for purposes of clock stability.

Referring to FIG. 11*c*, one embodiment of a phase PLL circuit is illustrated in block diagram form and generally indicated by the reference number 1020. Generally, the phase-locked loop (PLL) is a closed-loop frequency-control system based on the phase difference between an input reference signal, in this case provided by a crystal 1022, and a feedback signal that is provided by a controlled oscillator, in this case provided by a VCO 1024. The circuit further includes a divide by N block 1026, a phase frequency detector (PFD) 1028, a charge pump and loop filter section 1030 and a divide by M block 1032. Crystal 1022 provides a frequency reference to divide by N block 1026, where N is selectable to provide an appropriate frequency to PFD 1028. The PFD detects a difference in phase and frequency between the frequency reference on a line 1034 and a feed back signal on a line 1036. Responsive to these signals, the PFD produces an up or down control signal on lines 1038 and 1040, respectively, based on whether the feedback frequency is lagging or leading the reference frequency. These control signals cause VCO 1024, via charge pump and loop filter 1030 to operate at a higher or lower frequency, respectively, as needed. In other embodiments, the phase detector and charge pump/loop filter circuitry could be all digital, or a hybrid of digital and analog circuitry. If the charge pump receives an up signal, current is driven into the loop filter. On the other hand, if the charge pump receives a down signal, current is drawn from the loop filter. The loop filter converts the up and down signals to a control voltage that biases the VCO. In response to the control voltage, the VCO oscillates at a higher or lower frequency, to change the phase and frequency of the feedback signal on a line 1042. If the PFD produces an up signal, then the VCO frequency increases. A down signal decreases the VCO frequency. The VCO stabilizes once the reference clock and the feedback clock have the same phase and frequency. The loop filter provides compensation to make the PLL stable, along with filtering out jitter by removing higher frequency noise components from the charge pump. Divide by M block 1032 generates the feedback frequency on line 1036 and provides for increasing the VCO frequency to a value that is greater than the input frequency from crystal 1022.

When the reference clock on line 1034 and the feedback signal on line 1036 are aligned, the PLL is considered locked. The VCO frequency is equal to (M) times the frequency on line 1034. The PFD input on line 1034 is equal to the crystal frequency input clock (FIN) divided by N. Therefore, the feedback signal applied on line 1036 to one input of the PFD is locked to divide by N signal that is applied to the other input of the PFD. VCO 1024 provides a plurality of n phase selectable taps 1044. It is noted that this circuit configuration will be familiar to one of ordinary skill in the art of PLLs.

PLL 1020 can form part of each wired or wireless GT for use in maintaining a sufficiently accurate clock signal therein. Accordingly, selection of a particular phase tap 1044 can be performed to maintain adequate phase synchronization to an external sync signal such as aforedescribed time stamp calibration signal 1004 (sent to all GTs on the range), since the crystal frequency from one GT to the next is not necessarily perfectly frequency matched. Further, the crystal oscillation frequencies may drift relative to one another. Accordingly, compensation accounts for the drift by changing the selected phase tap, to maintain an adequate phase synchronization, for example, of +/−1 ns or better.

One embodiment of a spatial calibration procedure was described above with regard to FIG. 7. As noted, the aforedescribed technique is inapplicable with respect to wireless GTs. Accordingly, attention is now directed to a calibration technique that is applicable not only to wireless GTs, but likewise to wired GTs and to a combination of wireless and wired GTs. In one embodiment both time and spatial calibrations can be performed at the same time, as the process works its way through the range.

Referring briefly to FIGS. 11*a* and 11*b*, host 24' can transmit real time clock synchronization information periodically to all GTs on the range. It should be appreciated that the time stamp information can be sent in many formats, including one in which the time stamp data is only partially sent each sync frame (where a frame can be defined as a transmission of sync 1010 and time stamp 1012, contained in a $TC_{RR}$ period), so that at least some frames can be relatively shorter in duration. For instance, the time stamp information in 1012 could always contain second, millisecond, microsecond, and nanosecond data, but may only send year, day, hour, and minute information every million $TC_{RR}$ periods).

As stated above, each GT may receive time stamp information at different times depending on the distance of the particular GT from antenna 1002, so the clock reading from one GT to the next can be different. Time calibration provides for establishing an offset (in ns or portions of ns, and can be positive or negative) that the host can use to compensate for the differences between the GT clocks, so that when this offset is added to a given GT time stamp, it is then calibrated to the clock of GTa (or some other suitable clock), which is designated as a reference time stamp device on the range. In another embodiment, offsets can be stored in a given GT, so that the offset is introduced before the given GT sends its timestamp to the host.

Figure 11D:
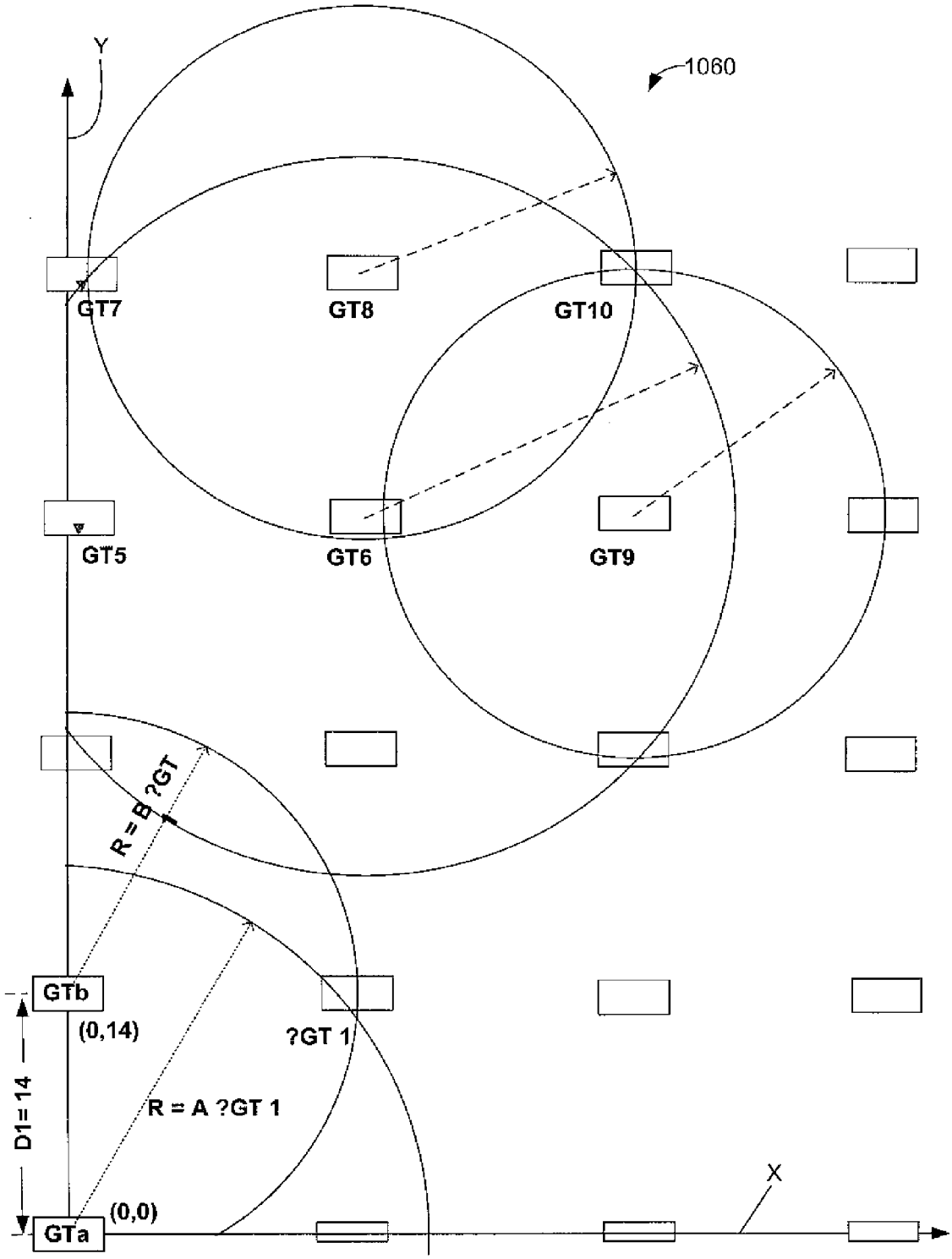
FIG. 11*d* is a diagrammatic plan view of an exemplary layout of wireless GTs in a Cartesian coordinate system, shown here for purposes of illustrating position determinations.

Referring now to FIG. 11*d*, a layout of wireless GTs is generally indicated by the reference number 1060 and shown in a plan view of an x/y coordinate plane for purposes of facilitating the present discussion. It should be appreciated that any suitable coordinate system may be used. It is noted that any coordinate system can be employed so long as it is sufficiently consistent and accurate to the degree needed on the range. Moreover, a polar coordinate system can be used, as opposed to a Cartesian coordinate system. The z axis is normal to the plane of the figure. GTa can, by definition, be located at (0,0), using a Cartesian coordinate system. GTb can, by definition, be located at (0, D1). This means that an imaginary line running through the centers (more particularly, the relevant antennas that receive/transmit the signals of interest) of GTa and GTb can serve as the Y axis of the Cartesian coordinate system. Perpendicular to the Y axis, passing thru the center of GTa, and likewise by definition, is the X axis of the Cartesian system for this exemplary range (when this optional coordinate system is employed). Therefore, using this coordinate system, it may be convenient to place a GTb in a location that causes the Y axis run directly up the left side of the range, or up the right side of the range in the view of the figure. Once the location of GTb is determined, GTa and GTb can be used in combination to find a third GT. Following that step, three GTs can be used in combination to find a subsequent GT, so that any ambiguity in the location of the GT is eliminated. Further details will be provided below regarding this calibration procedure.

In one embodiment, the total number of GTs on the range can be inputted to the host prior to range calibration. This is not a requirement, but will be assumed as the case for the embodiment currently being described by way of non-limiting example. Other embodiments may determine the number of GTs in an automatic manner or perform the calibration procedure until no more GTs respond.

Initial or virgin calibration is performed when the range is brought up for the very first time, after installation of all required range components. After the initial calibration is complete, in some embodiments, any follow-on calibrations may be less complex.

In one embodiment, each GT may have a predetermined ID programmed into memory at the time of manufacture. In other embodiments, prior to installation, but at the location of the range, IDs can be determined and programmed. Whenever the IDs are established prior to installation, initial calibration need not undertake procedures that are directed to establishing IDs including, for example, random ID generation, the possibility and elimination of two identical random IDs being generated and/or similar issues.

In another embodiment, GTa and GTb can be the only GTs that initially have a predetermined ID, for example, of 16 bits (although any convenient number of bits can be used) that is stored in non-volatile memory of the GT. In this example, the other GTs would not have predetermined IDs. The description and flow diagrams will presume this latter embodiment at least for the reason that pre-programmed embodiments are considered to represent at least somewhat of a simplification. It should be born in mind that the discussion is not intended as being limiting and other combinations and permutations are also possible, along with other calibration algorithms that can be implemented in view of this overall disclosure.

Still referring to FIG. 11*d*, it is initially assumed that all GTs, including GTa, GTb, all the GTLs (i.e., launch GTs, which have not been specifically identified for purposes of convenience), and all the GTRs (i.e., range GTs, also not specifically identified) are positioned. A number of GTs are designated in FIG. 11*d* for reference by the discussions which follow. The host can control all activity, using mesh communication to make commands, obtain responses, send and receive data. One example of a set of calibration steps follows immediately hereinafter.

FIG. 11*e* is a flow diagram which illustrates one embodiment of a Time/Spatial calibration procedure for determining GT positions and which is described in the context of the system layout of FIG. 11*d* with GTa at the origin of an x,y Cartesian coordinate system and GTb presumed to be on the y axis. The procedure outlines an initial calibration as well as a follow-on calibration 1) Beginning at 1070, the procedure begins by obtaining the total number of GTs to calibrate. At 1072, it is determined whether this is the first time the procedure is being performed for the given system. If so, the Host at 1074 instructs GTa to send a command to GTb for GTb to respond to a subsequent sync command with a response. GTa timestamps and saves the time of transmission of the sync command, for example, as TODa (Time of Day a) for subsequent use. Step 1076 waits for the GTb response. If there is no response, step 1078 sends an error message to the host. If there is a response, the response info is sent to the host at 1080 including the GTb timestamp which identifies the reception time of the sync pulse according to GTb's clock, for example, as TODb (Time of Day b). There is a fixed delay from when GTb obtains the sync command, to when GTb responds with the response sequence. This delay can be programmed into the GT non-volatile memory at manufacture, at installation, or some other convenient time prior to the range calibration sequence taking place. This delay should be accounted for, so that the distance between A and B can be precisely determined based at least in part on the difference in time between transmission of the sync command sent by GTa and reception of the response sequence by GTa as well as known device delays in GTa and GTb. It should be noted that this portion of the procedure is independent of the clock reading in GTb. Information is retrieved by the host, for example, via mesh system (MS). Information now known=D1.
   Coordinates of GTb are Now Known and are (0,D1).
2) When the sync command was sent to GTb at 1074, time stamp information was saved by GTa identified as TODa, as described above. When GTb responds, it's time stamp information (when GTb received the actual sync information from GTa) was also returned (TODb), as described above, along with GTb's ID.
   With the distance D1 now known, it is also then known that GTb's time stamp information should be equal to the GTa time stamp info plus the time it takes for the sync information to travel from GTa to GTb. Assume this is X ns. If GTb provides a perfectly correct time stamp, the GTb time stamp sent back to GTa should be equal to TODa time plus X ns. Based on these values, a correction factor can be determined by the host. This correction factor can be referred to as CTODb (correction TODb), given as:

$$CTOD_b=(TOD_a+X)-TOD_b$$

If it is assumed, for example, that GTb is about 25' farther from the range time sync antenna (antenna 1002 of FIG. 11*a*) than GTa and that the transmissions travel at Ins/foot: TODb=TODa+25.
   Assume further that GTb is 31' from GTa (i.e., D1=31 feet). This means that a correct TODb returned from GTb would be TODb=TODa+31
   Because of the difference in distance from time calibration antenna 1002, however, the actual returned time is TODb=TODa+25+31. The necessary correction factor then, is to subtract 25 from TODb, where the correction factor is given as:

$$CTOD_b=(TOD_a+31)-(TOD_a+25+31)=-25$$

Accordingly, the host thereafter applies a −25 correction factor to all TODb readings in order to synchronize with TODa readings.
   Calibration of GTb Time Stamp is Now Complete.
3) Locate the next GT and duplicate. At 1082, the host will now command GTa to send a Broadcast Command (BCMD) to all GTs in range of GTa. GTa will send in a given command protocol which is provided by way of example: (the specific numbers and ranges can vary and are likewise provided by way of just example). In there is no response before a timeout, an error state is entered at 1078. The command protocol to all GTs within range can contain:
   a) Command: Respond with ID at a random interval in milliseconds 1-25
   b) As part of the command, GTa will also send:
      i) GTa ID word
      ii) FCC, Parity and/or CRC information (so a GT that receives data can confirm that the data is correct, and can correct the data if it is nearly correct. It is noted that this command may be referred to hereinafter as a system calibration query. ECC/Parity and CRC are well known in communications.
   c) Each ?GT (it is noted that the nomenclature ?GT refers to a GT having a location that is presently unknown in the context of the overall process of discovering the locations of all GTs in the range) in range of the GTa command can now enter the following process:
      i) Generate a random interval between 1-25 ms (for example)
      ii) Start a timer in milliseconds, set to the random interval selected.
      iii) Generate a random ID of 16 bits.
      iv) Transmit a response to GTa at the conclusion of the random interval which includes the random ID.
   d) GTa awaits responses from ?GT devices at 1084.
      i) If an initial response is clean at 1086. That is, the random ID is received accompanied by good ECC data. That response will be used.
      ii) If, however, the first response is from two ?GTs that collide in time, the ECC will be bad. In this case, GTa will restart at 1082 and issue a new command #1 above. Such that the process restarts seeking ?GT devices.

e) At 1086, GTa has a valid $ID_?$ from an unknown ?GT. For descriptive purposes, it is assumed that this is ?GT1 of FIG. 11*d* having $ID_{?1}$ as its ID. GTa then determines that no other ?GT chose the same ID. This is unlikely, but possible. The probability is 1 in 65536 ($2^{16}$) for a 16 bit ID.

i) Still at 1086, send a high power command to ?GT1 in order to test for another GT that may have created the same ID. In this way, more GTs will receive the command, and their response will also be with higher power to confirm the integrity of a number of IDs.

ii) GTa now waits for the ?GT1 response with no collision and which response should include $ID_{?1}$. If the response is not clean, operation returns to 1082. In the event of a timeout, operation proceeds to an error state at 1078.

iii) Continuing at 1086, GTa now sends out a command for ?GT1 to lock in $ID_{?1}$. This will be the permanent ID stored in non volatile memory in ?GT1. Hereinafter, ?GT1 can be referred to as GT1 having $ID_1$. A command is sent for only $ID_1$ to respond. At 1088, if the response is clean operation proceeds to 1090. If the ID is not clean, operation returns to 1082.

f) Next, at 1090, GTa is used to assist in finding the (X,Y) location for GT1.

i) GTa sends a command for only GT1 to respond with sync information (because $ID_1$ can now be used)

ii) As parts of this command, GTa can send ID A (the ID of GTa, ECC/CRC)

iii) GT1 responds with sync information, $ID_1$, ID A, TOD $ID_1$ and then the ECC/CRC. All of this information is received and confirmed by GTa.

iv) Host retrieves this information from GTa, and determines a distance A ?GT1 (see FIG. 11*d*) which is the distance from GTa to ?GT1.

v) At 1092, GTb now stands in for GTa and sends a command for only ID1 to respond with Sync and TOD, as in the just described process beginning with step (i) above vi) At 1094, a test is performed to establish whether the receipt of ID1 is clean. If not, step 192 repeats or a timeout error state can be entered. If ID1 is clean, step 1096 repeats the procedure of aforedescribed step 1090 having GTb standing in for GTb. In this regard, the Host retrieves the GTb related information, and determines distance B ?GT1, which is the distance from GTb to ?GT1. At this point, the positions of GTa and GTb are known. Further, the distances from each of these GTs to GT1 are known.

g) Host can now determine the location of ?GT1, based on the intersections of a circle of radius A GT1 surrounding GTa and another circle of radius B GT1 surrounding GTb. There will be two locations where these circles intersect, however, one location is distinguished as being inside the range (i.e., the first quadrant of the Cartesian coordinate system of FIG. 11*d*), and the other intersection will be outside the range. This is why (as described earlier) the Y axis can define either the left or right side of the range, which forces one of the intersections outside the range to then be eliminated. Only during the virgin/initial calibration should this case exist. It is noted that the location of ?GT1 (at this time) can be found in two dimensions (x and y). Subsequent to finding the location of ?GT1, the next GT can be found in 2D, because there will always be 3 GTs available for use in finding the subsequent unknown GT locations. If a 3D location of subsequent GTs is desired, 4 GTs must be used to find the unknown GT location.

Location of ?GT1 is Now Determined, and ?GT1 has Permanent $ID_1$

4) Determine time stamp calibration of ?GT1 a) At 1098, Based on information received above, the host can also determine CTOD for GT1 with $ID_1$, because the host has available the distance from GTa to ?GT1, and the time stamp received. Accordingly, the procedure described above can be employed with GT1 standing in for GTb in order to determine the correction value for GT1.

Calibration of GT1 is Now Complete

5) Now, $GT_a$, $GT_b$, and GT1 are all calibrated in both time and space, by the host. At 1100, the process can continue, using any three GTs that are within range of a ?GT at an unknown location to find location of the next ?GT in two dimensions, assign each ?GT a fixed ID and establish an associated time calibration CTOD. It is noted that the use of three GTs at known positions provides for a determination of the position of an unknown GT in the x/y plane without ambiguity.

6) At this point in FIG. 11*e*, the host can select three adjacent GTs at known positions: $GT_{cx}$, $GT_{cx+1}$ and $GT_{cx+2}$ where the subscript "c" represents a GT that has already undergone calibration. Initially, these three GTs will be GTa, GTb and GT1. At 1102, $GT_{cx}$ can then transmit a BCMD to seek a random ?ID from a ?GT (an ID that has been generated in response to the BCMD by a GT that is currently at an unknown position). It should be appreciated that the current group of adjacent GTs serving as $GT_{cx}$, $GT_{cx+1}$ and $GT_{cx+2}$ may serve to locate a number of GTs. Once no more ?GTs respond to the current group, however, a new group of GTs is selected to serve as $GT_{cx}$, $GT_{cx+1}$ and $GT_{cx+2}$. This new group can then issue the BCMD to query for ?GTs that are in range. Referring to FIG. 11*d*, as one example GT6, GT8 and GT9 (where a "calibration circle" is indicated for each GT of the group) serve as the group of GTs that is used to calibrate GT10. Accordingly, the calibration circles intersect at GT10. It should be appreciated that both intersections of any two of these calibration circles fall within the boundaries of the range. The use of the third circle therefore resolves this ambiguity in two dimensions. As stated before, in order to get 3D which would include the z axis (vertical from the page of FIG. 11*d*), a $4^{th}$ GT would be needed. Steps 1084', 1086', 1088' and 1090' will be recognized as reflecting a general repetition of the procedure that is associated with prior steps but for a different group of GTs. At 1104, the Host completes calibration of the current unknown ?GT. At 1100', a new group GTs is selected to find the next unknown ground transceiver ?GT. Step 1106 establishes whether all GTs have been calibrated. If so, the process terminates at step 1108. If more GTs remain, operation returns to 1100. Returning to step 1072, if the calibration is an initial calibration, step 1110 returns operation to step 1074 but omits any operations with respect to establishing GT IDs since these are known from prior calibration. At step, 1112 it is determined if all GTs have been calibrated. If so, the process terminates at 1108. If more GTs remain, step 1110 is repeated.

When the number of GTs expected to respond is known and this number of GTs has responded to the process, the initial wireless calibration process is complete. The process can otherwise terminate once no additional GTs respond to a time calibration query that can be issued from every known GT on the range.

7) Once an initial time or spatial calibration is complete such that all GTs have valid and unique IDs, subsequent calibration processes can then omit steps that are directed to ID assignment. In one embodiment, as subsequent calibrations are performed, time and spatial calibration values can be averaged, so that accuracy continues to improve. In the example of FIG. 11*e*, the process can start at step 1100 and omit aspects of the procedure that are directed to ID assignment.

Figure 12:
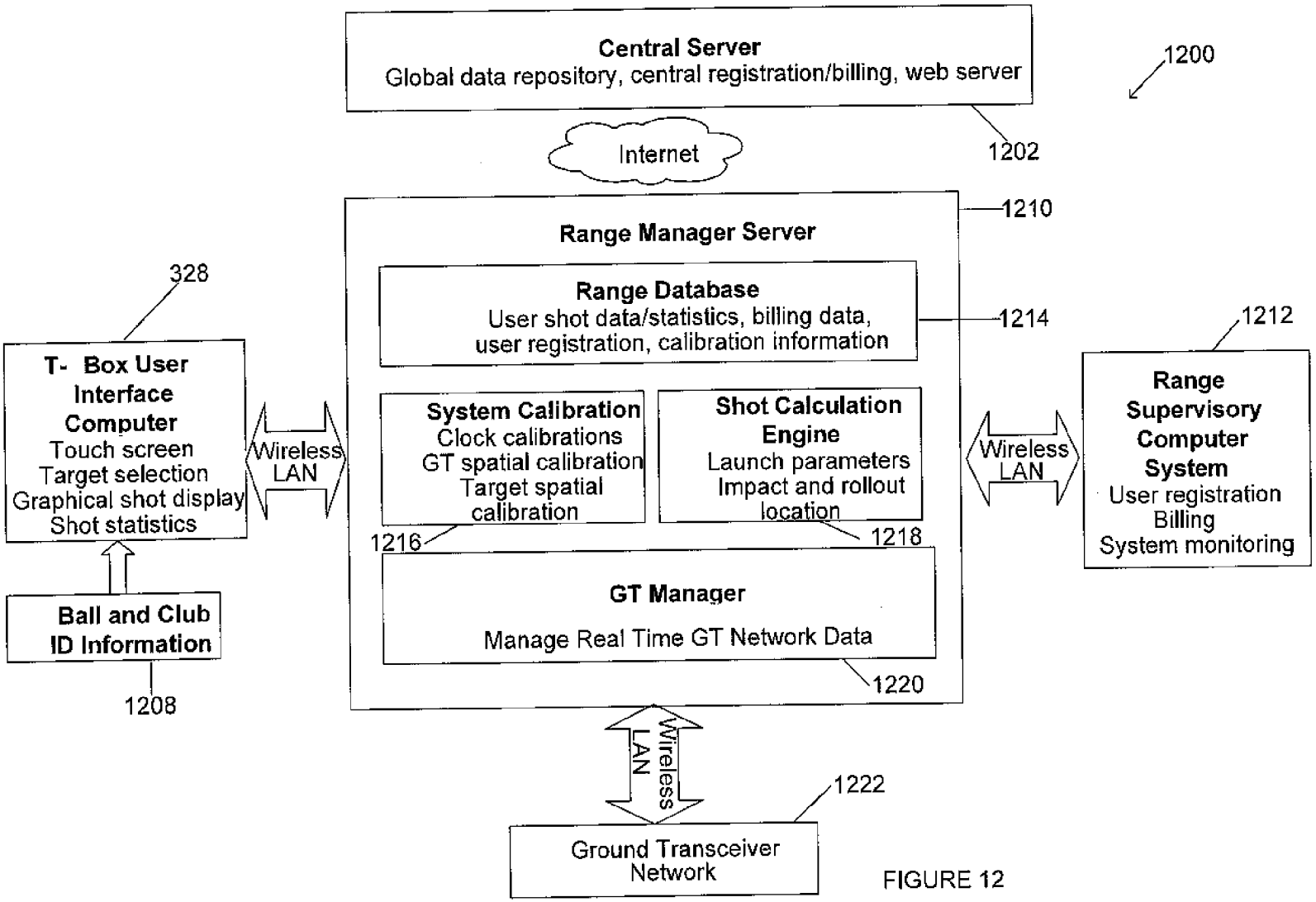
FIG. 12 is a block diagram which illustrates various components of one embodiment of a system that is produced according to the present disclosure.

FIG. 12 is a block diagram which illustrates various components of one exemplary system that is produced according to the present disclosure, generally indicated by the reference number 1200 with respect to selected components of the system. The system includes not only the components of an individual driving range such as, for example, a plurality of tee station computers 330, but components that are distributed at remote locations around the world. For example, a central server 1202 is illustrated that can communicate with the remainder of the system via the Internet and can, therefore, be located at any suitable location. The central server can perform as a global data repository, as well as being used for centralizing various tasks including registration and billing. The central server can further serve, for example, as a worldwide website host for informational and reservation services. As illustrated, each tee station 28 can receive ball information, as well as club information from a detector section 1208, as will be further described. Host system 24 or 24' of FIGS. 1 and 11, respectively, can be made up of a range manager server 1210 and a range supervisory computer system 1212 that handles local registration, billing and system monitoring. Range manager server 1210 can include a range database 1214 that can store information relating to a particular range that may include, but is not limited to user shared data and statistics, billing data, user registration data and calibration information such as, for example, calibration schedules.

The data stored in the database is used to compute user statistics or can be used for "gaming" purposes as well perform user registration, billing and system monitoring 903. The range database information can periodically be uploaded to central server 1202 where data from other ranges is also stored in a global repository. A system calibration section 1216 includes calibration information and procedures that are used on an ongoing basis during operation of the system. For example, clock calibration procedures and related management information can be stored. This may include implementing the real-time clock reset periodically, as described previously with respect to FIG. 8. As another example, information relating to time calibration can be stored as developed, for example, on the basis of aforedescribed FIG. 6. GT spatial calibration information can be stored as developed, for example, on the basis of aforedescribed FIG. 7. A shot calculation engine 1218 is used to establish information that is developed for each shot taken at one of the tee stations such as, for example, launch parameters and landing parameters which may include rollout information. A GT manager section 1220 serves to collect and manage the information that is gathered from the various ground transceivers that are organized in what is indicated by the reference number 1222 as a ground transceiver network. While certain components are indicated as being connected using wireless local area networks, it should be appreciated that this is not a requirement. For example, if one or more wired ground transceivers is used, a hardwired connection can be present between ground transceiver network 1222 and ground transceiver manager 1220.

Figure 13:
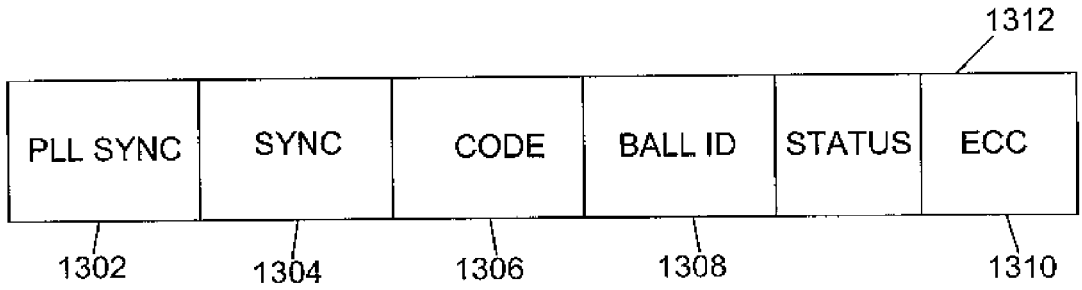
FIG. 13 is a diagrammatic illustration of one embodiment of a set of data fields that may be used to form a ball transmission.

FIG. 13 is diagrammatic illustration of one embodiment of a set of data fields that may be used to form a ball transmission, generally indicated by the reference number 1300. It is noted that these fields may form part of aforedescribed ball signal 50. In this regard, the present example is illustrative in nature and is not considered to be limiting. In the present example, transmission 1300 begins with a PLL Sync portion 1302 which is appropriate, for example, when the ball does not include a crystal for purposes of oscillator stabilization, as described above. A sync portion 1304 includes synchronization information, for example, that can be a precise sync time for the GT to establish a received TOD, as was described above, and will be described in more detail below. Code portion 1306 can identify the particular time period of a transmission that is taking place such as, for example, a launch, a landing or a rollout. Ball ID portion 1308 includes the identification number of the ball. Status portion 1310 identifies any particular information that is of interest, as will be further described. FCC portion 1312, is the final data sent. This, as described above, is well known in the art, and is used by the receiving GT to determine if all previous data is valid, and if not, can in some cases correct the data to be valid. If not, the data cannot be used. As described above, the most likely cause of invalid data is an RF collision. In this embodiment, all information is transmitted in digital form, which may utilize any suitable digital modulation method including, but not limited to pulse code modulation.

With regard to operation of the ball, Table 1 identifies various states in which a ball can be found, accompanied by related notes. It is noted that a ball without a crystal is presumed, however, this is not required. In the instance of a ball having a crystal oscillator, calibration steps and states relating to the ball oscillator are generally not needed.

TABLE 1

| Ball State | Ball Function | Notes/Description |
|---|---|---|
| COMA | Ball electronics are turned off essentially completely. Lowest operational power mode. | This is a condition when the ball is being stored, or when the ball has completed the final transmission after rollout. It can be brought out of Coma mode by being subjected to specific low frequency magnetic fields. |
| $CF_0$ | Ball is being charged and is active. It's internal non-volatile memory can now be programmed. | This is for initial programming of the ball, or for updating the ball. It is program space, and/or internal parameter values. |
| Charge Frequency 1 ($CF_1$) (FIG. 3, item 312) | Ball is being charged, but there is no response. | This charging might occur in a range mass storage area, or in a dispenser |

TABLE 1-continued

| Ball State | Ball Function | Notes/Description |
|---|---|---|
| $CF_2$ (FIG. 3, item 316) | Ball is going thru dispenser tube. It will send out ID and status information. | The dispenser tube receives the ball after being dispensed to the hitting mat. |
| $CF_3$ (FIG. 3, item 308) | Ball is on hitting mat, and responsive to $CF_3$, sends out ID information again. Ball also now performs ground proximity calibration (FIG. 2d). | The ball has just been placed on the hitting mat. Correct/valid ID is confirmed. |
| $CF_4$ (Lo Charge) | Ball is on hitting mat, and continues to transmit ball signal 50 (FIGS. 2h and 3). | If ball sees $CF_4$ (i.e., Lo Charge, as described with regard to FIGS. 2g and 2h), it lowers it's internal frequency 1 step. Then waits a short time, and looks again for either $CF_4$ or $CF_5$. |
| $CF_5$ (Hi Charge) | Ball is on hitting mat, transmitting ball signal 50 (FIGS. 2h and 3). | If ball sees $CF_5$, (i.e., Hi Charge, as described with regard to FIG. 2g and 2h), it raises it's internal frequency 1 step. Then waits a short time, and tests again for either $CF_4$ or $CF_5$. Process terminates per FIG. 2h. |
| $CF_6$ | Ball is on hitting mat, has completed all calibrations, had has good status. It is now armed and waiting for launch detection. | During this time, ball arms itself for launch, transmitting intermittent ID and status information. Upon launch, it will transmit launch signal 50. |
| $CF_7$ | Ball is on hitting mat. This is the hitting mat IDLE frequency. | During this time, the ball is waiting for other commands, such as Proximity cal, NCO cal, and Arm command. |
| $t_0$ (FIG. 10) | Ball detects launch and enters I1 launch interval. (FIG. 10) | From approximately $t_0$ for the duration of I1, ball transmits ball signal 50 for GTs to determine launch trajectory, launch velocity, and spin. |
| Flight time- $t_1$ to $t_2$ (FIG. 10) | Ball is in low power state, looking for impact. (FIG. 9) | Ball can sense impact several ways. If a ground proximity detector is used, this triggers initial launch transmission. |
| $t_2$ (FIG. 10) | Ball detects landing (FIG. 9) | |
| $t_2$ to $t_3$ (FIG. 10) | Ball transmits landing info | Ball can transmit a PLL sync field, a sync pulse, landing code, then ball ID information and ECC(FIG. 13). It then waits random periods of time, and re-transmits up to a programmable number of times. (FIG. 9) |
| $I_2$ ($t_3$ to $t_4$ in FIG. 10) | Ball is timing a rollout interval (FIG. 9). | This can typically be 3 to 4 seconds. |
| $t_4$ to $t_5$ (FIG. 10) | Ball transmits from rollout position (FIG. 9) | Ball can transmit a PLL sync field, a sync pulse, rollout code, then ball ID information and ECC (FIG. 13). It then waits random periods of time, and re-transmits up to a programmable number of times. (FIG. 9) |
| t5+ (FIG. 10) | Ball goes into Coma state. | Ball will not wake up until it sees a LF magnetic charging field. |

Referring again to FIGS. 2*g* and 2*h* in conjunction with FIG. 13, calibration of a ball having a non-crystal oscillator (NCO) was described. It should be appreciated that the calibration of this system is not expected to hold frequency accuracy as tightly as an actual crystal controlled oscillator, which is usually 0.001% or better, from the time lifecycle from $t_1$ to $t_5$ in FIG. 10. If the frequency can be initially calibrated to within about +/−0.2% of a target frequency, and it stays within +/−0.2% of the target frequency over the time lifecycle from $t_1$ to $t_5$, then the GT PLLs can "lock on" to a ball transmission, and acquire the data in the ball transmission. PLL sync field 1302 allows some calibration error, so this is the field that the GTs use to lock onto the actual frequency being transmitted by the golf ball. Once lock on has occurred, any small frequency deviation of the carrier during the subsequent transmission of the information in subsequent fields is also tracked.

Referring again to FIG. 13, sync field 1304 is used by the GTs as a time stamp reference. That is, when a GT receives the sync pulse, along with a ball ID, that GT will apply a timestamp that is based on the internal clock of the GT and then transmit this information to the host. In one embodiment, a timestamp at each GT is set to the nearest nanosecond. It is noted that the time stamp accuracy can vary, depending on what accuracy is required. In this regard, one nanosecond gives about 1 foot of spatial accuracy, which is considered to be reasonable in a golf system. As noted above, code portion 1306 indicates to a receiving GT whether a particular ball transmission is a launch, impact or rollout transmission. It is noted that other codes can readily be provided and that the present examples are exemplary in nature, as opposed to being limiting. Ball ID 1308 is the ball identifier, and is unique to each ball on the range. The ball ID provides for tracking a ball from a given hitting mat to a position on the range, and then feeding that information back to the user. Status field 1310 may be optional and, if used, can comprise a wide variety of information that is of use. Status information can include, for example, how much energy is left in the power system of the ball at impact, rollout or other times. Such information is useful, for example, in assessing performance. Other examples, with respect to the use of the status information, may be implemented at a dispensing station, and on the hitting mat, to confirm that all systems are go, there is adequate battery power, ball calibration has been completed and the like. In all cases, the FCC information 1312 is sent, so that the receiving GT can verify all data sent is valid.

Possible Error Conditions:

At this juncture, it is prudent to describe common error conditions that may occur, and appropriate responses. It is considered that the approaches that are described will provide a framework and basis for handling other error conditions that may subsequently be identified.

1. Range timing calibration error: Can be identified anytime a timing calibration is performed to synchronize all the real time clocks of the GTs, and an error condition is found. Since timing calibrations are performed periodically, any error can be identified immediately to the range operator, and corrective action identified. A typical example of an occurrence of this is when a GT fails to respond during the procedure. The cause for such failure of the GT to respond can be many, including but not limited to power outage to that GT, failure of the GT electronics, a missing GT and the like.
2. Range spatial calibration error: Can be identified any time a spatial calibration is performed. For example, in FIG. 11*e*, timeout decisions refer the system to repeat a prior step or to appropriate error handling. A spatial calibration typically is not frequently needed. Examples which indicate such need can be the identification of a discrepancy in ball landing information (meaning a triangulation cannot be found for location), the location of a GT that was previously known changes substantially, a GT is not found, or some other such anomaly is determined. The range operator can perform a complete range calibration at any time (typically at the beginning of the day), or the system can be programmed to automatically do all calibrations on a daily basis. Whenever a new GT is replaced or installed, a complete range calibration will be performed.
3. Ball status error: When the ball is first being dispensed to the hitting mat, there is a low frequency charging signal of a particular frequency that is detected by the ball. In other words, this event takes place when the ball is being dispensed and is enroute to the mat, but is not yet at the mat such as is the case with respect to charge signal $CF_2$ of FIG. 3. In response, the ball transmits status information (ball ID, battery level, self test diagnostic results and any other available information that is desired). If any of this information is incorrect, the range operator will be signaled, and also the user will be signaled to put the suspect ball in a refurbish area, and the user will not be charged for that ball. In another embodiment, this process is automated, for example, by the dispenser of FIGS. 4*b* and 4*c*.
4. Ball ID error: When a ball arrives at the mat, the mat has a unique low frequency that the ball identifies as the mat. This causes the ball to again transmit ID information. This ID information must match what was just seen by the dispenser, or an error condition has occurred. For instance, suppose a user walks out on the range a short distance, picks up a ball, brings it back to his hitting mat, and drops it to hit. The ball ID is now identified as a previously used ID, which was not just dispensed and will be rejected by the system for tracking purposes. This represents one instance of an ID error.
5. Ball hit error: There may be cases where the ball is apparently hit, but the local GTs don't pick up a launch trajectory. This could happen, for example, if someone picks up the ball from the mat, but does not hit it. Another example occurs if a user barely hits the ball, and it dribbles off the mat. In any case, the system will recognize that something is incorrect, since no launch data is detectable, signal the range operator, and also signal the user, along with instructions.
6. Ball impact error: This may occur if the ball is hit, but no ID that matched the ball just hit is identified, which would correspond to the landing of the ball. This can occur if the ball is hit outside the range, if the ball hits in a depression where the impact transmissions are not received, and similar such circumstances. In any case, this error is noted to the user and range operator.
7. Ball rollout error: Note that the ball sends a different code when it first contacts the ground (impact), as opposed to when it completes rollout. If a ball impact code is received, but a ball rollout is not received, this error condition is generated. This can happen in several cases. By way of non-limiting example, the ball might plug into the ground at impact. As another example, the ball may roll into a depression from which transmission cannot be received. As still another example, the ball may roll out of the range after the first bounce.
8. Ball dispenser error: Ball is not dispensed properly, due to failure of dispenser. Another type of dispenser error might occur if one or more balls put into the dispenser reservoir at the hitting station do not match the balls that were given to the user to carry to the hitting station. The balls that are provided to the user may be referred to as authorized balls. For example, the user picked up a stray ball and added it to a basket of authorized balls.

Errors can be recorded with relevant information regarding each error event, along with associated statistics. In this way, the range operator can keep track of balls, as well as repeating issues such as a location on the range that is missing ball signals, which might indicate that another GT should be added to cover that area and the like. Error diagnosis, error recovery, and statistics form part of the software of the range. This information can also be retrieved world wide to provide an idea of range performance relative to other ranges in many regards.

Referring again to FIG. 11*a*, in the exemplary case of a mesh network, required power levels are lower than in a direct communication method from each wireless GT to the host, because distances, with respect to any individual transmission, can be reduced. There may be other attendant benefits such as, for example, reducing interference and with respect to the use of licensed versus unlicensed RF spectrum space. As is well known in the technology of spread spectrum communications, there can be multiple users of the same spread spectrum space in the same location. These users do not interfere with each other. A single frequency, licensed or unlicensed, does not have this benefit. For purposes of the present example, it is assumed that system 20' of FIG. 11 is a wireless mesh system. In such a mesh system, communication for each wireless GT 22' to and from host 24' can be performed using existing communication protocols that are implemented via host antenna 1002. As of this writing, there are over 70 mesh systems in existence, each system using a different protocol and possibly transmission method, as well as different frequency characteristics. It is a shared feature of a mesh system that data "hops" from one device to another until it reaches its prescribed destination. In addition, tee stations 28*a-n* can also communicate to the host wirelessly, although this is not a requirement. Such wireless tee station communications can, likewise, utilize direct or mesh technology.

With continuing reference to FIG. 11*a*, wireless GTs 22' may be arranged on the driving range in any suitable manner. In the present example, the wireless GTs can be set out in a column that extends from each tee-off station and are separated within the column by a distance d. Adjacent columns can be offset with respect to one another by one-half d. The columns are typically spaced apart from one another by a similar distance, although this is not a requirement and the GTs can be arranged with calibration considerations in mind, for example, as described with respect to FIG. 11*d*. It should be appreciated that any suitable layout of the wireless GTs may be used in view of the typical receiving range that is exhibited between a ball and wireless GT. At least in this sense, there is no difference between the layout of wired versus wireless GTs. Even an arbitrary arrangement of the wireless GTs may be used, so long as, for any given position on the range, the ball is within range of at least four GTs when it is desired to determine the position of the ball for that given position within the lateral extents of the driving range. The time differential arrival technique, described above, remains applicable with respect to determining the position of the ball on the driving range. As will be further described below, for purposes of characterizing the launch parameters of the ball, the ball can transmit information picked up by wired and/or wireless GTs that are near the T-station to determine launch velocity, launch spin speed, and initial launch trajectory in three dimensions, relative to at least five GTs.

For purposes of detecting three dimensional launch information using GTLs 1000 (e.g. GTLs), launch information can be collected within milliseconds of launch. It is noted that the present discussion is framed in terms of GTLs since wired and wireless forms are essentially identical in this context. To accomplish launch data retrieval, at least five GTLs 1000 are located in sufficiently near proximity to each tee station. Hence, if a GTL is placed immediately in front of each tee station, and tee stations are relatively near each other (within about 8 feet), then three GTLs are already in desired positions. A fourth and fifth GTL is needed in proximity. One possible location is having a GTL between each tee station such as those at 1000*d*, 1000*e* and 1000*f*. This allows a given tee station to have 3 GTLs in front and one GTL at each side to give the requisite five needed in close proximity to obtain 3D launch information. Other locations are also suitable and those that have been illustrated have been provided by way of example. In the present example, three rows of GTLs are provided where, by way of example, GTLs 1000*a-e* are associated with station 28*a* and form a launch zone or region for this tee station that is defined by the receiving range from ball to GTL. It is noted that GTLs 1000*c* and 1000*e* are shared with stations 28*a* and 28*b*. For purposes of characterizing the launch of the ball, the system functions in a manner that is, in principle, essentially the same as described above for finding the position of the ball in a two dimensional field that characterizes the lateral extents of the driving range. In this instance, however, the three dimensional position is now found, as a function of time, based on five delay times, as opposed to four. The GTLs can have a different antenna on them than the range GTs. The antenna on the launch GT, for example, can be designed to have a much higher angle of reception and optimized for detecting the signal from the ball during launch. The only other difference between the launch and range GTs may be the firmware loaded on the unit. The launch GTs will have firmware augmented to handle trajectory and spin data In an embodiment that uses the ground transceivers to characterize the launch information, when the ball is first struck, processor 54 (FIG. 2*a*), responsive to a suitable sensor such as, for example, an Earth proximity detector, can sense that the ball has left its tee station and cause the ball to begin transmitting (step 910, FIG. 9). This transmission (step 912, FIG. 9), however, can be performed at intervals that are spaced apart in time. For example, processor 54 can cause the transmission of ball signal 50 (FIG. 2*a*), including the ball ID, at intervals that are some number of milliseconds spaced apart, so that in the launch zone (defined by the receiving range of the five GTs for a given tee station), a sufficient number of transmissions can be received from the ball in order to characterize the launch data for that hit. For example, transmissions can be obtained from the ball corresponding to an incremental movement of no more than one or two feet of travel in the launch zone. As set forth in FIG. 13, each transmission 1300, as part of aforedescribed ball signal 50, can include: Ball ID, the transmission # from launch (#1, #2, . . . up to #X) as part of status information 1310, and a spin speed transmission as another part of status information 1310. Launch code 1306 can be attached to the launch data so that the system understands that the associated data is to be used for purposes of characterizing launch data. The GTLs, associated with the launch zone, can pick up these transmissions, and because each GTL is sufficiently synchronized in time, each can time stamp a receive time and transmit the launch zone reception data. Again, using the aforedescribed differential time method, data obtained from at least five ground transceivers is used to determine the three dimensional position in space of the ball, relative to the receiving ground launch transceivers that are associated with the launch zone. Because each ball can transmit many times on initial launch, there can be many launch positions observed. In one embodiment, host 24' or the tee station computer receiving this data can calculate a least squares fit to obtain a trajectory (elevation and azimuth, illustrated as angles $\alpha_1$ and $\alpha_2$, in FIGS. 3 and 4*a*, respectively), and using these positions, along with associated time information, can also determine velocity. In fact, this data can be quite accurate. If spin information is not transmitted by the ball itself, the wireless GTs, associated with the launch zone, can monitor the RF amplitude modulation, which can correspond to the internal antenna spin and, hence, ball spin.

Figure 14A:
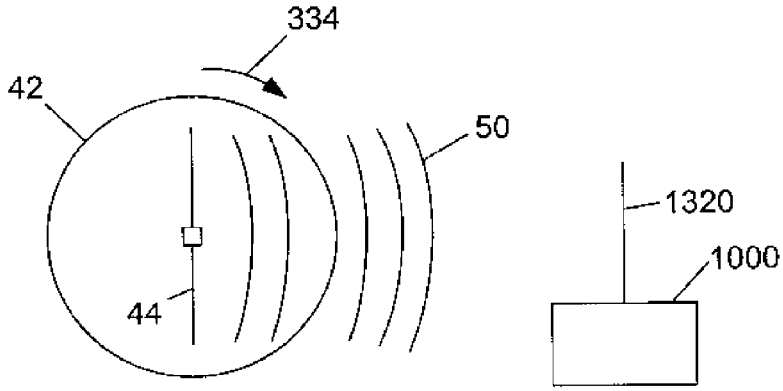
FIGS. 14*a* and 14*b* are diagrammatic views of a ball assembly including an internal antenna, shown here to illustrate aspects of the detection of ball spin.
Figure 14B:
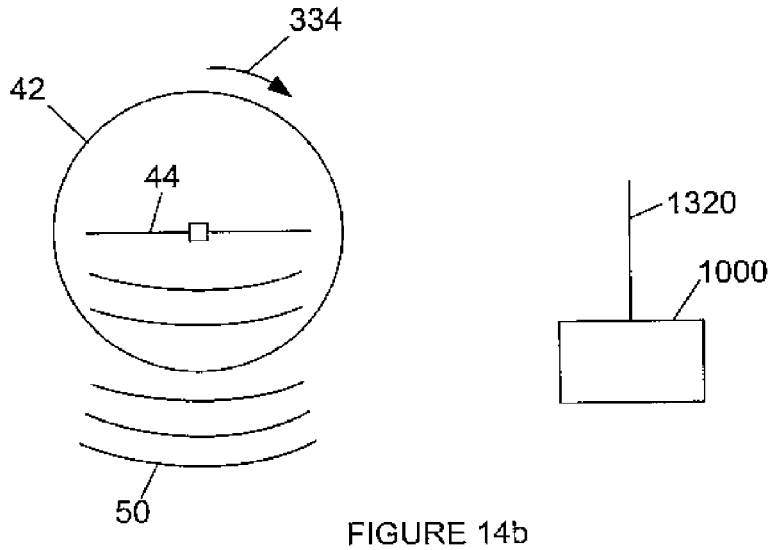

Turning now to FIGS. 14*a* and 14*b*, detection of ball spin will now be discussed in accordance with one embodiment. These figures illustrate ball 42 with antenna 44 spinning as indicated by an arrow 334 relative to a GTL 1000 (wired or wireless) having an antenna 1320 for receiving ball signal 50. The ball is shown as having rotated by ninety degrees from FIG. 14*a* to FIG. 14*b*. The ball is launched with spin, with only possibly a few exceptional cases. Internal to the ball, a suitable set of antennas is provided such as, for example, aforedescribed antenna 44. The arrangement of these antennas can provide a constant carrier frequency transmission from the ball during spinning, at rotational angular velocity 1321. For purposes of simplification of the present discussion, a single dipole antenna is shown as antenna 44, although this is not a requirement and additional antennas may be provided. As is well known in the art of antenna transmission characteristics, the amplitude of a signal when antenna 1320 is in the position of FIG. 14*a*, relative to the receiving antenna, can be high. When the ball is in the position of FIG. 14*b*, relative to receiving antenna 1320, the amplitude can be low. As the ball spins, this varying amplitude (called carrier amplitude modulation) will vary at a rate that is directly proportional to the spin rate. For purposes of this discussion, it is assumed that the ball is spinning such that the antenna is spinning in the plane of the subject figures to cause the signal received by the GT to be amplitude modulated. It should be noted that, if a more complex antenna system is designed, for any given ball orientation, some signal amplitude modulation will occur.

Figure 15:
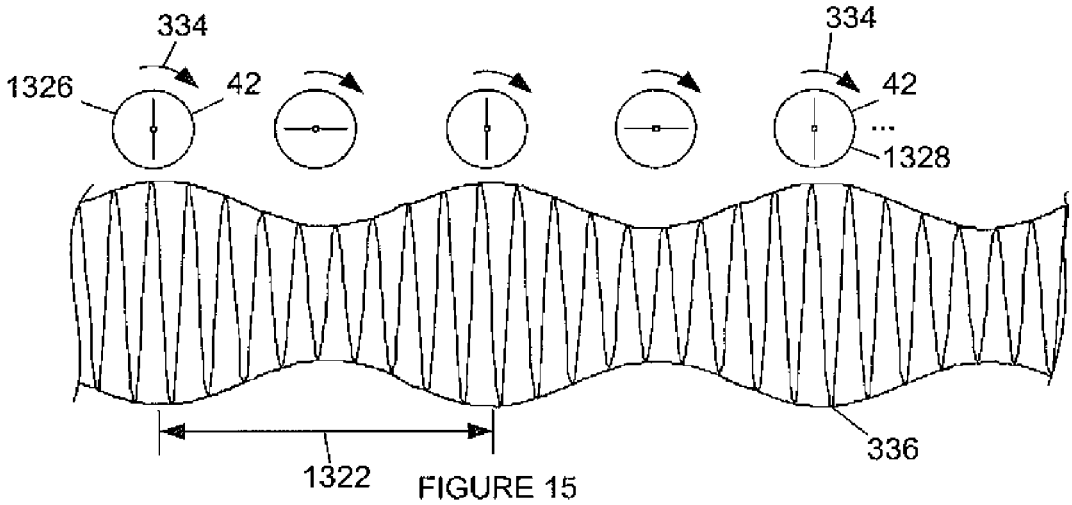
FIG. 15 is a diagrammatic illustration of an amplitude modulated carrier wave in association with ball/antenna orientation shown here to demonstrate a correspondence between spin and amplitude modulation.

Turning to FIG. 15, an amplitude modulated carrier wave 336 (also see FIG. 3) is received by the GTL of FIGS. 14*a* and 14*b*, as illustrated, with associated orientations of ball 42 being illustrated adjacent to the carrier wave. Carrier wave 336 is characterized by a repetition rate 1322. From observing the antenna in the ball, rotating adjacent to the carrier wave, it can clearly be seen that the repetition rate corresponds to one-half a rotation of the ball. Accordingly, the repetition rate or frequency for the modulation of the carrier wave is equal to twice the rotation rate of the ball. In the present example with antennas 44 and 1320 always in the same plane, the modulation causes carrier wave 336 (also see FIG. 3) to instantaneously go to zero amplitude (100%) modulation. However, a 25% modulation has been illustrated for purposes of enhancing the reader's understanding.

Referring to FIGS. 14*a*, 14*b* and 15, GTL (ground launch transceiver) 1000 receives this RF transmission during the launch phase of the ball flight, earlier described as transmissions during time interval I1 of FIG. 10. It is during interval I1 that this spin information is retrieved in the launch zone by the GTLs near the launch position. As should be appreciated by one having ordinary skill in the art, there are many possible techniques that can be used to identify repetition rate 1322, but it should be remembered that the principle that has been brought to light herein remains applicable, irrespective of what sort of data modulation technique is employed. That is, the amplitude of the carrier will experience modulation through two full cycles of amplitude when the ball antenna spins from position 1326 to position 1328, as shown in FIG. 15. These two full cycles, as noted above, mean the ball has actually completed just one rotation. For some cases, the actual shape and amplitude of the carrier wave can be more complex than what is described, but the governing principle is nonetheless applicable with respect to amplitude modulation of the carrier, when a non-omnidirectional antenna is used. In order to make an accurate determination of the actual rotational velocity, it is desirable to obtain more information than that which is associated with a single rotation, and it may be desirable to obtain information corresponding to a plurality of rotations.

Figure 16:
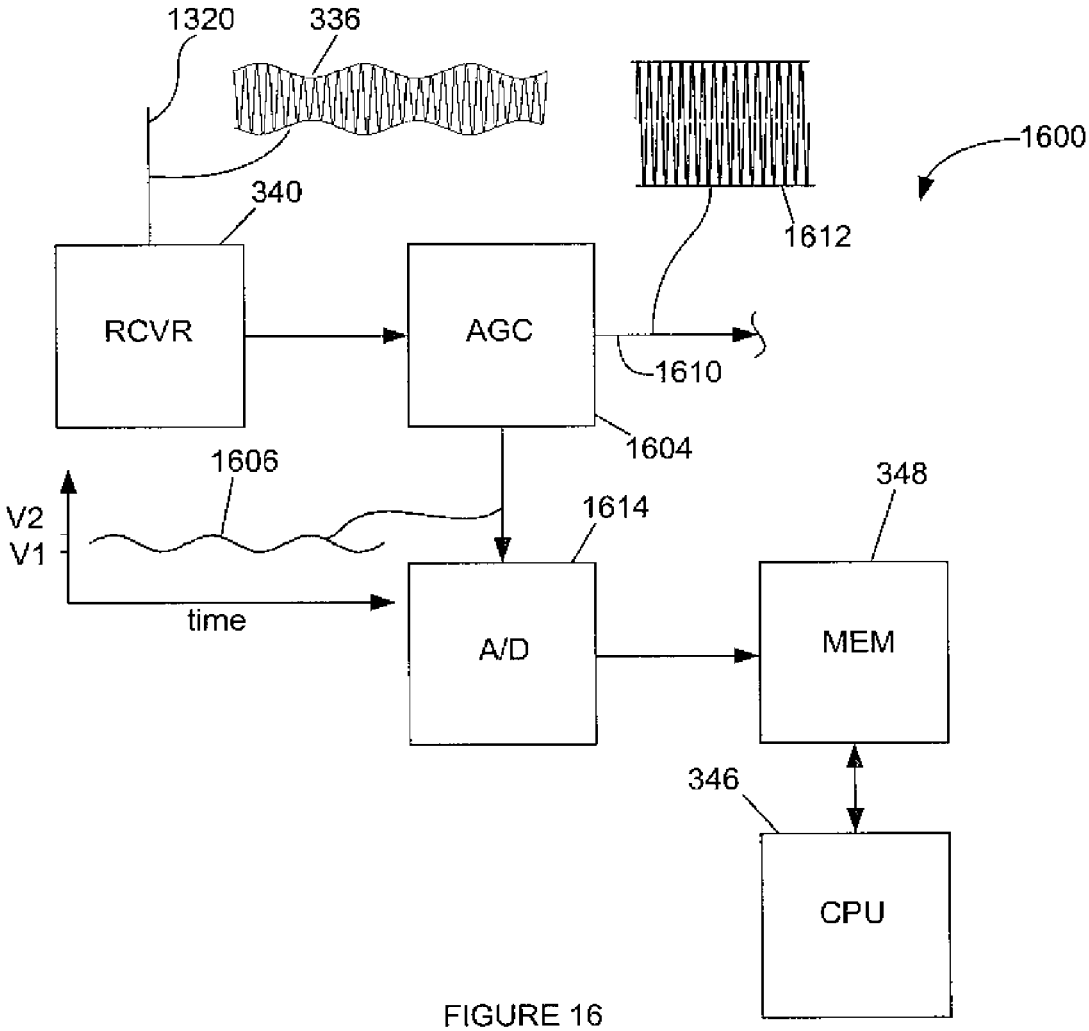
FIG. 16 is a block diagram of one embodiment of an arrangement for characterizing the carrier wave of FIG. 15.

Turning to FIG. 16, one embodiment of an arrangement for characterizing carrier wave 336 is generally indicated by the reference number 1600. It is noted that the components of the present figure are located in a GTL. The RF signal is received at a receiver front end using well known receiver technology. This signal may be of many forms, including a simple carrier wave, spread spectrum transmission, or other suitable forms that are well known in the art of RF transmission. The RF signal is amplified and passed to an AGC section 1604 that can be typical of AGC sections that are included in receiver designs or in other systems that receive signals that may vary in amplitude such as hard disk drive signals out of a preamp, satellite communications signals, cell phone communication, normal automobile AM/FM radio transmissions and the like. Hence, detailed descriptions of the operation of the AGC section are not included for purposes of brevity. It is recognized, however, that an appropriate AGC section can be used to even out a signal that modulates in amplitude, so that when the signal is passed on to a subsequent stage, the amplitude is more consistent. The speed and performance of an AGC system is dependent on its application, however, an AGC section can be designed so that an AGC output 1606 of the AGC amplifier, can be observed and used. A signal output 1610 outputs a more uniform amplitude version 1612 of the original RF signal, which at least partially removes the spin induced amplitude modulation for use by other sections which have not been shown since that are not relevant to the present discussion. AGC output 1606 varies with how the "gain" of the amplifier is being varied to attempt to maintain an output amplitude of the signal output 1610 that is nearly constant. AGC output voltage 1606 varies at the same frequency as the amplitude modulation of carrier wave 336. Accordingly, in one embodiment, this voltage can be sampled periodically by an A/D converter 1614 which converts AGC output 1606 to a digital signal, which is then saved in memory 348 for future processing. If a plurality of the modulation cycles can be sampled during I1, then this information is stored in memory 348. Processor 346 determines an average spin during time interval I1. Using one technique, based on the waveforms shown, the spin RPM can be established by determining the period of time (on average) that is required to modulate at least two cycles (corresponding to at least a 360 degree rotation of the ball). It is not of concern if these amplitudes are equal in magnitude, but only that a modulation pattern is identifiable. For example, assume the ball is spinning at 5000 RPM. This corresponds to an average time for one ball rotation of 12 ms (0.012 seconds). Accordingly, if an average measurement of 12 ms is made over one ball rotation, the ball spin speed can be calculated as 5000 RPM. The spin can be determined in essentially the same manner by any appropriately configured GT that receives the modulated signal. The most common method of signal processing performed by the CPU is the well known FFT (fast fourier transform). This method yields all frequency components below the Nyquist frequency (½ the sample rate of the A/D). Therefore, even complex shapes of the amplitude envelope using this type of signal processing scheme will yield correct information.

FIGS. 17*a-d* are screen shots that diagrammatically illustrate a number of system displays that may be presented on tee station display 328 (FIGS. 3, 4*a* and 4*b*) to a golfer. In each figure, the range is indicated by the reference number 2000, showing four targets that are labeled 1-4. The range display can be customized for a particular range in any suitable way. A tee-station 28 is indicated as being associated with the particular tee-station that is in use and is shown in an actual angular orientation with respect to the targets in a plan view. Display 328, in the present example, is a touch screen and is providing a golfer with the opportunity to select one of the four targets.

Figure 17A:
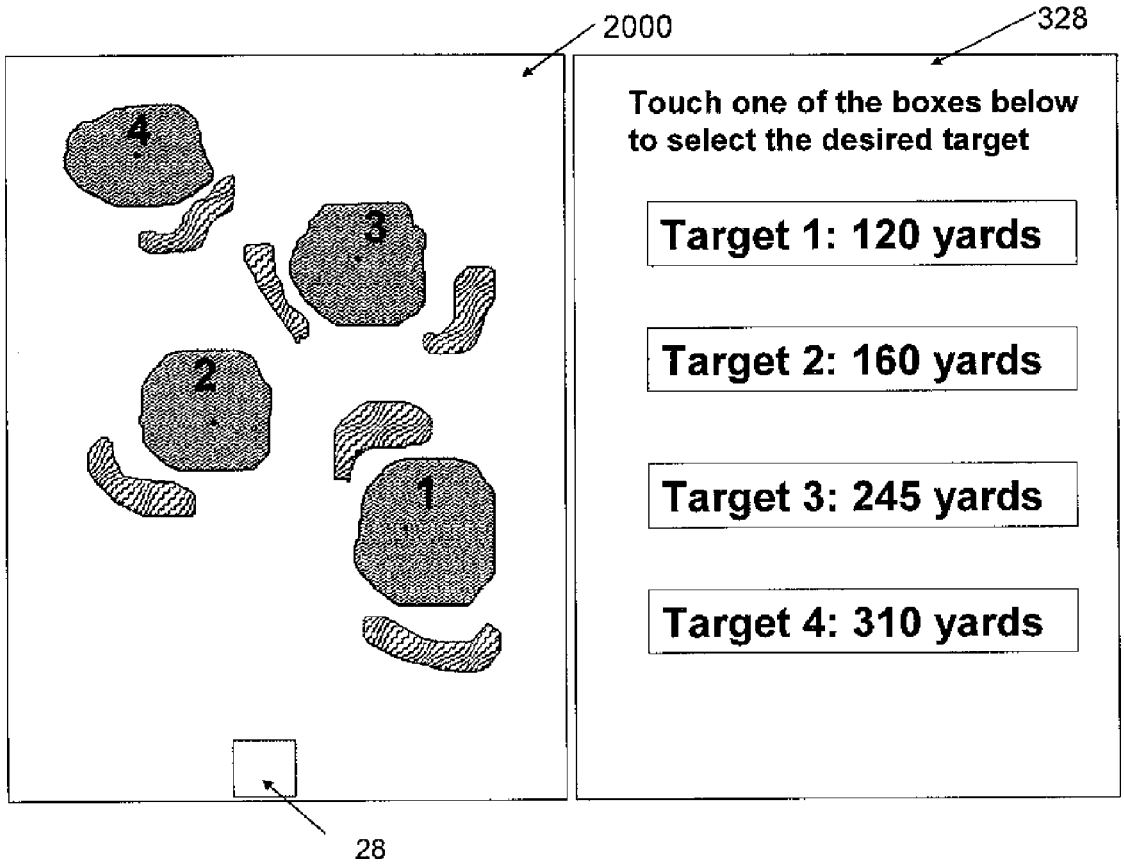
FIGS. 17*a*-*d* are screen shots that diagrammatically illustrate a number of system displays that may be presented on tee station display 328 to a golfer.
Figure 17B:
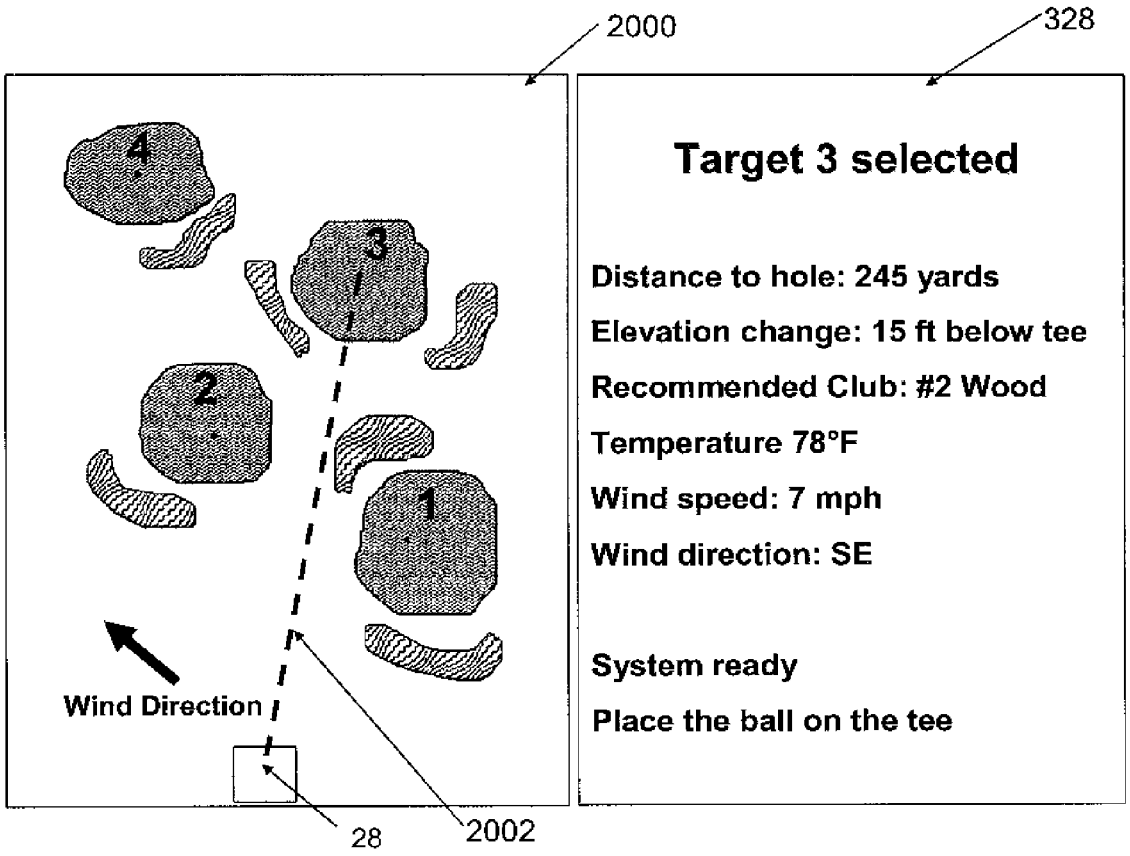

FIG. 17*b* indicates that the golfer has selected target 3 and provides information to the golfer relating to target 3 which can be customized for the particular tee-station that is in use. Club information, as well as weather information including wind speed and direction are also shown, along with an indication that the system is ready for placement of the ball on the tee. A desired shot path is illustrated by a dashed line 2002 that extends from the tee station to the target 3 hole. Any suitable combination of these various items may be presented.

Figure 17C:
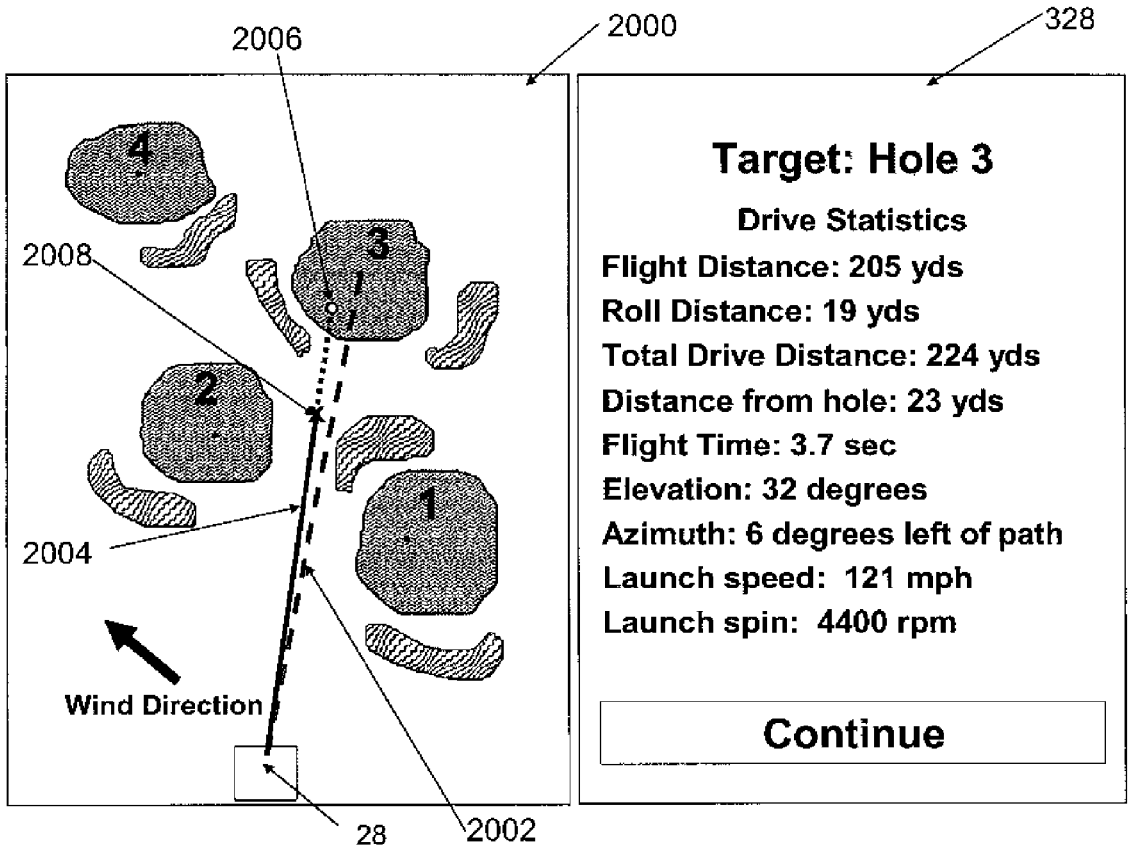

FIG. 17*c* is a post shot display which presents information to the golfer for the shot that was just completed. Any suitable combination of these various items may be presented. In the present example, an actual shot path 2004 is shown extending to a rollout position 2006. Different colors can be used to show the path from the tee to the landing site and the continuing roll from the landing site to the final rollout position of the ball. In the present example, the landing position is shown by an "x" that is indicated by the reference number 2008. Detailed information is presented with respect to the various aspects of the flight of the ball. A continue button is available for selection once the golfer is ready to continue. A line from tee station 28 to landing position 2008, corresponding to a projection of the flight of the ball on the ground, is shown as a dashed line. Another line from landing position 2008 to roll out or final position 2006 is dashed.

Figure 17D:
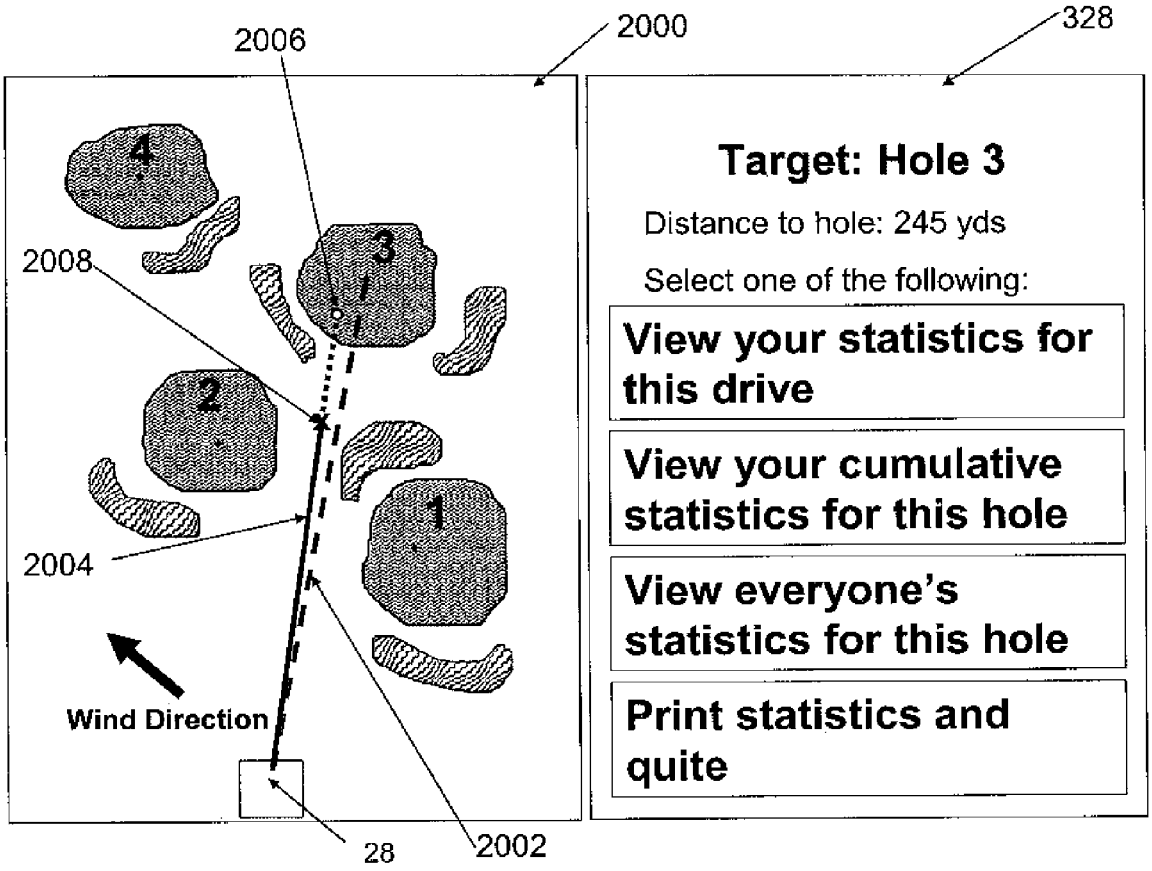

FIG. 17*d* is a display that can follow the display of FIG. 17*c* and provides, by way of non-limiting example, some possible options which allow the golfer to put the last shot into statistical perspective.

By way of non-limiting example, the tables that appear below represent information that may be associated with events such as, for example, a hit ball, a physical location or any other relevant items of interest. The items that are set forth may be used in any desired combination and in combination with additional items that are not shown.

TABLE 2

| Hit Ball Items | |
|---|---|
| Hit Ball Fields | Description |
| Ball ID | The unique ID of the ball that was hit |
| User ID | The user ID that hit the ball |
| Range ID | The ID of the range the ball was hit on |
| Club ID | The ID of the club the ball was hit with |
| Weather ID | The ID of the weather information for the hit ball |
| Target ID | The ID of the target the ball was hit to |
| Tee ID | The ID of the tee the ball was hit from |
| Landing location | Coordinates of landing location |
| Resting location | Coordinates of resting location |
| Launch velocity | The velocity of the ball at launch |
| Launch trajectory | The launch trajectory of the ball |
| Spin | The spin data for the ball at launch |
| Flight time | The amount of time the ball was in the air |

TABLE 3

| Tee/Tee-Station Items | |
|---|---|
| Tee Table | |
| Tee ID | The ID of the tee |
| Range ID | The Range ID the tee is on |
| Tee location | Tee location in the range (Relative to GTa) |
| Tee direction | Direction of tee on range |
| Tee altitude | Altitude of the Tee |

TABLE 4

| Weather Related Items | |
|---|---|
| Weather Table | |
| Weather ID | The ID of the weather information |
| Range ID | The ID of the range where the weather info is from |
| Wind speed | The speed of the wind |
| Wind direction | Wind direction |
| Humidity | The humidity |
| Temperature | The temperature |

TABLE 5

| Club Related Items | |
|---|---|
| Club Table | |
| Club ID | Unique club ID |
| User ID | User ID of the club |
| Club type | The type of club (7 iron, driver, etc.) |
| Club Manufacturer | The manufacturer of the club |

TABLE 6

| Target Related Items | |
|---|---|
| Target Table | |
| Target ID | The target ID |
| Range ID | The range ID the target is on |
| Range Location | Coordinates of range (GPS coordinates: multiple locations that define the range |
| Target Type | The type of target |
| Target location | GPS coordinates of the target |
| Target altitude | The altitude of the target |

TABLE 7

| User Related Items | |
|---|---|
| User Table Database Fields | Description |
| User ID | The unique ID of the user |
| Name | The name of the user |
| Registration Information | Fields holding registration information of the user |

TABLE 8

| Range Related Items | |
|---|---|
| Range Table Database Fields | Description |
| Range ID | Unique range ID |
| Location | The location of the range |
| Altitude | The altitude of the range |
| Name | The name of the range |

Although each of the aforedescribed physical embodiments have been illustrated with various components having particular respective orientations, it should be understood that the present invention may take on a variety of specific configurations with the various components being located in a wide variety of positions and mutual orientations. Furthermore, the methods described herein may be modified in an unlimited number of ways, for example, by reordering the various sequences of which they are made up. Accordingly, having described a number of exemplary aspects and embodiments above, those of skill in the art will recognize certain modifications, permutations, additions and sub-combinations thereof. For example, although the invention has been described in the context of a golf driving range, it may be used in a wide variety of applications. For example, the invention can be used for purposes of tracking other types of balls or similar such items in sporting events including, for example, baseball, football and hockey. In the instance of baseball, it should be appreciated that the area of home plate bears similarities to a tee station.

What is claimed is:

1. In a system for characterizing the movement of a golf ball assembly on a golf range having lateral extents, a method comprising:

configuring the golf ball assembly for transmitting a ball signal at least from a landing impact location on the golf range based on a detected proximity of the golf ball assembly to a surface of the ground and for monitoring proximity to the surface of the ground to generate a ground proximity signal and indicating a flight status of the golf ball based on a capacitance that changes responsive to a current distance between the golf ball assembly and the surface of the ground at least to Indicate that the surface of the ground has been hit;

distributing a plurality of at least four ground transceivers across the lateral extents of the golf range;

determining positional coordinates of at least the four ground transceivers such that the four ground transceivers form a group of ground transceivers that are at known locations;

receiving the ball signal at each one of the ground transceivers in timed relation to one another;

identifying a selected one of the ground transceivers as a reference transceiver such that the arrival time of the ball signal at the selected ground transceiver serves as a reference arrival time;

establishing a set of arrival time differences including a difference in arrival time of the ball signal at each of the other three ground transceivers as compared to the reference arrival time at the reference ground transceiver; and determining a landing position of the golf ball assembly in two dimensions with respect to the lateral extents of the golf range based on the set of arrival time differences.

2. The method of claim 1 wherein said plurality of ground transceivers includes at least five ground transceivers in said group of ground transceivers such that a further additional ground transceiver is distributed across said lateral extents and such that the further additional ground transceiver contributes a further additional arrival time difference and said determining establishes the landing position of the golf ball assembly in three dimensions with respect to the golf range.

3. The method of claim 1 further comprising configuring the golf ball assembly for monitoring proximity to a surface of the ground to generate a ground proximity signal and indicating a flight status of the golf ball based on a capacitance that changes responsive to a current distance between the golf ball assembly and a surface of the ground has been hit.

4. The method of claim 3 wherein indicating is responsive at least to the golf ball assembly landing on the surface of the ground.

5. In a system for characterizing movement of a golf ball assembly on a golf range, a method comprising:

electronically detecting that the ball assembly has been hit and launched;

responsive to detection of the hit, transmitting an electromagnetic radio frequency ball signal from the ball assembly for a duration of a launch interval which duration is less than a flight time of the ball assembly following the hit, which ball signal is emanated having a non-uniform antenna pattern and having a generally constant amplitude and frequency such that said spin produces an amplitude variation in the received radio frequency signal and said hit produces a Doppler shift of the radio frequency when received, and receiving the ball signal during said launch interval to characterize a set of launch parameters that correspond to the hit at least including spin at time of launch by detecting said Doppler shift to indicate that the ball has been hit and detecting said amplitude variation and determining the spin based on said amplitude variation;

responsive to a timeout of the launch interval, temporarily terminating the transmission of the ball signal while the ball assembly is in-flight such that the ball signal is not transmitted for a remainder of the in-flight time of the ball assembly;

electronically detecting a landing of the ball assembly on the ground; and responsive to detection of the landing, initiating a landing interval by temporarily resuming transmission of the ball signal for at least approximately detecting a landing position of the ball assembly by transmitting the ball signal as a ball ID transmission in a plurality of discrete and randomly spaced apart periods during the landing interval; and receiving at least one ball ID transmission as the ball signal, during the landing interval, to identify a landing position of the ball assembly.

6. The method of claim 5, further comprising:

at a conclusion of the landing interval, terminating the transmission of the ball signal and initiating a rollout period to provide for rollout of the ball assembly subsequent to landing;

after a termination of the rollout period, temporarily resuming transmission of the ball signal for at least approximately detecting a resting position of the ball assembly by transmitting the ball signal as said ball ID transmission in a plurality of discrete and randomly spaced apart periods during a final position detection period; and receiving at least one ball ID transmission as the ball signal, during the final position detection interval, to identify the resting position of the ball assembly.

7. The method of claim 5 including configuring the golf ball assembly for monitoring proximity to a surface of the ground to generate a ground proximity signal and indicating a flight status of the golf ball based on a capacitance that changes responsive to a current distance between the golf ball assembly and a surface of the ground.

8. The method of claim 7 wherein indicating is responsive to at least one of the golf ball assembly landing on the surface of the ground and a vertical component of movement of the golf ball assembly away from the surface of the ground.

9. In a system for characterizing the movement of a plurality of golf ball assemblies that are simultaneously in play on a golf range, a method comprising:

configuring each ball assembly for transmitting a ball signal including a ball ID that is unique for each ball on the golf range and for monitoring proximity to a surface of the ground to generate a ground proximity signal and indicating said landing based on a capacitance that changes responsive to a current distance between the golf ball assembly and a surface of the ground;

for a given one of the ball assemblies that has been previously hit and is in-flight, electronically detecting a landing of the ball assembly on the ground using an electronics package in the given ball assembly;

responsive to detection of the landing by the given ball assembly, causing the electronics package to initiate a landing interval by transmitting a plurality of ball ID transmissions from the given ball assembly in a plurality of discrete and randomly spaced apart periods during the landing interval; and receiving at least one ball ID transmission from the given ball assembly, during the landing interval, to at least approximately identify a landing position of the given ball such that the landing position of the given ball is distinguishable from landing positions of other ones of the ball assemblies based on said plurality of random ball ID transmissions and a probability that at least one of the random ball ID transmissions from the given ball does not collide with another ball ID transmission from a different ball assembly;

at a conclusion of the landing interval, terminating the transmission of the ball signal from the given ball assembly and initiating a rollout period to provide for rollout of the given ball assembly subsequent to landing;

after termination of the rollout period, temporarily resuming transmission of the ball signal from the given ball assembly for at least approximately detecting a resting position of the given ball assembly by transmitting the ball signal as said ball ID transmission in a plurality of discrete and randomly spaced apart periods during a final position detection period; and receiving at least one ball ID transmission as the ball signal, during the final position detection interval, to identify the resting position of the given ball assembly.

10. The method of claim 9 including selecting said set of launch parameters at least to include spin at time of launch.

11. The method of claim 10 wherein transmitting the electromagnetic ball signal includes transmitting a radio frequency signal that is emanated from the ball having a non-uniform antenna pattern and having a generally constant amplitude such that said spin produces an amplitude variation in the received radio frequency signal and said receiving the ball signal includes detecting said amplitude variation and determining the spin based on said amplitude variation.

12. The method of claim 11 further comprising emanating said radio frequency signal having a generally constant frequency such that the hit of the ball produces a Doppler shift of the received radio frequency signal and detecting said Doppler shift to indicate that the ball has been initially hit.

13. The method of claim 9 including configuring the golf ball assembly for monitoring proximity to a surface of the ground to generate a ground proximity signal and indicating said landing based on a capacitance that changes responsive to a current distance between the golf ball assembly and a surface of the ground.

14. The method of claim 9, further comprising:

at a conclusion of the landing interval, terminating the transmission of the ball signal from the given ball assembly and initiating a rollout period to provide for rollout of the given ball assembly subsequent to landing;

after a termination of the rollout period, temporarily resuming transmission of the ball signal from the given ball assembly for at least approximately detecting a resting position of the given ball assembly by transmitting the ball signal as said ball ID transmission in a plurality of discrete and randomly spaced apart periods during a final position detection period; and receiving at least one ball ID transmission as the ball signal, during the final position detection interval, to identify the resting position of the given ball assembly.

* * * * *